US007899611B2

(12) United States Patent
Downs et al.

(10) Patent No.: US 7,899,611 B2
(45) Date of Patent: Mar. 1, 2011

(54) DETECTING ANOMALOUS ROAD TRAFFIC CONDITIONS

(75) Inventors: Oliver B. Downs, Redmond, WA (US); Alec Barker, Woodinville, WA (US); Robert C. Cahn, Federal Way, WA (US); Craig H. Chapman, Redmond, WA (US); Wayne Stoppler, Bothell, WA (US)

(73) Assignee: Inrix, Inc., Kirkland, WA (US)

( * ) Notice: Subject to any disclaimer, the term of this patent is extended or adjusted under 35 U.S.C. 154(b) by 859 days.

(21) Appl. No.: 11/556,648

(22) Filed: Nov. 3, 2006

(65) Prior Publication Data

US 2007/0208497 A1 Sep. 6, 2007

Related U.S. Application Data

(63) Continuation-in-part of application No. 11/367,463, filed on Mar. 3, 2006, now Pat. No. 7,813,870.

(60) Provisional application No. 60/778,946, filed on Mar. 3, 2006.

(51) Int. Cl.
*G06G 7/76* (2006.01)

(52) U.S. Cl. ..... 701/117; 701/119

(58) Field of Classification Search ..... 701/117, 701/119

See application file for complete search history.

(56) References Cited

U.S. PATENT DOCUMENTS 3,582,620 A 6/1971 Noetinger ..... 235/150.24
3,626,413 A 12/1971 Zachmann ..... 343/8
4,866,438 A 9/1989 Knisch ..... 340/936
4,985,705 A 1/1991 Stammler ..... 342/69
5,289,183 A 2/1994 Hassett et al. ..... 340/905

(Continued)

FOREIGN PATENT DOCUMENTS

DE 10063763 A1 7/2002

(Continued)

OTHER PUBLICATIONS

"Dash Express Automotive Navigation System," retrieved Aug. 3, 2007, from http://www.dash.net/product.php, 1 page.

(Continued)

*Primary Examiner*—Khoi Tran
*Assistant Examiner*—Brian J Broadhead
(74) *Attorney, Agent, or Firm*—Seed IP Law Group PLLC

(57) ABSTRACT

Techniques are described for automatically detecting anomalous road traffic conditions and for providing information about the detected anomalies, such as for use in facilitating travel on roads of interest. Anomalous road traffic conditions may be identified using target traffic conditions for a particular road segment at a particular selected time, such as target traffic conditions that reflect actual traffic conditions for a current or past selected time, and/or target traffic conditions that reflect predicted future traffic conditions for a future selected time. Target traffic conditions may be compared to distinct expected road traffic conditions for a road segment at a selected time, with the expected conditions reflecting road traffic conditions that are typical or normal for the road segment at the selected time. Anomalous conditions may be identified based on sufficiently large differences from the expected conditions, and information about the anomalous conditions may be provided in various ways.

46 Claims, 28 Drawing Sheets

U.S. PATENT DOCUMENTS

| | | | | |
|---|---|---|---|---|
| 5,337,082 | A | 8/1994 | Fredericks | 342/69 |
| 5,465,289 | A | 11/1995 | Kennedy, Jr. | 379/59 |
| 5,610,821 | A | 3/1997 | Gazis et al. | 364/444.2 |
| 5,663,720 | A | 9/1997 | Weissman | 340/934 |
| 5,673,039 | A | 9/1997 | Pietzsch et al. | |
| 5,696,502 | A | 12/1997 | Busch et al. | 340/905 |
| 5,745,865 | A | 4/1998 | Rostoker et al. | 701/117 |
| 5,827,712 | A | 10/1998 | Yokoyama et al. | 435/193 |
| 6,011,515 | A | 1/2000 | Radcliffe et al. | 342/453 |
| 6,119,013 | A | 9/2000 | Maloney et al. | 455/456 |
| 6,150,961 | A | 11/2000 | Alewine et al. | 340/995 |
| 6,292,742 | B1 | 9/2001 | Heimann et al. | 707/117 |
| 6,317,686 | B1 | 11/2001 | Ran | |
| 6,401,027 | B1 | 6/2002 | Xu et al. | |
| 6,463,382 | B1 | 10/2002 | Bullock | 701/117 |
| 6,480,783 | B1 | 11/2002 | Myr | 701/117 |
| 6,490,519 | B1 | 12/2002 | Lapidot et al. | 701/117 |
| 6,496,773 | B1 | 12/2002 | Olsson | 701/117 |
| 6,505,114 | B2 | 1/2003 | Luciani | 701/117 |
| 6,574,548 | B2 | 6/2003 | DeKock et al. | 701/117 |
| 6,594,576 | B2 | 7/2003 | Fan et al. | 701/117 |
| 6,650,948 | B1 | 11/2003 | Atkinson et al. | 700/66 |
| 6,664,922 | B1 | 12/2003 | Fan | 342/357.1 |
| 6,728,628 | B2 | 4/2004 | Peterson | 701/117 |
| 6,781,523 | B2 | 8/2004 | Matsui et al. | 340/910 |
| 6,832,140 | B2 | 12/2004 | Fan et al. | 701/33 |
| 6,862,524 | B1 | 3/2005 | Nagda et al. | 701/209 |
| 6,882,313 | B1 | 4/2005 | Fan et al. | 342/457 |
| 6,922,566 | B2 | 7/2005 | Puranik et al. | 455/456.2 |
| 6,973,319 | B2 | 12/2005 | Ormson | 455/456.1 |
| 6,989,765 | B2 * | 1/2006 | Gueziec | 340/905 |
| 7,026,958 | B2 | 4/2006 | Wainfan et al. | 340/995.13 |
| 7,027,915 | B2 | 4/2006 | Craine | 701/117 |
| 7,069,143 | B2 | 6/2006 | Peterson | 701/117 |
| 7,096,115 | B1 | 8/2006 | Groth et al. | 701/117 |
| 7,116,326 | B2 | 10/2006 | Soulchin et al. | 345/440 |
| 7,161,497 | B2 * | 1/2007 | Gueziec | 340/905 |
| 7,221,287 | B2 * | 5/2007 | Gueziec et al. | 340/905 |
| 7,375,649 | B2 * | 5/2008 | Gueziec | 340/905 |
| 7,508,321 | B2 * | 3/2009 | Gueziec et al. | 340/905 |
| 7,519,564 | B2 * | 4/2009 | Horvitz | 706/12 |
| 7,557,730 | B2 * | 7/2009 | Gueziec | 340/905 |
| 7,610,145 | B2 * | 10/2009 | Kantarjiev et al. | 701/204 |
| 2001/0047241 | A1 | 11/2001 | Khavakh et al. | |
| 2002/0051464 | A1 * | 5/2002 | Sin et al. | 370/466 |
| 2003/0028319 | A1 | 2/2003 | Khavakh et al. | |
| 2003/0069683 | A1 * | 4/2003 | Lapidot et al. | 701/117 |
| 2004/0039520 | A1 | 2/2004 | Khavakh et al. | |
| 2004/0249568 | A1 | 12/2004 | Endo et al. | |
| 2004/0267440 | A1 | 12/2004 | DeKock et al. | |
| 2006/0041927 | A1 | 2/2006 | Stark et al. | |
| 2006/0074551 | A1 * | 4/2006 | Zaitsu et al. | 701/209 |
| 2006/0103674 | A1 | 5/2006 | Horvitz et al. | 345/629 |
| 2006/0106530 | A1 | 5/2006 | Horvitz et al. | 701/117 |
| 2006/0106599 | A1 | 5/2006 | Horvitz | 704/219 |
| 2006/0106743 | A1 | 5/2006 | Horvitz | 706/21 |
| 2006/0122846 | A1 * | 6/2006 | Burr et al. | 705/1 |
| 2006/0149461 | A1 | 7/2006 | Rowley et al. | 701/202 |
| 2006/0155464 | A1 | 7/2006 | Smartt | 701/208 |
| 2006/0224797 | A1 * | 10/2006 | Parish et al. | 710/62 |
| 2006/0229802 | A1 | 10/2006 | Vertelney et al. | 701/200 |
| 2007/0005419 | A1 * | 1/2007 | Horvitz et al. | 705/14 |
| 2007/0073477 | A1 * | 3/2007 | Krumm et al. | 701/209 |
| 2007/0199050 | A1 * | 8/2007 | Meier | 726/4 |
| 2007/0208492 | A1 * | 9/2007 | Downs et al. | 701/117 |
| 2007/0208494 | A1 * | 9/2007 | Chapman et al. | 701/117 |
| 2007/0208495 | A1 * | 9/2007 | Chapman et al. | 701/117 |
| 2007/0208496 | A1 * | 9/2007 | Downs et al. | 701/117 |
| 2007/0208497 | A1 * | 9/2007 | Downs et al. | 701/117 |
| 2007/0208498 | A1 * | 9/2007 | Barker et al. | 701/117 |
| 2007/0208501 | A1 * | 9/2007 | Downs et al. | 701/119 |
| 2008/0021791 | A1 * | 1/2008 | Steelberg et al. | 705/26 |
| 2008/0046165 | A1 * | 2/2008 | Downs et al. | 701/117 |
| 2008/0059115 | A1 * | 3/2008 | Wilkinson | 702/179 |
| 2008/0071465 | A1 * | 3/2008 | Chapman et al. | 701/117 |
| 2008/0071466 | A1 * | 3/2008 | Downs et al. | 701/117 |
| 2008/0133517 | A1 * | 6/2008 | Kapoor et al. | 707/6 |
| 2008/0275309 | A1 * | 11/2008 | Stivoric et al. | 600/300 |
| 2008/0278328 | A1 * | 11/2008 | Chand et al. | 340/572.1 |
| 2009/0118996 | A1 * | 5/2009 | Kantarjiev et al. | 701/119 |

FOREIGN PATENT DOCUMENTS

| | | | |
|---|---|---|---|
| DE | 102004015880 | A1 | 11/2004 |
| JP | 2006090872 | A | 4/2006 |
| WO | 2004/021305 | | 3/2004 |
| WO | 2004/021306 | | 3/2004 |
| WO | 2006/005906 | | 1/2006 |

OTHER PUBLICATIONS

"Dash Navigation Unveils First Internet-Connected Auto Navigation Device," Sep. 26, 2006, Dash Navigation™, Inc., retrieved Aug. 3, 2007, from http://www.dash.net/news_pr-060925.php, 1 page.

"Inrix Advances Navigation with 'Nationwide Average Speeds'," Aug. 7, 2006, Inrix, Inc., retrieved Jul. 19, 2007, from http://www.inrix.com/news_NationwideAverageSpeeds_07Aug2006.asp, 1 page.

"Inrix Historical Traffic Improves Consumer Navigation Experience," Jul. 18, 2007, Inrix, Inc., retrieved Jul. 19, 2007, from http://www.inrix.com/news_NAS_18July2007.asp, 2 pages.

"LandSonar, Inc. Announces First-Ever Nationwide Traffic-Prediction Product," Jan. 22, 2006, LandSonar, Inc., retrieved Jul. 20, 2007, from http://www.landsonar.com/?p=55, 3 pages.

"NAVTEQ Launches NAVTEQ Traffic Patterns™ Database: *Historic Traffic Data is the Basis for Predicting Traffic Behavior and Enhancing Routes*," Jan. 5, 2007, NAVTEQ, retrieved Jul. 19, 2007, from http://www.navteq.com/webapps/NewsUserServlet?action=NewsDetail&newsId=479, 2 pages.

"TrafficCast International and LandSonar Introduce LPS Plus," Mar. 1, 2007, LandSonar, Inc., retrieved Jul. 19, 2007, from http://www.landsonar.com/?p=117, 2 pages.

"About LandSonar, Inc.," retrieved Apr. 27, 2006, from http://www.landsonar.com/?page_id=2, 2 pages.

"Award Abstract—#0349460—SBIR Phase II: Animated Real-Time Road Traffic Visualization for Broadcast and the Internet," National Science Foundation, retrieved Jul. 31, 2006, from http://www.nsf.gov/awardsearch/showAward.do?AwardNumber=0349460, 2 pages.

"Global Positioning Systems > Tracking Systems in the Yahoo! Directory," Yahoo!® Small Business Directory, retrieved Feb. 8, 2006, from http://dir.yahoo.com/Business_and_Economy/Business_to_Business/Navigation/Global_Positioning_Systems/Tracking_Systems, 8 pages.

"Powerful Tool Crunches Commutes," Mar. 8, 2005, National Science Foundation, retrieved Jan. 20, 2006, from http://www.beatthetraffic.com/aboutus/nsf20050308.htm, 2 pages.

"Seattle Area Traffic—Central Puget Sound Travel Times," Washington State Department of Transportation, retrieved Jan. 20, 2006, from http://www.wsdot.wa.gov/traffic/seattle/traveltimes/, 3 pages.

"Technology Overview," retrieved Apr. 27, 2006, from http://www.landsonar.com/?page_id=20, 3 pages.

BeatTheTraffic.com: The Right Traffic at the Right Time™, Homepage, retrieved Jan. 20, 2006, from http://www.beatthetraffic.com/, 1 page.

Graham-Rowe, D., "Smart Traffic Forecast Offers Seven-Day Predictions," Jun. 29, 2005, NewScientist.com, retrieved Jan. 20, 2006, from http://www.newscientist.com/article.ns?id=dn7605&print=true, 2 pages.

Green, D., "Navigating by Phone," Apr. 28, 2004, Palo Alto Weekly Online Edition, retrieved Jul. 27, 2006, from http://www.paloaltoonline.com/weekly/morgue/2004/2004_04_28.zipdash28ja.shtml, 3 pages.

Slawski, W., "Ending Gridlock with Google Driving Assistance (Zipdash Re-Emerges)," Jul. 6, 2006, retrieved Jul. 27, 2006, from http://www.seobythesea.com/?p=240, 3 pages.
Smith, B. "OmniTRACS Keeps on Trucking," Dec. 1, 2005, WirelessWeek.com, retrieved Feb. 7, 2006, from http://www.wirelessweek.com/index.asp?layout=articlePrint&articleID=CA6287997, 2 pages.
Utter, D., "Google Mobilizes Traffic Data," Jul. 25, 2006, webpronews.com, retrieved Jul. 27, 2006, from http://www.webpronews.com/topnews/topnews/wpn-60-20060725GoogleMobilizesTrafficData.html, 3 pages.
U.S. Appl. No. 60/628,267, filed Nov. 16, 2004, Horvitz.

* cited by examiner

210

| | 212a Variable | 212b Possible Values |
|---|---|---|
| 214a | IsSchoolDay | true, false |
| 214b | Precipitation | none, low, medium, high |
| 214c | StadiumXEvtType | none, football, concert, soccer, other |
| 214d | PercentBlackSegmentX-Y | [0, 1.0] |
| 214e | BlackStartSegmentX | notblack, 0, 5, 10, 15, …, 30 |
| 214f | SegmentXColorY | green, yellow, red, black |
| 214g | … | … |

*Fig. 2B*

220

| | Input Variables | | | | | | Output Variables | | | |
|---|---|---|---|---|---|---|---|---|---|---|
| | 222a | 222b | 222c | 222d | | 222e | 222f | 222g | 222h | 222i | 222j |
| | ***IsSchool Day*** | ***Precip-itation*** | ***StadiumX EvtType*** | ***PercentBlack SegmentX-Y*** | ***…*** | ***BlackStart SegmentN*** | ***Segment1 Color15*** | ***Segment1 Color30*** | ***…*** | ***SegmentN Color180*** |
| 224a | true | none | soccer | 0.22 | | 0 | red | black | | yellow |
| 224b | true | none | football | 0.05 | | notblack | green | red | | green |
| 224c | false | low | none | 0.13 | | 15 | green | black | | black |
| 224d | false | medium | concert | 0.07 | | 10 | yellow | yellow | | red |
| 224e | false | high | other | 0.11 | | 5 | green | green | | yellow |
| 224f | | | | | | | | | | |
| 224g | true | none | none | 0.16 | | notblack | green | green | | black |

*Fig. 2C*

Example Decision Tree for Segment1 at Future Time 60

DETECTING ANOMALOUS ROAD TRAFFIC CONDITIONS

CROSS REFERENCE TO RELATED APPLICATIONS

This application is a continuation-in-part of U.S. patent application Ser. No. 11/367,463, filed Mar. 3, 2006 and entitled "Dynamic Time Series Prediction of Future Traffic Conditions," which is hereby incorporated by reference in its entirety.

This application claims the benefit of provisional U.S. Patent Application No. 60/778,946, filed Mar. 3, 2006 and entitled "Obtaining Road Traffic Condition Information From Mobile Data Sources," which is hereby incorporated by reference in its entirety.

TECHNICAL FIELD

The following disclosure relates generally to techniques for automatically detecting anomalous road traffic conditions for use in facilitating travel on roads of interest, such as based on comparisons of actual and/or predicted traffic conditions information for a segment of road at a selected time to information about traffic conditions that are typical or otherwise normally expected for that road segment at that time.

BACKGROUND

As road traffic has continued to increase at rates greater than increases in road capacity, the effects of increasing traffic congestion have had growing deleterious effects on business and government operations and on personal well-being. Accordingly, efforts have been made to combat the increasing traffic congestion in various ways, such as by obtaining and providing information about current traffic conditions to individuals and organizations. One source for obtaining information about current traffic conditions in some larger metropolitan areas is networks of traffic sensors capable of measuring traffic flow for various roads in the area (e.g., via sensors embedded in the road pavement), and such current traffic condition information may be provided to interested parties in various ways (e.g., via frequent radio broadcasts, an Internet Web site that displays a map of a geographical area with color-coded information about current traffic congestion on some major roads in the geographical area, information sent to cellular telephones and other portable consumer devices, etc.).

However, while such current traffic information provides some benefits in particular situations, the lack of accurate information about comparative traffic conditions creates a number of problems. In particular, knowledge about comparative traffic conditions, such as when traffic conditions are currently or expected to become unusual or otherwise anomalous, would allow users to improve their travel, such as to initiate travel when current or expected future traffic conditions are better than typical, or to alter travel plans when current or expected future traffic conditions are worse than usual.

Accordingly, it would be beneficial to provide improved techniques for automatically detecting anomalous road traffic conditions for use in facilitating travel on roads of interest, as well as to provide additional related capabilities.

BRIEF DESCRIPTION OF THE DRAWINGS

FIGS. 2A-2J illustrate various graphical representations of predictive models for representing knowledge about traffic conditions in a given geographic area.

DETAILED DESCRIPTION

Figure 1A:
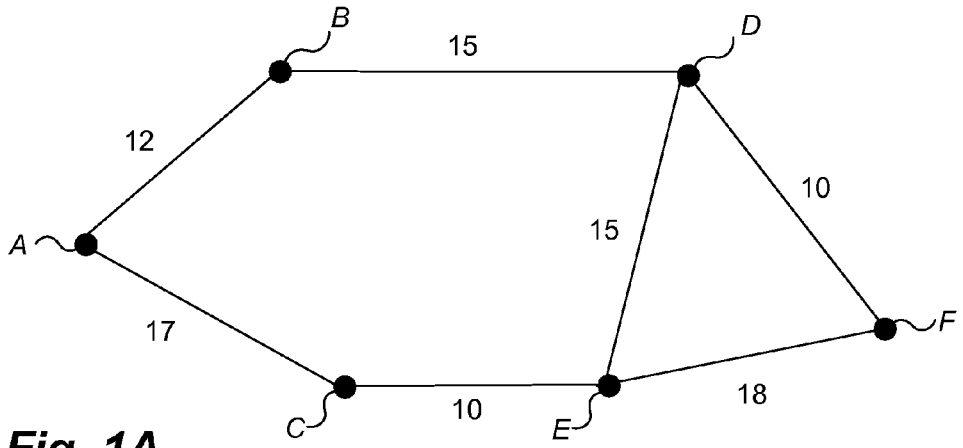
FIGS. 1A-1F illustrate examples of travel route selection based on predicted future traffic conditions.

Techniques are described for automatically detecting anomalous road traffic conditions and providing information about the detected anomalies, such as for use in facilitating travel on roads of interest. The detection of anomalous road traffic conditions is performed in at least some embodiments for each of one or more segments of roads at each of one or more selected times with respect to target traffic conditions that are identified to be analyzed for a particular road segment at a particular selected time, such as to identify target traffic conditions that reflect actual traffic conditions for a current or past selected time, and/or to identify target traffic conditions that reflect predicted future traffic conditions for a future selected time. The analysis of target traffic conditions for a selected segment of road at a selected time to detect anomalous road traffic conditions may include comparing the target traffic conditions for the road segment at the selected time to distinct expected road traffic conditions for the road segment at the selected time, with the expected conditions reflecting road traffic conditions that are typical or normal for the road segment at the selected time. When the target traffic conditions have sufficiently large differences from the expected conditions, corresponding anomalous conditions may be identified, and information about the anomalous conditions may be provided in various ways, as discussed below. In at least some embodiments, at least some of the described techniques for detecting anomalous road traffic conditions and providing information about the detected anomalies are automatically provided by an Anomalous Traffic Conditions Detector system, as described in greater detail below.

Traffic conditions data that is analyzed to detect anomalous conditions may reflect one or more of various types of traffic flow measurements in various embodiments (e.g., average traffic speeds, average traffic volume over a period of time, average traffic occupancy that reflects the average percentage of time that vehicles are occupying a particular location, etc.), as discussed in greater detail below. In addition, a particular type of traffic flow data may be detected as being anomalous based on differing in one or more ways from expected traffic flow data of that type, such as to be abnormal, atypical, unusual, or otherwise sufficiently different (e.g., so as to exceed a predetermined or dynamically determined threshold). Furthermore, the target traffic conditions data to be analyzed for anomalous conditions may be obtained in various ways in various embodiments. For example, current actual traffic conditions data may be obtained from various types of sources in various embodiments (e.g., road-based traffic sensors and/or mobile data sources related to vehicles traveling on roads), and in some embodiments may be obtained and analyzed as target traffic conditions in a substantially realtime or near-realtime manner (e.g., within a few minutes or less of the corresponding traffic). Predicted future traffic conditions data may be generated or otherwise obtained for a road segment for a future time (e.g., a time one or more hours in the future) in various ways in various embodiments (e.g., from a predictive traffic information provider system, as discussed in greater detail below), and expected road traffic conditions may also be determined in various ways in various embodiments, as discussed in greater detail below. In this manner, anomalies may be determined, detected, and/or identified that indicate that traffic conditions may be different (e.g., better or worse, faster or slower, etc.) than traffic conditions that would be expected to occur on a particular road segment during or at a particular time.

Information related to detected anomalous traffic conditions may be provided to users and/or other computer systems or applications in various ways in various embodiments. For example, as discussed in greater detail below, users may be provided with graphically displayed maps that indicate degrees or levels to which target traffic conditions differ from expected traffic conditions, such as via one or more Web pages or in other manners. In other embodiments, alerts or other notifications may be sent to client devices and/or client applications that are used or operated by users when specified circumstances occur, so that the client applications/devices may notify the users if appropriate that traffic is likely to differ from normal or other expectations. Furthermore, in some embodiments such information related to detected anomalous traffic conditions may be provided to other entities or systems that may use the information in various ways, including by making some or all of the provided information to customers or other users of the other entities and systems. In addition, information related to detected anomalies and other comparative traffic condition information may be used in other manners in at least some embodiments, as described in more detail below.

As previously noted, in at least some embodiments, predictions of future traffic conditions at multiple future times are generated in various ways. In some embodiments, the predictions are generated using probabilistic techniques that incorporate various types of input data in order to repeatedly produce future time series predictions for each of numerous road segments, such as in a real-time manner based on changing current conditions for a network of roads in a given geographic area. Moreover, in at least some embodiments one or more predictive Bayesian or other models are automatically created for use in generating the future traffic condition predictions for each geographic area of interest, such as based on observed historical traffic conditions for those geographic areas. Predicted future traffic condition information may be used in a variety of ways to assist in travel and for other purposes, such as to plan optimal routes through a network of roads based on predictions about traffic conditions for the roads at multiple future times, or to determine whether predicted future traffic conditions are anomalous with respect to expected traffic conditions. In at least some embodiments, a predictive traffic information provider system generates such predictions, as described in greater detail below.

In some embodiments, the types of input data used to generate predictions of future traffic conditions may include a variety of current, past, and expected future conditions, and outputs from the prediction process include the generated predictions of the expected traffic conditions on each of multiple target road segments of interest for each of multiple future times (e.g., every 5, 15 or 60 minutes in the future) within a pre-determined time interval (e.g., three hours, or one day), as discussed in greater detail below. For example, types of input data may include the following: information about current and past amounts of traffic for various target road segments of interest in a geographic area, such as for a network of selected roads in the geographic area; information about current and recent traffic accidents; information about current, recent and future road work; information about current, past and expected future weather conditions (e.g., precipitation, temperature, wind direction, wind speed, etc.); information about at least some current, past and future scheduled events (e.g., type of event, expected start and end times of the event, and/or a venue or other location of the event, etc., such as for all events, events of indicated types, events that are sufficiently large, such as to have expected attendance above an indicated threshold (for example, 1000 or 5000 expected attendees), etc.); and information about school schedules (e.g., whether school is in session and/or the location of one or more schools). Moreover, current and predicted future traffic conditions may be measured and represented in one or more of a variety of ways, such as in absolute terms (e.g., average vehicle speed, volume of traffic for an indicated period of time; average occupancy time of one or more traffic sensors, such as to indicate the average percentage of time that a vehicle is over or otherwise activating the sensor; one of multiple enumerated levels of roadway congestion, such as measured based on one or more other traffic condition measures; etc.) and/or in relative terms (e.g., to represent a difference from typical or from maximum). In addition, while in some embodiments the multiple future times at which future traffic conditions are predicted are each points in time, in other embodiments such predictions may instead represent multiple time points (e.g., a period of time), such as by representing an average or other aggregate measure of the future traffic conditions during those multiple time points. Furthermore, some or all of the input data may be known and represented with varying degrees of certainty (e.g., expected weather), and additional information may be generated to represent degrees of confidence in and/or other metadata for the generated predictions. In addition, the prediction of future traffic conditions may be initiated for various reasons and at various times, such as in a periodic manner (e.g., every five minutes), when any or sufficient new input data is received, in response to a request from a user, etc.

Some of the same types of input data may be used to similarly generate longer-term forecasts of future traffic conditions (e.g., one week in the future, or one month in the future) in some embodiments, but such longer-term forecasts may not use some of the types of input data, such as information about current conditions at the time of the forecast generation (e.g., current traffic, weather, or other conditions). In addition, such longer-term forecasts may be generated less frequently than shorter-term predictions, and may be made so as to reflect different future time periods than for shorter-term predictions (e.g., for every hour rather than every 15 minutes). Furthermore, in some embodiments and situations, the previously mentioned longer-term forecasts each correspond to a "full" or "complete" forecast that represents a best prediction for the corresponding future time using all relevant information that is available, while a default or baseline forecast may also (or instead) be generated that does not use all of the types of information used by the complete forecast, even if the unused information is available. For example, the default forecast may not consider any information about weather forecasts for the corresponding future time and/or about scheduled events for the corresponding future time. In some embodiments and situations, a generated default forecast may represent the subjective expectations of a group of one or more users for traffic conditions at a particular future time, such as if the users in the group have a conceptualized expectation for what traffic will be like at a particular future time (e.g., next Friday evening at 5:30 pm during a commute home along a particular road) without conceptually adjusting that expectation for particular unusual weather and/or for a particular large event in the area at that time. In addition, in some embodiments expected traffic conditions for a particular road segment at a particular future time may be obtained without generating a forecast or prediction, such as by merely using historical average traffic conditions for that road segment at similar prior times (e.g., for the same or similar day-of-week and the same or similar hour-of-day, but without differentiating based on seasons, holiday schedules, school schedules, event schedules, etc.).

As previously noted, anomalous traffic conditions (also referred to herein as "anomalies") may be detected in at least some embodiments for current actual traffic conditions, past actual traffic conditions, and/or future predicted traffic conditions, and by comparing target traffic conditions data for a road segment at a given time to expected traffic conditions data for the road segment at the given time. Different embodiments may utilize various combinations of target conditions data and expected traffic conditions data. For example, target traffic conditions data may include current traffic conditions data for a current time, and expected traffic conditions data may include default forecast traffic conditions data for the current time, such that a detected anomaly is with respect to actually occurring current traffic conditions. In other embodiments, target traffic conditions data may include predicted traffic conditions data for a future time that are generated using all available relevant data (e.g., information about planned roadwork for the future time; about a current traffic accident that may affect traffic conditions at the future time, such as if the future time is within the next hour or so; etc.), and expected traffic conditions data may include data that reflects average or other typical conditions at the future time without considering some types of currently available data (e.g., by using baseline forecast information that is generated without using current information about weather, realtime traffic accidents and other incidents, scheduled events, etc., even if that unused information is available when the forecast traffic conditions data is generated; by using historical average traffic conditions data; etc.). Other combinations and variations are possible, and are described in more detail below.

The roads and/or road segments for which future traffic condition predictions and/or forecasts are generated may also be selected in various manners in various embodiments. In some embodiments, future traffic condition predictions and/or forecasts are generated for each of multiple geographic areas (e.g., metropolitan areas), with each geographic area having a network of multiple inter-connected roads—such geographic areas may be selected in various ways, such as based on areas in which current traffic condition information is readily available (e.g., based on networks of road sensors for at least some of the roads in the area) and/or in which traffic congestion is a significant problem. In some such embodiments, the roads for which future traffic condition predictions and/or forecasts are generated include those roads for which current traffic condition information is readily available, while in other embodiments the selection of such roads may be based at least in part on one or more other factors (e.g., based on size or capacity of the roads, such as to include freeways and major highways; based on the role the roads play in carrying traffic, such as to include arterial roads and collector roads that are primary alternatives to larger capacity roads such as freeways and major highways; based on functional class of the roads, such as is designated by the Federal Highway Administration; etc.). In other embodiments, future traffic condition predictions and/or forecasts may be made for a single road, regardless of its size and/or inter-relationship with other roads. In addition, segments of roads for which future traffic condition predictions and/or forecasts are generated may be selected in various manners, such as to treat each road sensor as a distinct segment; to group multiple road sensors together for each road segment (e.g., to reduce the number of independent predictions and/or forecasts that are made, such as by grouping specified numbers of road sensors together); to select road segments so as to reflect logically related sections of a road in which traffic conditions are typically the same or sufficiently similar (e.g., strongly correlated), such as based on traffic condition information from traffic sensors and/or from other sources (e.g., data generated from vehicles and/or users that are traveling on the roads, as discussed in greater detail below); etc.

In addition, future traffic condition prediction and/or forecast information may be used in a variety of ways in various embodiments, as discussed in greater detail below, including to provide such information to users and/or organizations at various times (e.g., in response to requests, by periodically sending the information, etc.) and in various ways (e.g., by transmitting the information to cellular telephones and/or other portable consumer devices; by displaying information to users, such as via Web browsers and/or application programs; by providing the information to other organizations and/or entities that provide at least some of the information to users, such as third parties that perform the information providing after analyzing and/or modifying the information; etc.). For example, in some embodiments, the prediction and/or forecast information is used to determine suggested travel routes and/or times, such as an optimal route between a starting location and an ending location over a network of roads and/or an optimal time to perform indicated travel, with such determinations based on predicted and/or forecast information at each of multiple future times for one or more roads and/or road segments.

For illustrative purposes, some embodiments are described below in which specific types of predictions are generated in specific ways using specific types of input, and in which generated prediction information is used in various specific ways. However, it will be understood that such future traffic predictions may be generated in other manners and using other types of input data in other embodiments, that the described techniques can be used in a wide variety of other situations, that future traffic forecasts may similarly be generated and used in various ways, and that the invention is thus not limited to the exemplary details provided.

FIGS. 1A-1F illustrate examples of performing travel route selection based on predicted future traffic conditions. In particular, FIG. 1A illustrates multiple potential travel routes between a starting point A and a destination point F in the form of an undirected graph, with intermediate nodes labeled B-E—for example, listing nodes in order along a route, one potential route is ABDF, while other potential routes are ABDEF, ACEF and ACEDF. In addition, the edges between the nodes in FIG. 1A are each labeled with a predicted time to travel between the two nodes connected by the edge. For example, at a starting time T1 represented by the graph, the predicted time to travel between node A and node B is 12 minutes and the predicted time to travel between node A and node C is 17 minutes. Similarly, for someone departing node B at starting time T1 and heading toward node D along edge BD (with an edge being represented by the node labels at the two ends of the edge), the predicted time for travel is 15 minutes. In other embodiments, other types of predicted information may instead be used as part of such travel route selection, such as predicted traffic congestion or predicted average speed.

Figure 1B:
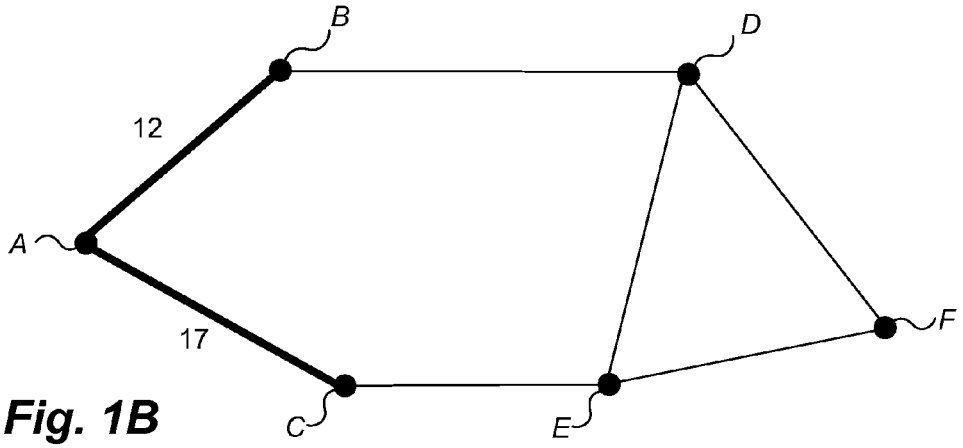
Figure 1C:
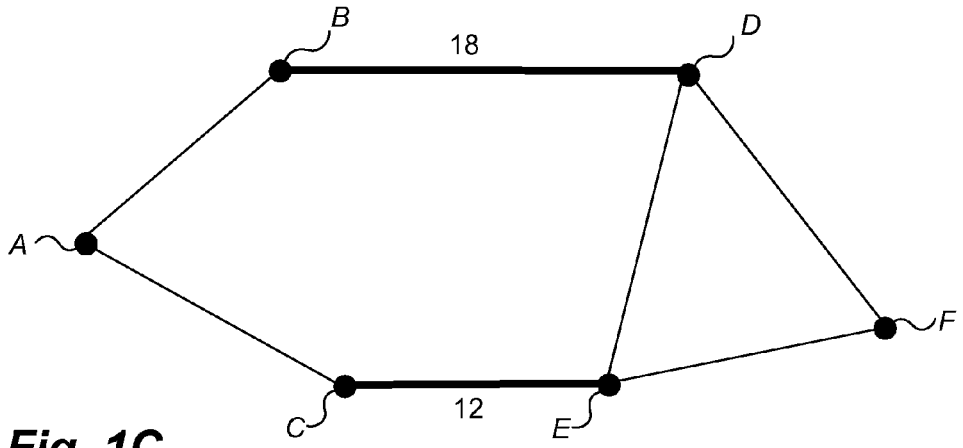
Figure 1D:
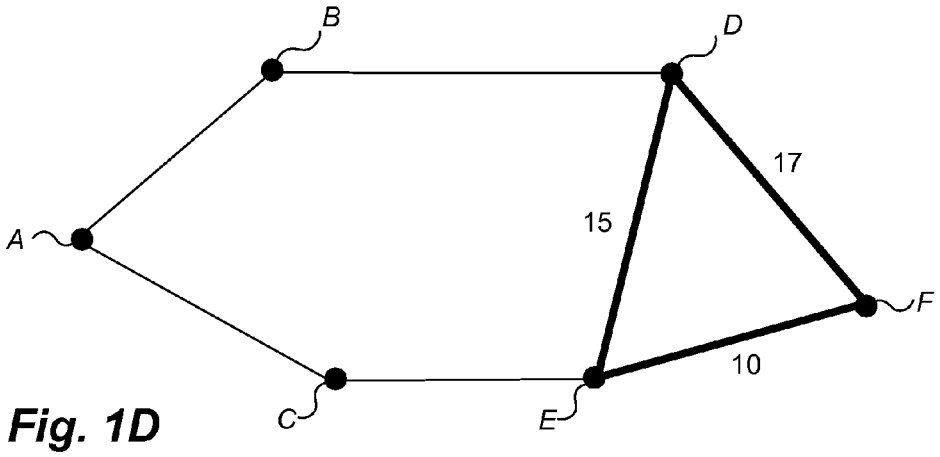

Thus, FIG. 1A illustrates the entire route graph at a single starting time T1 (e.g., 5 PM), such as for edges traveled by vehicles starting at any of the graph nodes at that starting time. Conversely, FIGS. 1B-1E illustrate various views showing predicted traffic condition information for multiple future times for use by the route selection process from node A to node F, with the intervals between each of the future times in this example being 15 minutes. For example, FIG. 1B illustrates a portion of the route graph based on predicted travel times for time T1 that are for use during a first time period beginning at starting time T1 and continuing until time T2, which in this example is a 15-minute time period from 5 PM until 5:15 PM, but shows only predicted time information that is relevant during that first time period for the route selection process, which in this example is for edges AB and AC. In particular, since edges beyond nodes B and C will not be reached in this example until the first time period is complete or substantially complete, the predicted traffic information at time T1 5 pm for edge CE (for example) is not of use since a vehicle would not reach that edge until a second time period of 5:15 pm-5:30 pm. Accordingly, FIG. 1C illustrates predicted travel information for the route graph during the second time period, such as based on predicted travel times for time T2 5:15 PM, with only predicted travel times for edges BD and CE shown since those edges correspond to road segments that would possibly be traveled by a vehicle that left node A at 5 pm. Similarly, FIG. 1D illustrates the route graph during a third time period between 5:30 and 5:45 PM, such as based on predicted travel times for time T3 5:30 PM, with the predicted travel times for edges DF, DE, and EF shown since those edges correspond to road segments that could be traveled by a vehicle that left node A at 5 pm. For purposes of simplification for this example, predicted travel times during a fourth time period between 5:45 PM and 6 PM (such as based on predicted travel times for time T4 5:45 PM) for edges DF, DE, and EF are the same as the predicted travel times for those edges during the third period, and the fourth time period times are not illustrated separately.

Figure 1E:
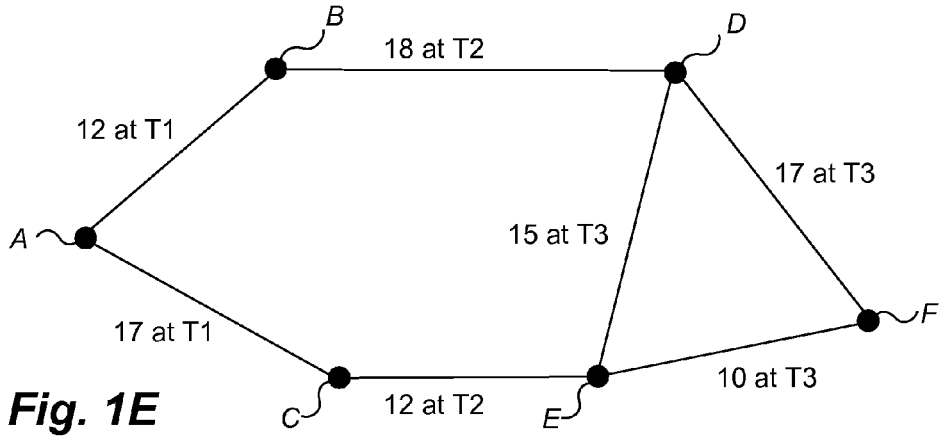

FIG. 1E illustrates a combined view of the information displayed in FIGS. 1B-1D, with predicted travel times for multiple future times being displayed. In particular, the edges are labeled with the predicted travel times that correspond to the time periods during which a vehicle traveling from source node A to destination node F would be expected to be traversing the route segments corresponding to the graph edges, with information displayed from left to right in the graph generally reflecting predictions relating to successively later time periods. Thus, the graph shows that the predicted travel time from A to B during the first time period is 12 minutes; from A to C during the first time period is 17 minutes; from B to D during the second time period is 18 minutes; from C to E during the second time period is 12 minutes; from D to E during the third time period is 15 minutes; from D to F during the third time period (and the fourth time period) is 17 minutes; and from E to F during the third time period (and the fourth time period) is 10 minutes.

Using the predicted travel times for these multiple time periods shown in FIG. 1E, it is possible to select the optimal route (in this example, the fastest route) from source node A to destination node F. In this simple example, total travel times for possible routes between the source and destination nodes are as follows (not counting routes in which a vehicle backtracks over a previously traveled edge): ABDF (total time=47); ABDEF (total time=55); ACEF (total time=39); and ACEDF (total time=61). Thus, based on the predictions made at the current time for the multiple future time periods, route ACEF will be the fastest route between source node A and destination node F, with an expected travel time of 39 minutes.

Returning to FIG. 1A, in which the predicted times for the entire route graph during the first time period are shown, this route group illustrates how a non-optimal route would be selected using this information since predicted travel times for future time periods are not considered. In particular, the predicted travel times for the same 4 routes using only the predicted first time period travel times are as follows: ABDF (travel time=37); ABDEF (travel time=60); ACEF (travel time=45); and ACEDF (travel time=52). Thus, this less-accurate information would have erroneously indicated that route ABDF would be the fastest route between source node A and destination node F with a time of 37 minutes, rather than the 47 minutes for that route that are indicated by using the predicted travel times indicated in FIG. 1E. Such inaccuracies may have arisen, for example, due to predicted increases in traffic congestion after the first time period, such as due to a scheduled event that causes traffic to significantly increase during the second and third time periods.

Figure 1F:
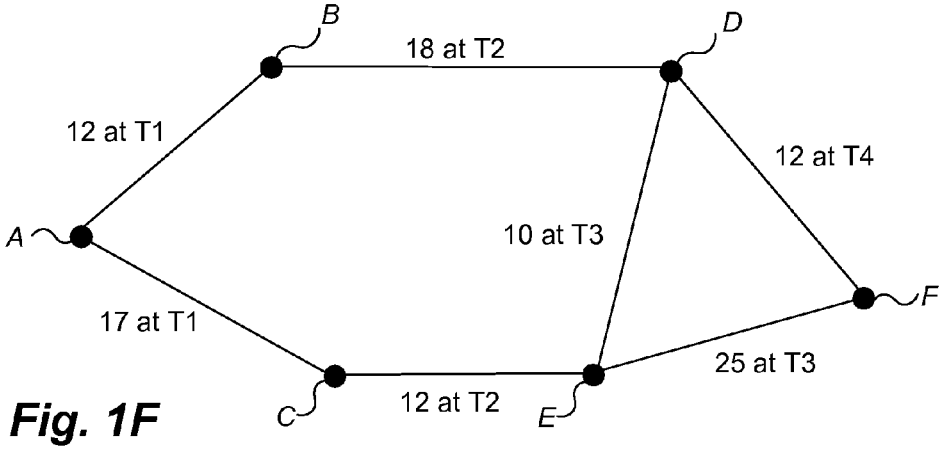

FIG. 1F shows a revised view of the information shown in FIG. 1E, and in particular shows updated predicted travel times for the third and fourth time periods with respect to edges DF, DE and EF. In this example, the updated predicted travel information is generated during the second time period based on new input information that became available at that time (e.g., an accident that occurred along a road corresponding to edge EF, thus significantly increasing predicted travel time for that edge), which may alter optimal routes between nodes in the graph. Such updated information may be particularly beneficial if it can be rapidly provided to users that are affected by changes in the predicted travel information. For example, a user who had begun traveling along route ACEF based on the predicted travel information shown in FIG. 1E would be traveling along a road corresponding to edge CE when the updated information becomes available, but the updated information indicates that traveling edge EF is no longer the optimal choice from node E—instead, traveling a revised route ED and DF is now predicted to take less time than the original edge EF route. If the user can be quickly notified while in transit, the user can thus dynamically adjust the route being taken to reflect the new predicted traffic information at multiple future time periods. Moreover, if the updated travel information had become available early in the first time period before a user had departed from node A, the user could be directed toward a new optimal route of ABDF.

Thus, FIGS. 1B-1F illustrate examples of using predicted future traffic conditions at multiple future times to provide benefits with respect to route planning.

FIGS. 2A-2F illustrate various graphical representations of example predictive models for representing knowledge about traffic conditions in a given geographic area. In some embodiments, such predictive models are automatically generated, maintained, and utilized to make predictions and/or forecasts regarding future traffic conditions at multiple future times, such as to predict future time series data for each road segment of interest. Such predictive models may include, but are not limited to, Bayesian or belief networks, decision trees, hidden Markov models, autoregressive trees, and neural networks. Some such predictive models may be probabilistic models, such as Bayesian network models, and such predictive models may be stored as part of one or more data structures on one or more computer-readable media.

FIGS. 2A-2D illustrate an example of the generation of a Bayesian network for representing probabilistic knowledge about traffic conditions. A Bayesian network is a directed acyclic graph ("DAG") consisting of nodes and edges. The nodes in the graph represent random variables, which may have discrete or continuous values that represent states in the domain being modeled. The edges in the graph represent dependence relationships between the variables. Nodes with no parents are root nodes. The probability distributions of root nodes are unconditional on any other nodes in the graph. A node with one or more parents has a probability distribution that is conditional on the probabilities of its parent nodes. By specifying the prior probabilities of the root nodes and the conditional probabilities of the non-root nodes, a Bayesian network graph can represent the joint probability distribution over all of the variables represented by nodes in the graph.

Figure 2A:
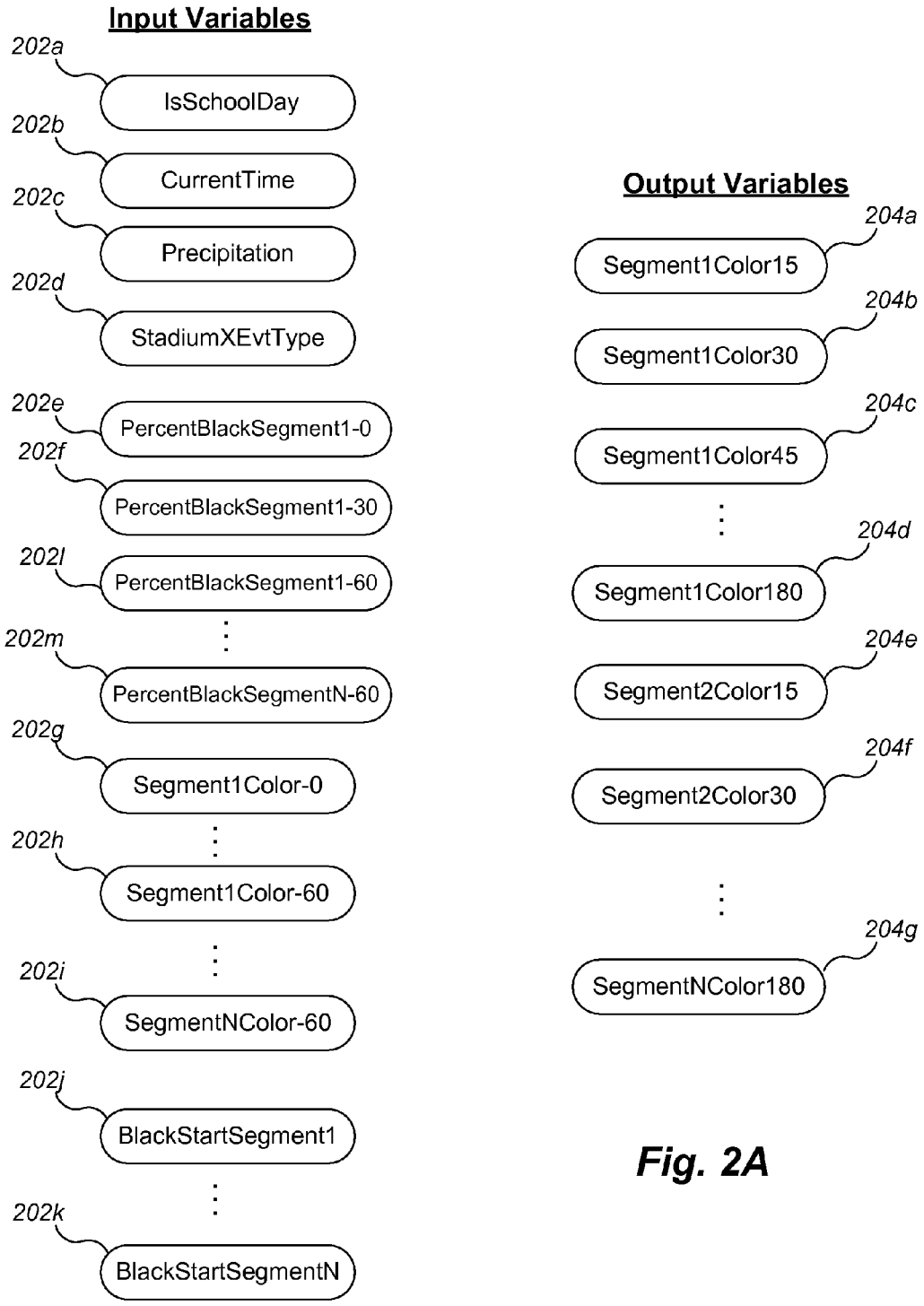

FIG. 2A illustrates an example collection of nodes that may be used to generate a Bayesian network predictive model for use in predicting traffic conditions. The illustrated nodes correspond to variables for which observed input data may be received, and to traffic conditions predictions that may be output with respect to a particular geographic area. In particular, nodes 202*a-m* represent various input variables for use in the predictive model, which in this example will correspond to root nodes in the Bayesian network that will be generated. The example input variables are as follows. Node 202*a* labeled IsSchoolDay may be used to represent whether school is in session on a particular day. Node 202*b* labeled CurrentTime may be used to represent the time of day. Node 202*c* labeled Precipitation may be used to represent an amount of precipitation over a particular time interval (e.g., the past 6 hours) or alternatively a current rate of precipitation. Node 202*d* labeled StadiumXEvtType may be used to represent the type of event (if any) that is scheduled for or currently taking place at stadium X. Nodes 202*e*, 202*f* and 202*l-m* may each be used to represent the traffic conditions on a particular road segment at the present time or at some time in the past, and in particular to represent the percentage of individual data sources (e.g., traffic sensors or other data sources) for that road segment that are reporting black (e.g., highly congested) traffic conditions at the time being represented—as previously noted, each road segment may be associated with one or more traffic sensors and/or with one or more other sources of traffic condition information for that road segment, as described in greater detail elsewhere. In some embodiments, traffic congestion level data for road segments is represented using colors (e.g., green, yellow, red, black) corresponding to enumerated increasing levels of traffic congestion, with green thus corresponding to the lowest level of traffic congestion and black corresponding to the highest level of traffic congestion. These nodes in this example are labeled PercentBlackSegmentX-Y, where X refers to a particular road segment and Y refers to a time in the past (e.g., in minutes, or other unit of time measurement) for which the percentage level of highly congested traffic on that road segment is being reported. For example, node 202*f* labeled PercentBlackSegment1-30 may be used to represent the percentage of black-level congestion for road segment Segment1 30 minutes ago.

Nodes 202*g-i* may each be used to represent the average or most common traffic conditions on a particular road segment at the present time or at some time in the past. These nodes are labeled SegmentXColor-Y in this example, where X refers to a particular road segment and Y refers to a time in the past (e.g., in minutes, or other unit of time measurement) at which a particular level of traffic congestion on that road segment has been identified (with the traffic congestion level represented here with its corresponding color). For example, node 202*h* labeled Segment1Color-60 may be used to represent the traffic conditions 60 minutes ago on road segment Segment1, with the level of traffic congestion at that time being illustrated with the appropriate congestion color. Nodes 202*j-k* may each be used to represent how long the levels of traffic congestion for a particular road segment have been continuously reported as being black. For example, node 202*j* labeled BlackStartSegment1 may be used to represent how long the level of traffic congestion on road segment Segment1 has been continuously reported as being black. A variety of other input variables may be used in other embodiments, such as to provide additional details related to various of the types of conditions shown or to represent other types of conditions, as discussed in greater detail below.

Nodes 204*a-g* in FIG. 2A represent output variables in the predictive model, and in particular correspond to predictions regarding traffic conditions that may be made given prior probabilities assigned to input nodes 202*a-m* and any current input information for those input nodes. Each output node 204*a*-204*g* in this example is labeled SegmentXColorY, where X refers to a particular road segment and Y refers to a time in the future for which a particular color corresponding to a level of traffic congestion on that road segment is predicted. For example, node 204*a* labeled Segment1Color15 may be used to represent the predicted traffic conditions on road segment Segment1 at 15 minutes in the future. For each road segment, traffic conditions are represented for a number of future times. For example, nodes 204*a*-204*d* represent the predicted traffic conditions on road segment Segment1 at 15-minute intervals over a three hour-long window into the future. In the illustrated embodiment, traffic conditions on N road segments are represented, each having 12 nodes corresponding to the twelve 15-minute time intervals over which traffic conditions are to be predicted. In other embodiments, larger or smaller future time windows and/or more or less time intervals may be represented.

FIG. 2B illustrates the possible values that may be taken by the variables corresponding to nodes depicted in FIG. 2A. In table 210, column 212*a* lists the variable name and column 212*b* lists the possible values the corresponding variable may take, which may be either continuous or discrete. Rows 214*a-g* each list an individual variable name and its corresponding range of values. For example, row 214*a* illustrates that the IsSchoolDay input variable may take the values true or false, corresponding to the observation that the current day is a school day or not, while row 214*b* illustrates that the Precipitation input variable may take one of the enumerated values of none, low, medium, or high. In this example, precipitation is measured as a discretized quantity over a fixed time interval for the sake of simplicity, although in other embodiments precipitation may be represented instead in other manners (e.g., as a continuous quantity of rain over a fixed time interval, as a current rate of rainfall, etc.). Row 214*c* illustrates that the StadiumXEvtType input variable may take one of the values none, football, concert, soccer, or other, although in other embodiments the event type may take on a greater or lesser number of possible values (e.g., a Boolean value indicating whether or not there is an event). Row 214*d* illustrates that each PercentBlackSegmentX-Y input variable may take a real numbered value in the closed interval from 0.0 to 1.0, representing the percentage of data points (e.g., road sensor readings, mobile data source values, etc.) or other sub-segments for the road segment SegmentX on which black traffic congestion level conditions are being reported at the corresponding time Y minutes in the past. Row 214*e* illustrates that each BlackStartSegmentX input variable may take one of the values notblack, 0, 5, 10, 15, . . . 30, with the "notblack" value indicating that the road segment SegmentX has not had a black traffic congestion level condition in the last 30 minutes, and with the other values indicating the closest number of minutes during the last 30 minutes that black traffic conditions have been continuously reported on the road segment SegmentX prior to the current time. For example, a value of 10 means that black traffic conditions have been continuously reported for approximately the last 10 minutes, and a value of 0 means that black traffic conditions have been continuously reported for zero minutes (or for less than 2½ minutes if time is rounded down) but that black conditions have previously been present during the last 30 minutes (otherwise, the notblack value would be used). Row 214*f* illustrates that the SegmentXColorY output variable may take one of the enumerated values green, yellow, red, or black, corresponding to increasing levels of traffic congestion reported on road segment X at Y minutes in the future. Row 214*g* illustrates that additional possible values for additional variables may be represented.

FIG. 2C illustrates a collection of example data corresponding to observations made regarding traffic conditions in a given geographic area. Each row represents an observation record consisting of related observations for each of multiple of the variables in the predictive model, such as to reflect a particular time or situation. In table 220, columns 222*a*-222*f* correspond to input variables represented by nodes 202*a-m* in FIG. 2A and columns 222*g*-222*j* correspond to output variables represented by nodes 204*a-g* in FIG. 2A, with some nodes not represented for the sake of clarity. For example, row 224*a* illustrates a first observation record corresponding to an observation at a time at which school was in session; no precipitation had been measured; a soccer event was scheduled to be occurring in stadium X; black traffic congestion level conditions were reported for 22 percent of road segment SegmentX at a time Y minutes ago; and black traffic congestion level conditions were continuously reported on road segment SegmentN for approximately zero minutes. In addition, 15 minutes after the above observations were made, red traffic congestion level conditions were reported on road segment Segment1; black traffic congestion level conditions were reported on road segment Segment1 30 minutes after those observations; and yellow traffic congestion level conditions were reported on road segment SegmentN 180 minutes after those observations. Rows 224*b-g* similarly illustrate additional observation records, and it will be appreciated that actual observation data may include very large numbers of such observations.

Figure 2D:
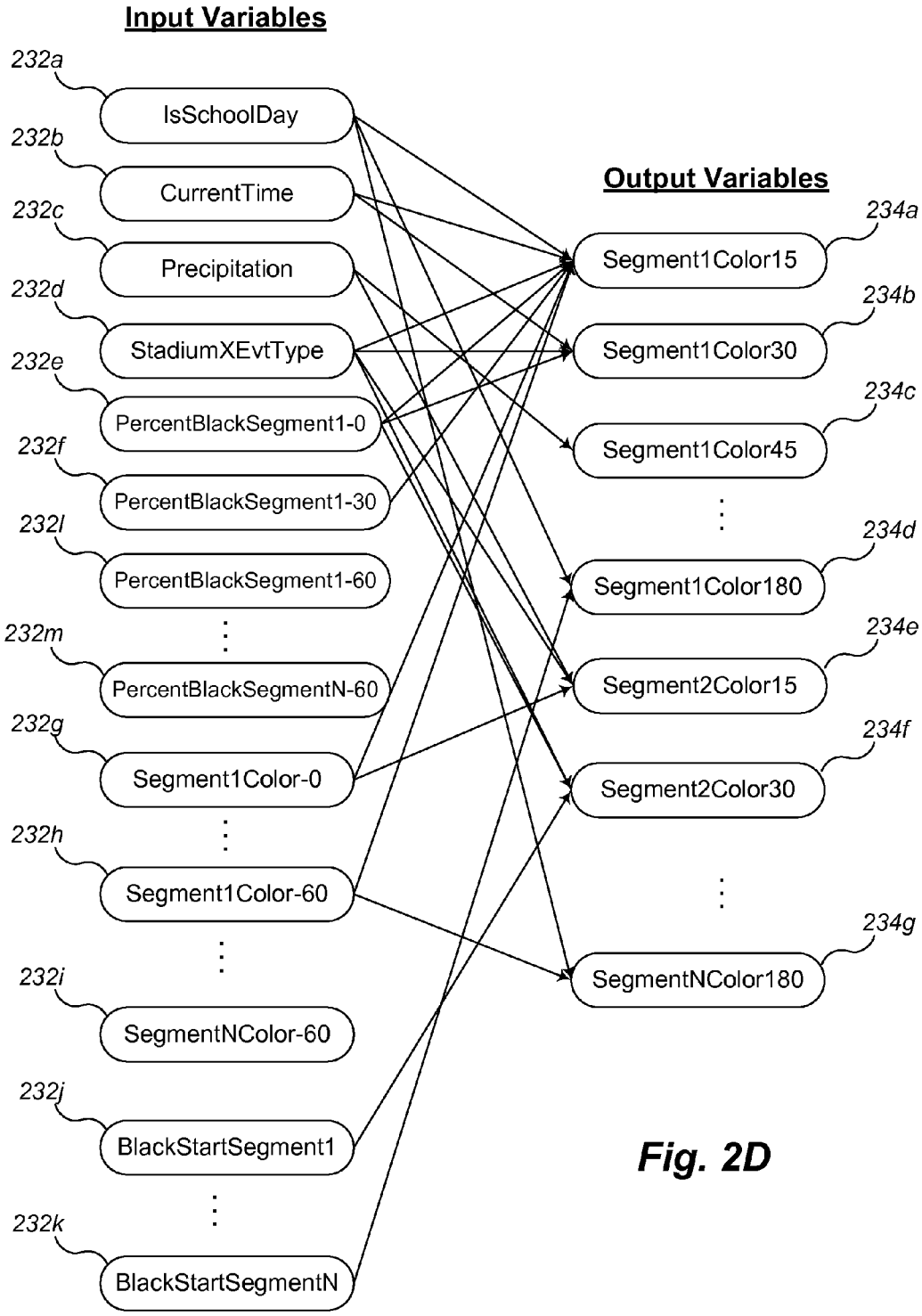

FIG. 2D illustrates an example Bayesian network that may be generated based on observation data such as that illustrated in FIG. 2C, and that may be used as a predictive model for generating future traffic conditions predictions. As is shown, the nodes depicted in FIG. 2D represent the same input and output variables as the nodes as in FIG. 2A, but arcs now connect the input variable nodes 232*a-m* to the output variable nodes 234*a-g* such that each of the output nodes is now the child of one or more of the input nodes 232*a-m* corresponding to input variables. Each arc directed from a parent node to a child node represents dependence between the child node and the parent node, meaning that the observed data from which the Bayesian network structure was generated indicates that the probability of the child node is conditional on the prior probability of its parent node. For example, node 234*c* in this example has a single parent node 232*c*, which can be understood to mean that the probability of the output variable Segment1Color45 represented by node 234*c* is conditional on the prior probability of the Precipitation input variable represented by node 232*c*. Thus, when input information is currently obtained for the Precipitation input variable, a predicted value for the traffic congestion level color of road segment Segment1 at future time 45 minutes can be determined. If a child node has multiple parent nodes, its probability is conditional on the probabilities of all combinations of its multiple parent nodes. For example, output node 234*a* has seven parent nodes in this example, those being input nodes 232*a*, 232*b*, 232*d*, 232*e*, 232*f*, 232*g* and 232*h*, which can be understood to mean that the probability of the output variable Segment1Color15 represented by node 234*a* is conditional on the prior probabilities of the input variable IsSchoolDay represented by node 232*a*, the input variable CurrentTime represented by node 232*b*, the input variable StadiumXEvtType represented by node 232*d*, the input variable PercentBlackSegment1-0 represented by node 232*e*, the input variable PercentBlackSegment1-30 represented by node 232*f*, the input variable Segment1Color-0 represented by node 232*g*, and the input variable Segment1Color-60 represented by node 232*h*.

Intuitively, the Bayesian network may be understood to represent causal relationships. For example, the illustrated Bayesian network expresses causal relationships between input factors such as school schedules, stadium events, weather, and current and past traffic conditions (as represented by input nodes 232*a-m*) and output future traffic conditions on various road segments (as represented by output nodes 234*a-g*). As one specific example, the traffic conditions reported 60 minutes ago on road segment Segment1 and whether it is a school day may influence the traffic conditions 180 minutes in the future on road segment SegmentN, such as if road segments Segment1 and SegmentN are related (e.g., are nearby to each other) and if significant traffic reported on road segment Segment1 on school days has a later impact on road segment SegmentN. This relationship is depicted in FIG. 2D by way of arcs from each of node 232*a* labeled IsSchoolDay and node 232*h* labeled Segment1Color-60 to node 234*g* labeled SegmentNColor180.

The structure and probability distributions of a Bayesian network such as that depicted in FIG. 2D may be generated from observation data via learning algorithms that determine the corresponding relationships and values, such as to determine a network structure that best matches the given observation data. In addition, at least some such learning algorithms can proceed with incomplete data (e.g., such as where some of the observation records are missing some data elements), and may further in some embodiments generate more complicated network structures (e.g., by identifying and representing one or more levels of intermediate nodes between the input nodes and output nodes, such as to reflect high-level relationships between groups of input nodes and/or output nodes). Additional details related to one set of example techniques for use in some embodiments for generating a Bayesian network based on observed case information are included in "A Tutorial on Learning Bayesian Networks," David Heckerman, March 1995, Technical Report MSR-TR-95-06 from the Microsoft Research Advanced Technology Division of Microsoft Corporation and available at ftp://ftp.research.microsoft.com/pub/tr/tr-95-06.pdf, which is hereby incorporated by reference in it entirety.

FIGS. 2E-J depict example decision trees that may each be generated based on observation data, such as that illustrated in FIG. 2C and in conjunction with the example Bayesian network illustrated in FIG. 2D, and that may each be used as part of a predictive model for generating future traffic conditions predictions for a particular road segment at a particular future time. As previously noted, a Bayesian network such as the one depicted in FIG. 2D indicates probabilistic relationships between various variables. A decision tree allows a subset of such relationships to be encoded in a manner that may be used to efficiently compute a predicted value for an output variable given a set of input values. In particular, a decision tree includes numerous decisions arranged in a tree structure, such that possible answers to a decision each lead to a different sub-tree based on that answer, and with the decisions and answers arranged so as quickly split multiple cases with different outcomes into different sub-trees. Given a set of observation data such as that shown in FIG. 2C, decision trees such as those shown in FIGS. 2E-J may be automatically generated via learning algorithms that determine the best decisions and answers to include in the decision tree and the best structure of the tree to facilitate rapid decisions based on input data to reflect current conditions. Additional details related to one set of example techniques for use in some embodiments for generating decision trees based on observed case information and/or a corresponding Bayesian network are included in "Scalable Classification over SQL Databases," Surajit Chaudhuri et al., Microsoft Research Division of Microsoft Corporation, March 1999, Proceedings of 15th International Conference on Data Engineering, Sydney, Australia, available at http://doi.ieeecomputersociety.org/10.1109/ICDE.1999.754963 and/or at ftp://ftp.research.microsoft.com/users/AutoAdmin/icde99.pdf, which is hereby incorporated by reference in its entirety.

In the illustrated embodiment, each decision tree is used to generate the predicted traffic congestion level conditions on a single road segment at a single future time given current condition information for input variables. As described in more detail with reference to FIGS. 2A-D, in some embodiments, at each of one or more successive current times, traffic conditions for multiple future times are modeled based on the information available at the current time of the modeling, such as every 15 minutes of a three-hour time interval, resulting in twelve decision trees per modeled road segment. In FIGS. 2E-2J, the decision tree nodes are each labeled with a variable name corresponding to one of the input variables described with reference to FIGS. 2A-D, and the arcs emanating from a given node representing an input variable are each labeled with one or more of the possible values that may be taken by the variable. A path is determined by starting at the root node of the tree, using the value in the set of input data corresponding to the variable represented by that node to determine which arc to follow to a child node, and repeating the process for each successive children along the path until a leaf node is reached. In FIGS. 2E-J, leaf nodes are rectangular in shape, and each represent a most likely future traffic congestion level prediction for the given set of input data.

Figure 2E:
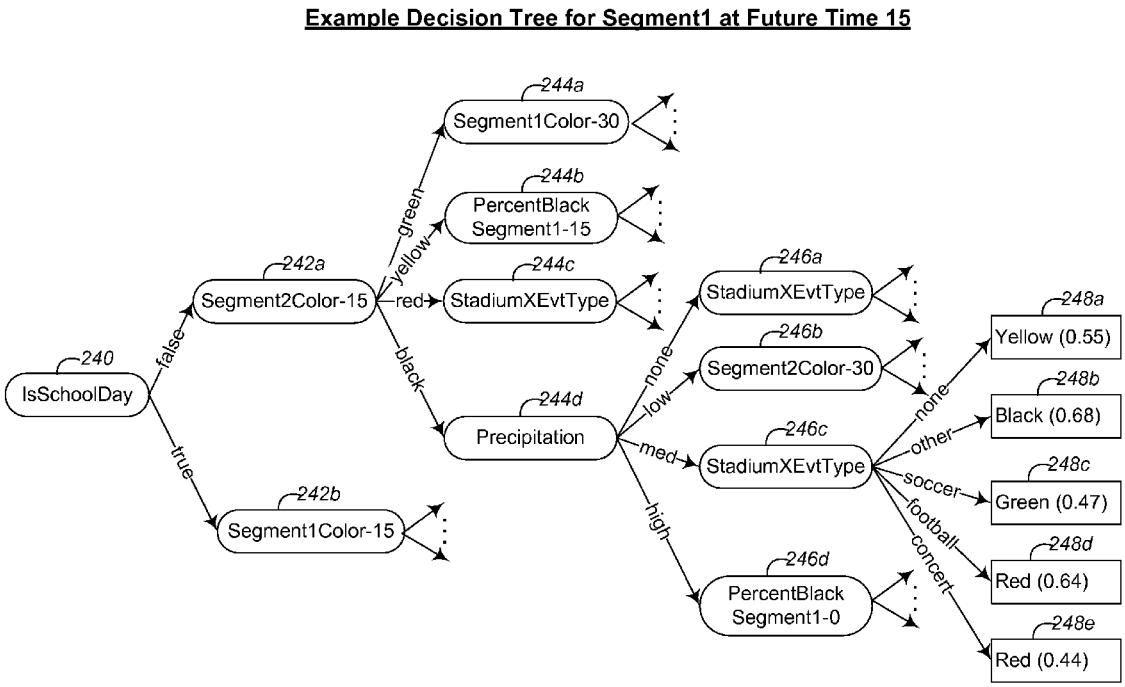

FIG. 2E shows a portion of an example decision tree for predicting future traffic congestion levels for road segment Segment1 at a future time of 15 minutes, and in particular illustrates a single path from the root node to possible leaf nodes, although it will be understood that in an actual decision tree numerous other paths will similarly lead to other such possible leaf nodes. In this example, the root node 240 of the illustrated decision tree corresponds to the IsSchoolDay input variable, with the path leading to node 242*b* being followed if it is currently a school day and with the path leading to node 242*a* being followed otherwise. Node 242*a* represents the Segment2Color-15 input variable, with possible values of the traffic congestion color (e.g., green, yellow, red, black) of road segment Segment2 fifteen minutes in the past leading to nodes 244*a-d* as shown. For example, if it is currently determined that black was reported 15 minutes ago on this road segment, the path to node 244*d* is followed, which represents the Precipitation input variable. Possible values of the Precipitation input variable from node 244*d* lead to nodes 246*a-d* as shown. For example, if the current measured precipitation is medium, the path to node 246*c* is followed, which represents the StadiumXEvtType input variable. Possible values of the StadiumXEvtType input variable lead to leaf nodes 248*a-e* as shown, with each of these leaf nodes representing an associated predicted future traffic congestion level on road segment Segment1 at a future time of 15 minutes. In this example, each leaf node is also labeled with a confidence level associated with the predicted future traffic congestion level (as shown by the value in parenthesis), such as may be determined in various ways. As one example, node 248*d* indicates that if a football game is currently scheduled, then a red traffic congestion level condition on road segment Segment1 is predicted for future time 15 minutes with a confidence level of 64%, while node 248*c* indicates that if a soccer game is instead currently scheduled then green traffic congestion level conditions are predicted on road segment Segment1 for future time 15 minutes with a confidence level of 47%. This difference may be attributed, for example, to the relative attendance and corresponding traffic for events of the two sports within the given geographic area, to different schedules (e.g., start, duration or end times) for such types of events, and/or to different patterns of traffic flow before and/or after the event (e.g., concert attendees may tend to arrive and/or depart en masse, whereas sporting event attendees may tend to arrive and/or depart more sporadically over larger time intervals).

Figure 2F:
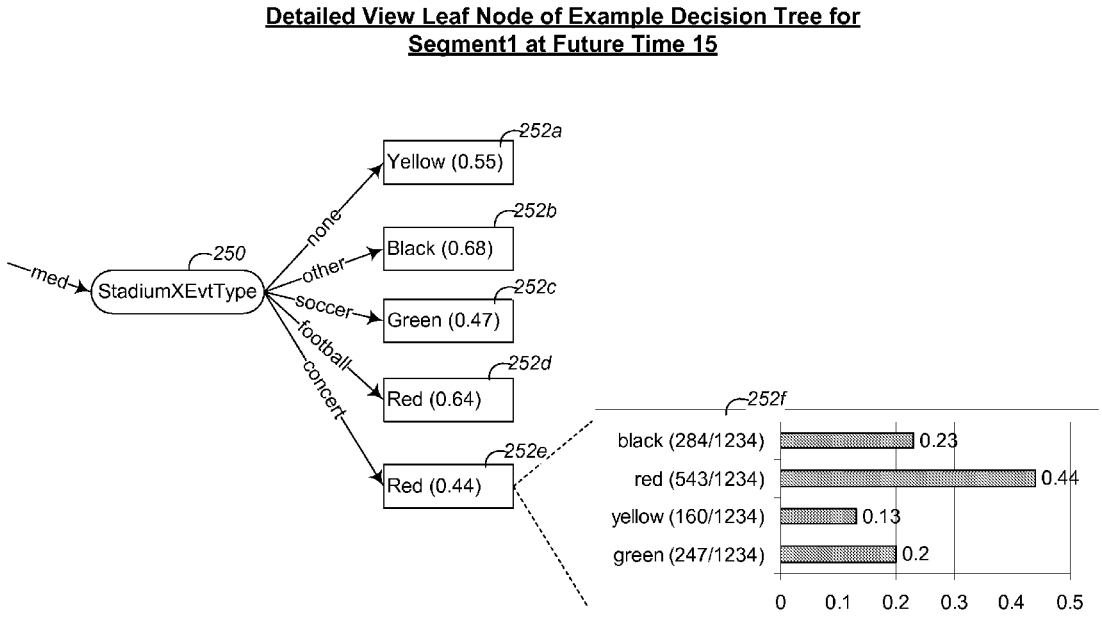

FIG. 2F shows a detailed view of one example leaf node of the example decision tree of FIG. 2E. In particular, a detailed view of leaf node 252*e* is shown, which corresponds to the leaf node 248*e* of FIG. 2E. FIG. 2F shows a histogram 252*f* for node 252*e*, which illustrates a probability distribution over all possible outcomes for node 252*e* in the observed data used to generate the decision tree. In this example, the histogram 252*f* shows the four possible traffic congestion level values (e.g., black, red, yellow, green) and the associated frequency of each value from the observed data. As can be seen from the histogram, the outcome with the highest frequency is a red traffic congestion level, with a frequency of 44% of the observed cases (shown as being the outcome in 543 of 1234 observed cases). In this example, the highest frequency outcome will be selected as the predicted outcome at a particular leaf node, and the frequency of that particular outcome in the observed data will be selected as the confidence value for the prediction. In other embodiments, confidence values may be determined in other manners, such as based on a relationship of the highest frequency outcome to an overall mean, median, or other statistical aggregate measure of the outcomes.

Figure 2G:
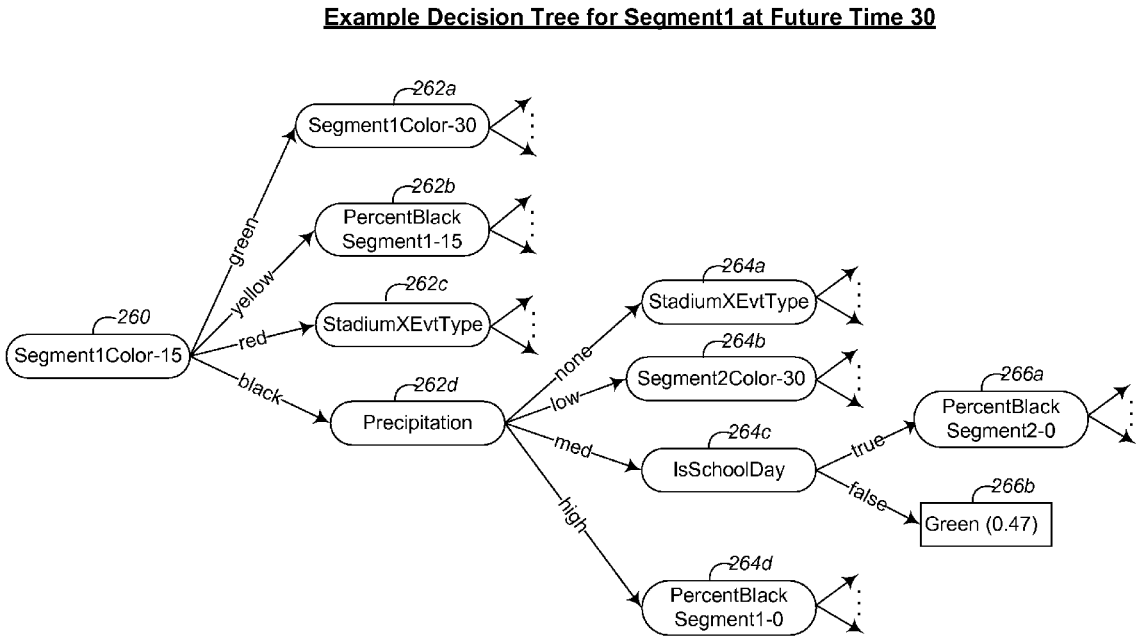

In a manner similar to that of FIG. 2E, FIG. 2G shows a portion of another example decision tree for road segment Segment1, with this decision tree representing predicted future traffic congestion levels for road segment Segment1 at a future time of 30 minutes. In particular, this decision tree illustrates a path from root node 260 to a leaf node 266*b*, which results in a most likely prediction of green traffic congestion level conditions with an associated confidence value of 47% based on input conditions corresponding to that path. In this example, the structure of the decision tree of FIG. 2G differs from that of the decision tree of FIG. 2E, even though it is used to compute predictions for the same road segment, based on the observed data reflecting different relevant factors for 30-minute future predictions than for 15-minute future predictions. For example, the decision tree of FIG. 2G begins with node 260 that corresponds to the input variable Segment1Color-15, whereas the decision tree of FIG. 2E begins with node 240 that corresponds to the input variable IsSchoolDay.

Figure 2H:
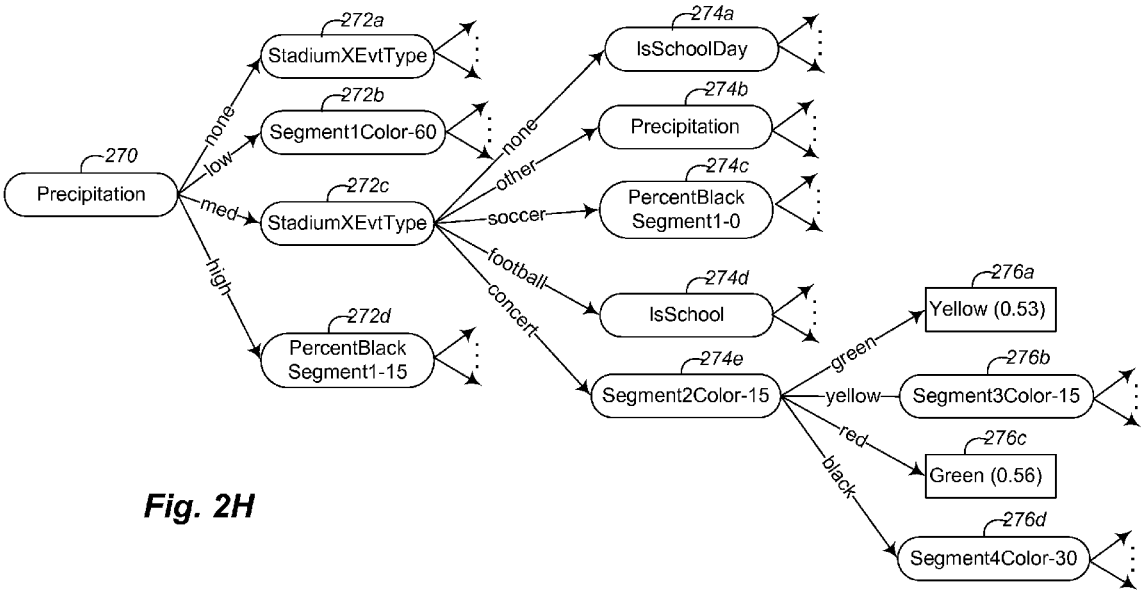

FIG. 2H shows a portion of an example decision tree for predicting future traffic congestion levels for road segment Segment1 at a future time of 60 minutes. In a similar manner to that of FIG. 2G, the structure of this decision tree differs from that of the tree in FIG. 2E, as well as that of FIG. 2G. This decision tree shows a path from root node 270 to a leaf node 276*a* that yields a most likely prediction of yellow traffic congestion level conditions with an associated confidence value of 53%. In addition, this decision tree shows a second path from root node 270 to a leaf node 276*c* that yields a most likely prediction of green traffic congestion level conditions with an associated confidence value of 56%.

Figure 2I:
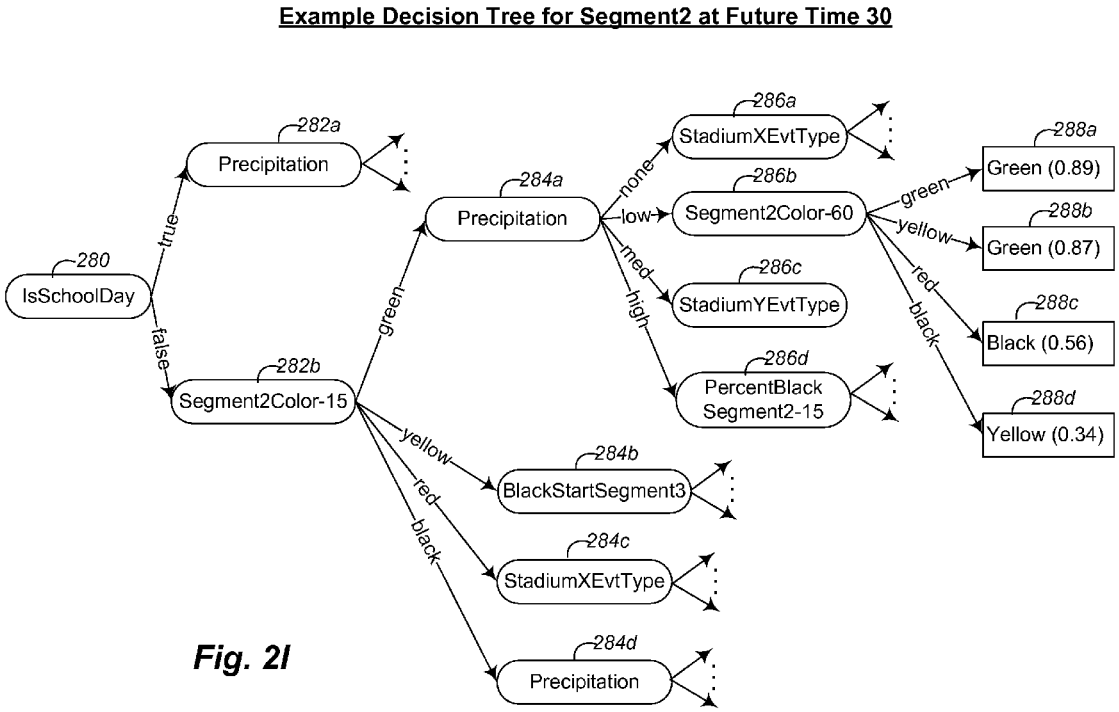

FIG. 2I shows a portion of an example decision tree for predicting future traffic congestion levels for road segment Segment2 at a future time of 30 minutes. This decision tree may be used to predict traffic conditions for road segment Segment2, as opposed to road segment Segment1 as depicted in FIGS. 2E, 2G, and 2H, but otherwise has a similar structure and use as the previously discussed decision trees. This decision tree shows four paths from root node 280 to leaf nodes 288*a-d*, which result in most likely predictions of green, green, black, and yellow traffic congestion level conditions with associated confidence values of 89%, 87%, 56%, and 34%, respectively.

Figure 2J:
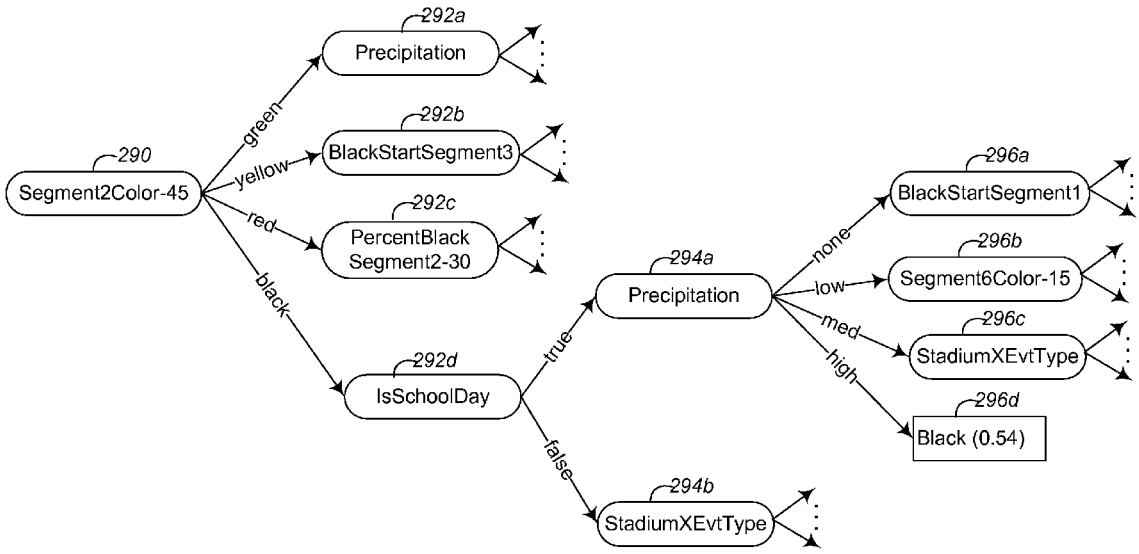

FIG. 2J shows a portion of an updated example decision tree for road segment Segment1 at a future time of 60 minutes, with a particular path illustrated from root node 290 to a leaf node 296*d* that yields a most likely prediction of black traffic congestion level conditions with an associated confidence value of 54%. As described in more detail elsewhere, in some embodiments such decision trees and/or the associated Bayesian network prediction models are updated and/or re-created when new observed case information becomes available. These updates may occur at various times, such as on a periodic basis (e.g., weekly, monthly, etc.), upon request, and/or upon the accumulation of sufficient new observed case data. In addition, in some embodiments the new observed case data may merely be used to update the predicted values for existing leaf nodes (e.g., with respect to histogram 252*f* of FIG. 2F, to update that black is now the most frequent outcome for node 252*e* given the new observed data based on 1284 of 2334 total occurrences), while in other embodiments the new observed case data is used to generate new decision trees with potentially different structures. In this example, the new decision tree depicted in FIG. 2J differs in structure from that shown in FIG. 2H, even though both decision trees predict future traffic congestions levels for road segment Segment1 at a future time of 60 minutes, based on the changes in the observed case data.

Figure 3:
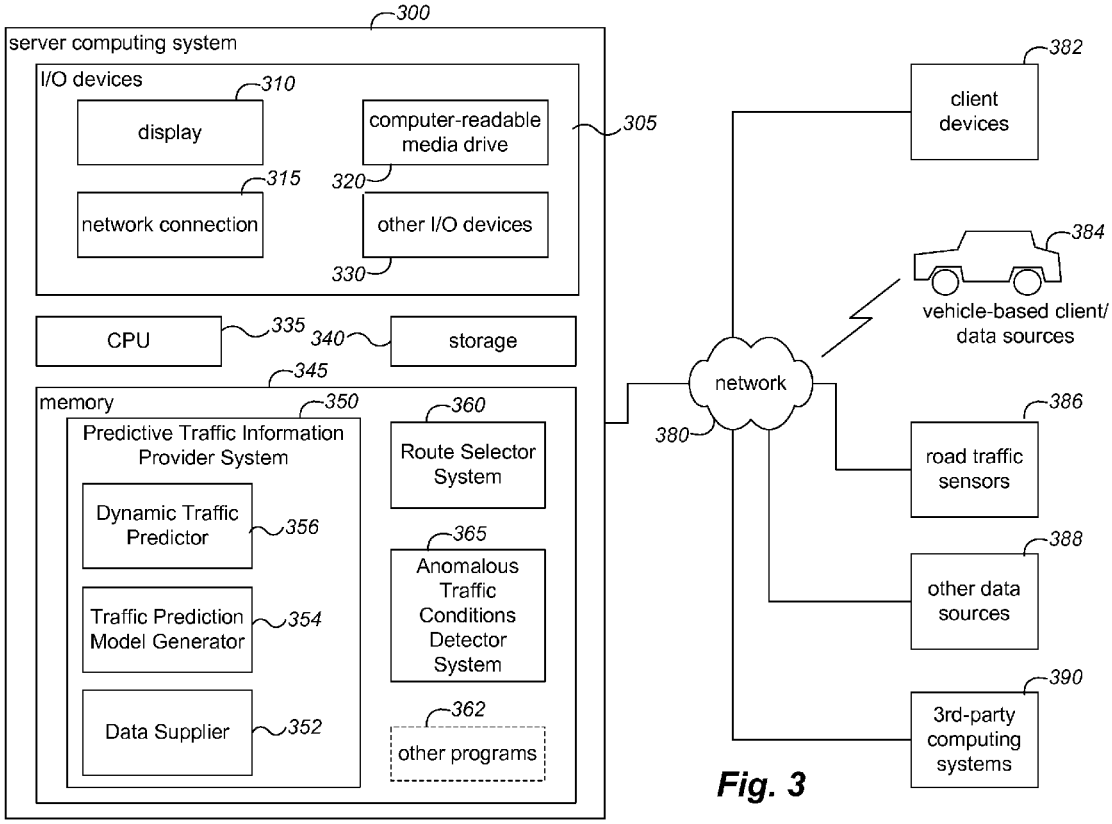
FIG. 3 is a block diagram illustrating a computing system suitable for executing an embodiment of the described Predictive Traffic Information Provider system.

FIG. 3 is a block diagram illustrating an embodiment of a server computing system 300 that is suitable for performing at least some of the described techniques, such as by executing an embodiment of an Anomalous Traffic Condition Detector system 365, and/or by executing an embodiment of a Predictive Traffic Information Provider system and/or a Route Selector system. The server computing system 300 includes a central processing unit ("CPU") 335, various input/output ("I/O") components 305, storage 340, and memory 345, with the illustrated I/O components including a display 310, a network connection 315, a computer-readable media drive 320, and other I/O devices 330 (e.g., keyboards, mice or other pointing devices, microphones, speakers, etc.).

In the illustrated embodiment, a Predictive Traffic Information Provider system 350, a Route Selector system 360 and optional other systems provided by programs 362 are executing in memory 345 in order to perform at least some of the described techniques, with these various executing systems generally referred to herein as predictive traffic information systems. The server computing system and its executing systems may communicate with other computing systems via a network 380 (e.g., the Internet, one or more cellular telephone networks, etc.), such as various client devices 382, vehicle-based clients and/or data sources 384, road traffic sensors 386, other data sources 388, and third-party computing systems 390. In particular, one or more of the predictive traffic information systems receives various information regarding current conditions and/or previous observed case data from various sources, such as from the road traffic sensors, vehicle-based data sources and other data sources. The Predictive Traffic Information Provider system then uses the received data to generate future traffic condition predictions for multiple future times, and provides the predicted information to the Route Selector system and optionally to one or more other recipients, such as one or more predictive traffic information systems, client devices, vehicle-based clients, third-party computing systems, and/or users. The Route Selector system uses the received predicted future traffic condition information to generate route-related information, such as for frequently used routes and/or upon request for indicated routes, and similarly provides such route-related information to one or more other predictive traffic information systems, client devices, vehicle-based clients, and/or third-party computing systems.

The client devices 382 may take various forms in various embodiments, and may generally include any communication devices and other computing devices capable of making requests to and/or receiving information from the predictive traffic information systems. In some cases, the client devices may run interactive console applications (e.g., Web browsers) that users may utilize to make requests for traffic-related information based on predicted future traffic information, while in other cases at least some such traffic-related information may be automatically sent to the client devices (e.g., as text messages, new Web pages, specialized program data updates, etc.) from one or more of the predictive traffic information systems.

The road traffic sensors 386 include multiple sensors that are installed in, at, or near various streets, highways, or other roadways, such as for one or more geographic areas. These sensors include loop sensors that are capable of measuring the number of vehicles passing above the sensor per unit time, vehicle speed, and/or other data related to traffic flow. In addition, such sensors may include cameras, motion sensors, radar ranging devices, and other types of sensors that are located adjacent to a roadway. The road traffic sensors 386 may periodically or continuously provide measured data via wire-based or wireless-based data link to the Predictive Traffic Information Provider system 350 via the network 380 using one or more data exchange mechanisms (e.g., push, pull, polling, request-response, peer-to-peer, etc.). In addition, while not illustrated here, in some embodiments one or more aggregators of such road traffic sensor information (e.g., a governmental transportation body that operates the sensors) may instead obtain the raw data and make that data available to the predictive traffic information systems (whether in raw form or after it is processed).

The other data sources 388 include a variety of types of other sources of data that may be utilized by one or more of the predictive traffic information systems to make predictions related to traffic flow and/or to make selections of traffic routes. Such data sources include, but are not limited to, sources of current and past weather conditions, short and long term weather forecasts, school schedules and/or calendars, event schedules and/or calendars, traffic incident reports provided by human operators (e.g., first responders, law enforcement personnel, highway crews, news media, travelers, etc.), road work information, holiday schedules, etc.

The vehicle-based clients/data sources 384 in this example may each be a computing system located within a vehicle that provides data to one or more of the predictive traffic information systems and/or that receives data from one or more of those system. In some embodiments, the Predictive Traffic Information Provider system may utilize a distributed network of vehicle-based data sources that provide information related to current traffic conditions for use in traffic prediction. For example, each vehicle may include a GPS ("Global Positioning System") device (e.g., a cellular telephone with GPS capabilities, a stand-alone GPS device, etc.) and/or other geo-location device capable of determining the geographic location, speed, direction, and/or other data related to the vehicle's travel, and one or more devices on the vehicle (whether the geo-location device(s) or a distinct communication device) may from time to time obtain such data and provide it to one or more of the predictive traffic information systems (e.g., by way of a wireless link)—such vehicles may include a distributed network of individual users, fleets of vehicles (e.g., for delivery companies, transportation companies, governmental bodies or agencies, vehicles of a vehicle rental service, etc.), vehicles that belong to commercial networks providing related information (e.g., the OnStar service), a group of vehicles operated in order to obtain such traffic condition information (e.g., by traveling over predefined routes, or by traveling over roads as dynamically directed, such as to obtain information about roads of interest), etc. Moreover, while not illustrated here, in at least some embodiments other mobile data sources may similarly provide actual data based on travel on the roads, such as based on computing devices and other mobile devices of users who are traveling on the roads (e.g., users who are operators and/or passengers of vehicles on the roads). In addition, such vehicle-based information may be generated in other manners in other embodiments, such as by cellular telephone networks, other wireless networks (e.g., a network of Wi-Fi hotspots) and/or other external systems (e.g., detectors of vehicle transponders using RFID or other communication techniques, camera systems that can observe and identify license plates and/or users' faces) that can detect and track information about vehicles passing by each of multiple transmitters/receivers in the network. Such generated vehicle-based travel-related information may then be used for a variety of purposes, such as to provide information similar to that of road sensors but for road segments that do not have functioning road sensors (e.g., for roads that lack sensors, such as for geographic areas that do not have networks of road sensors and/or for arterial roads that are not significantly large to have road sensors, for road sensors that are broken, etc.), to verify duplicative information that is received from road sensors or other sources, to identify road sensors that are providing inaccurate data (e.g., due to temporary or ongoing problems), etc. The wireless links may be provided by a variety of technologies known in the art, including satellite uplink, cellular network, WI-FI, packet radio, etc., although in at least some embodiments such information about road traffic conditions may be obtained from mobile devices (whether vehicle-based devices and/or user devices) via physically download when the device reaches an appropriate docking or other connection point (e.g., to download information from a fleet vehicle once it has returned to its primary base of operations or other destination with appropriate equipment to perform the information download). In some cases, various factors may cause it to be advantageous for a mobile device to store multiple data samples that are acquired over a determined period of time (e.g., data samples taken at a pre-determined sampling rate, such as 30 seconds or a minute) and/or until sufficient data samples are available (e.g., based on a total size of the data), and to then transmit the stored data samples together (or an aggregation of those samples) after the period of time—for example, the cost structure of transmitting data from a vehicle-based data source via a particular wireless link (e.g., satellite uplink) may be such that transmissions occur only after determined intervals (e.g., every 15 minutes), one or more of the geo-location and/or communication devices may be configured or designed to transmit at such intervals, an ability of a mobile device to transmit data over a wireless link may be temporarily lost (e.g., such as for a mobile device that typically transmits each data sample individually, such as every 30 seconds or 1 minute, and possibly due to factors such as a lack of wireless coverage in an area of the mobile device, other activities being performed by the mobile device or a user of the device, or a temporary problem with the mobile device or an associated transmitter) such that storage of data samples will allow later transmission or physical download, etc. For example, if a wireless transmission of up to 1000 units of information costs $0.25 cents, and each data sample is 50 units in size, the it may be advantageous to sample every minute and send a data set comprising 20 samples every 20 minutes, rather than sending samples more frequently (e.g., every minute). Moreover, in some embodiments additional information may be generated and provided by a mobile device based on multiple stored data samples. For example, if a particular mobile device is able to acquire only information about a current instant position during each data sample, but is not able to acquire additional related information such as speed and/or direction, such additional related information may be calculated or otherwise determined based on multiple subsequent data samples.

Alternatively, some or all of the vehicle-based clients/data sources 384 may each have a computing system located within a vehicle to obtain information from one or more of the predictive traffic information systems, such as for use by an occupant of the vehicle. For example, the vehicle may contain an in-dash navigation system with an installed Web browser or other console application that a user may utilize to make requests for traffic-related information via a wireless link from the Predictive Traffic Information Provider system or the Route Selector system, or instead such requests may be made from a portable device of a user in the vehicle. In addition, one or more of the predictive traffic information systems may automatically transmit traffic-related information to such a vehicle-based client device (e.g., updated predicted traffic information and/or updated route-related information) based upon the receipt or generation of updated information.

The third-party computing systems 390 include one or more optional computing systems that are operated by parties other than the operator(s) of the predictive traffic information systems, such as parties who receive traffic-related data from one or more of the predictive traffic information systems and who make use of the data in some manner. For example, the third-party computing systems 390 may be systems that receive predicted traffic information from one or more of the predictive traffic information systems, and that provide related information (whether the received information or other information based on the received information) to users or others (e.g., via Web portals or subscription services). Alternatively, the third-party computing systems 390 may be operated by other types of parties, such as media organizations that gather and report predicted traffic condition and route information to their consumers, or online map companies that provide predicted traffic-related information to their users as part of travel-planning services.

In this illustrated embodiment, the Predictive Traffic Information Provider system 350 includes a Data Supplier component 352, a Traffic Prediction Model Generator component 354, and a Dynamic Traffic Predictor component 356. The Data Supplier component obtains current condition data that may be used by one or more of the other components or other predictive traffic information systems, such as from the data sources previously discussed, and makes the information available to the other components and predictive traffic information systems. In some embodiments, the Data Supplier component may optionally aggregate obtained data from a variety of data sources, and may further perform one or more of a variety of activities to prepare data for use, such as to place the data in a uniform format; to detect and possibly correct errors or missing data (e.g., due to sensor outages and/or malfunctions, network outages, data provider outages, etc.); to filter out extraneous data, such as outliers; to discretize continuous data, such as to map real-valued numbers to enumerated possible values; to sub-sample discrete data (e.g., by mapping data in a given range of values to a smaller range of values); to group related data (e.g., a sequence of multiple traffic sensors located along a single segment of road that are aggregated in an indicated manner); etc. Information obtained by the Data Supplier component may be provided to other predictive traffic information systems and components in various ways, such as to notify others when new data is available, to provide the data upon request, and/or to store the data in a manner that is accessible to others (e.g., in one or more databases on storage, not shown). Additional details related to the aggregation, filtering, conditioning, and provision of obtained traffic-related data are included in U.S. patent application Ser. No. 11/540,342, filed Sep. 28, 2006 and entitled "Rectifying Erroneous Traffic Sensor Data," which is hereby incorporated by reference in its entirety.

In the illustrated embodiment, the Traffic Prediction Model Generator component uses obtained observation case data to generate predictive models used to make predictions about traffic conditions, as previously discussed. In some embodiments, the Traffic Prediction Model Generator component utilizes historical observation case data to automatically learn the structure of a Bayesian network for a given group of one or more roads, and further automatically learns multiple decision tree models that each may be used to make predictions of future traffic flow on a particular road segment for a particular future time. The created predictive models may then be provided to other predictive traffic information systems and components in various ways, such as to notify others when the new models are available, to provide the models upon request, and/or to store the models in a manner that is accessible to others (e.g., in one or more databases on storage, not shown).

The Dynamic Traffic Predictor component utilizes the predictive models generated by the Traffic Prediction Model Generator component to generate predictions of future traffic conditions for multiple future times, such as based on real-time and/or other current condition information. Such predictions may be made at various times, such as periodically (e.g., every five or ten minutes), when new and/or anomalous data (e.g., a traffic accident incident report) has been received, upon request, etc. The generated predicted future traffic condition information may then be provided to other predictive traffic information systems and components and/or to others in various ways, such as to notify others when new information is available, to provide the information upon request, and/or to store the information in a manner that is accessible to others (e.g., in one or more databases on storage, not shown).

The Route Selector system selects travel route information based on predicted future traffic condition information, and provides such route information to others in various ways. In some embodiments, the Route Selector system receives a request from a client to provide information related to one or more travel routes between a starting and ending location in a given geographic area at a given date and/or time. In response, the Route Selector system obtains predictions of future road conditions for the specified area during the specified time period from, for example, the Predictive Traffic Information Provider system, and then utilizes the predicted future road condition information to analyze various route options and to select one or more routes based on indicated criteria (e.g., shortest time). The selected route information may then be provided to other predictive traffic information systems and components and/or to others in various ways, such as to notify others when information is available, to provide the information upon request, and/or to store the information in a manner that is accessible to others (e.g., in one or more databases on storage, not shown).

In the illustrated embodiment, an embodiment of an Anomalous Traffic Conditions Detector system 365 is also executing in memory 345 in order to perform at least some of the described techniques related to detection of and/or providing of information about traffic condition anomalies. In some embodiments, the Anomalous Traffic Conditions Detector system 365 obtains target traffic condition information (e.g., that reflects actual traffic conditions) for one or more road segments (e.g., some or all road segments in a given geographic area) and one or more times, obtains expected traffic condition information (e.g., that reflects normal traffic conditions) for the road segments and the times, and compares the target traffic condition information to the expected traffic condition information to identify any anomalous target traffic conditions. Indications of detected anomalies may then be provided to users (e.g., via client devices 382 and/or clients 384) and/or to other systems (e.g., to predictive traffic information systems and/or to 3$^{rd}$-party computing systems 390), such as to notify human users of detected anomalies affecting travel routes of interest to such users (e.g., notifying a user that traffic on their preferred route to work is or is likely to be worse than normal), to provide indications of detected anomalies upon request, and/or to store indications of detected anomalies in a manner that is accessible to others (e.g., in one or more databases on storage, not shown).

It will be appreciated that the illustrated computing systems are merely illustrative and are not intended to limit the scope of the present invention. Computing system 300 may be connected to other devices that are not illustrated, including through one or more networks such as the Internet or via the Web. More generally, a "client" or "server" computing system or device, or Anomalous Traffic Conditions Detector system and/or component, may comprise any combination of hardware or software that can interact and perform the described types of functionality, including without limitation desktop or other computers, database servers, network storage devices and other network devices, PDAs, cellphones, wireless phones, pagers, electronic organizers, Internet appliances, television-based systems (e.g., using set-top boxes and/or personal/digital video recorders), and various other consumer products that include appropriate inter-communication capabilities. In addition, the functionality provided by the illustrated system components may in some embodiments be combined in fewer components or distributed in additional components. Similarly, in some embodiments the functionality of some of the illustrated components may not be provided and/or other additional functionality may be available. For example, in some embodiments the Anomalous Traffic Conditions Detector system 365 may execute on computing system 300 without any other executing systems or programs 350, 360 and/or 362. Note also that while various items are illustrated as being stored in memory or on storage while being used, these items or portions of them can be transferred between memory and other storage devices for purposes of memory management and/or data integrity. Alternatively, in other embodiments some or all of the software components and/or modules may execute in memory on another device and communicate with the illustrated computing system/device via inter-computer communication. Some or all of the system components or data structures may also be stored (e.g., as software instructions or structured data) on a computer-readable medium, such as a hard disk, a memory, a network, or a portable media article to be read by an appropriate drive or via an appropriate connection. The system components and data structures can also be transmitted as generated data signals (e.g., as part of a carrier wave or other analog or digital propagated signal) on a variety of computer-readable transmission mediums, including wireless-based and wired/cable-based mediums, and can take a variety of forms (e.g., as part of a single or multiplexed analog signal, or as multiple discrete digital packets or frames). Such computer program products may also take other forms in other embodiments. Accordingly, the present invention may be practiced with other computer system configurations.

Figure 4:
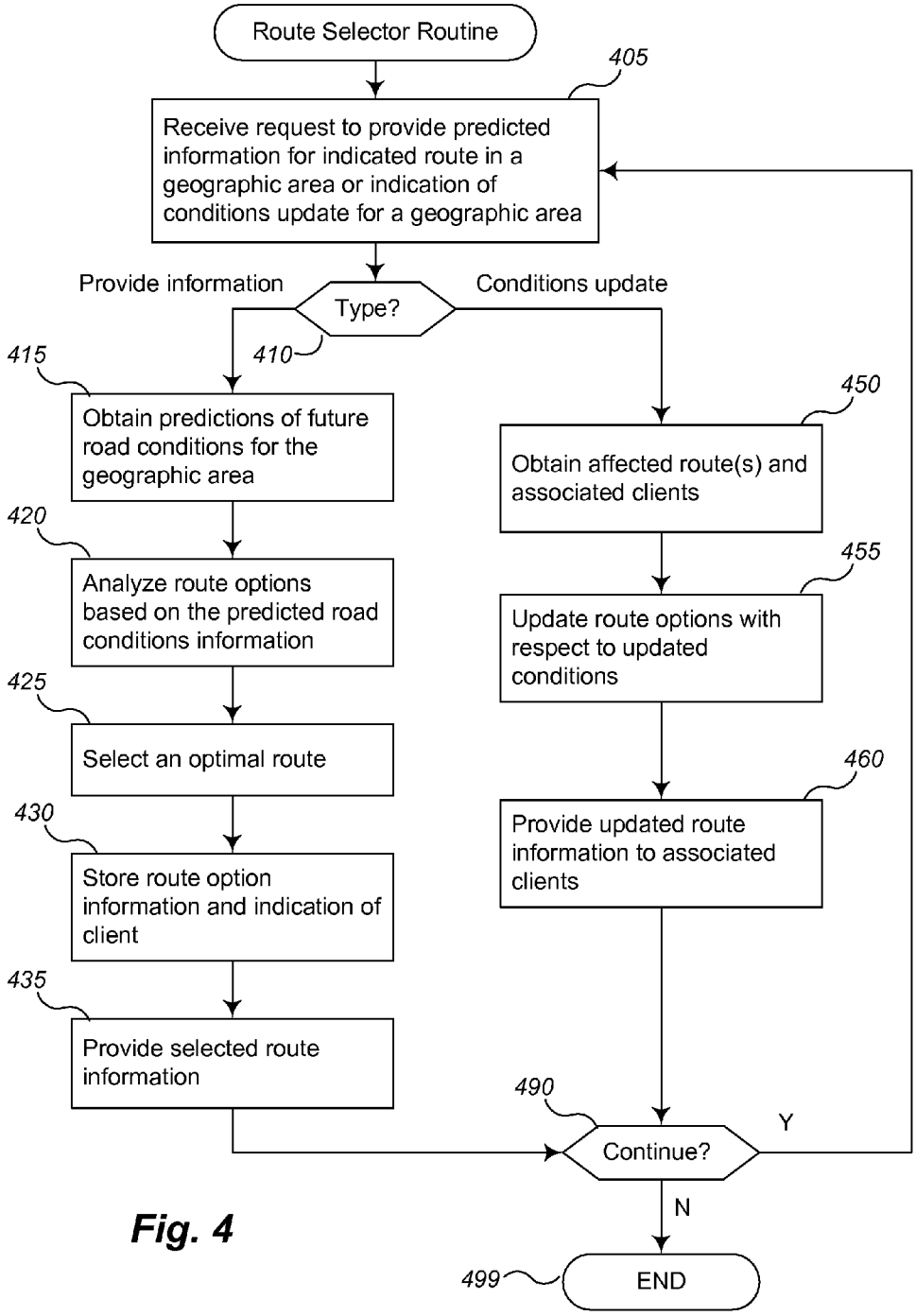
FIG. 4 is a flow diagram of an embodiment of a Route Selector routine.

FIG. 4 is a flow diagram of an embodiment of a Route Selector routine. This routine may be provided, for example, by execution of the Route Selector system 360 of FIG. 3. The routine uses predicted future traffic conditions at multiple future times to plan routes through a network of roads, such as to determine one or more routes that are predicted to be optimal, near-optimal, or otherwise preferred.

The routine begins in step 405 and receives a request to provide predicted information for an indicated route in a geographic area (e.g., a route indicated with a starting location, an ending location, a preferred arrival time, a preferred departure time and/or other indicated criteria for use in identifying or evaluating route options) or receives an indication of an update in relevant conditions for a geographic area. In step 410, the route determines the type of input received, and if a request to provide route information has been received, the routine proceeds to step 415 and obtains predictions of future road conditions at one or more future times for the geographic area, such as for future times that correspond to the preferred travel time (if any). The routine may obtain this information from, for example, the Predictive Traffic Information Provider system 350 described with reference to FIG. 3, such as in an interactive manner or instead by retrieving previously generated prediction information. In step 420, the routine then analyzes route options based on the obtained predicted future road conditions information, such as to determine predicted travel times for each of the route options. The route options may include a number of alternative routes to travel from the indicated starting location (if any) to the indicated ending location (if any), such as a set of pre-determined route options or instead all route options that satisfy indicated criteria (e.g., using roads of a certain size or class, using any roads for which predicted future information is available, using all possible route options, using domain-specific heuristics to constrain the number of possible routes in order to reduce the search space, etc.). In step 425, the routine then optionally selects a predicted optimal route from the set of route options, or in some embodiments more generally ranks the route options (e.g., in a relative or absolute manner) using one or more criteria (e.g., the minimum travel time, minimum travel distance, minimum travel speed, minimum travel speed variability, maximum confidence in a route that otherwise satisfies such criteria, etc. or combinations thereof) and selects some or all of those route options. In step 430, the routine stores the route option information, optionally with an indication of the client that requested the route information (e.g., to enable later provision of updated information to the client should conditions change), and in step 435 provides at least some of the selected route information to the client (e.g., only information for the predicted optimal or top-ranked route, information for a specified number of routes and/or all route options, etc.).

If it is instead decided in step 410 that an indication of a conditions update for a geographic area has been received (e.g., an indication of a traffic incident along a particular roadway), the routine proceeds to step 450 and identifies any affected route(s) whose associated clients are known. In step 455, the routine updates route options with respect to the updated conditions for the identified routes, with the updated conditions possibly including real-time traffic data and/or updated predictions information from the Predictive Traffic Information Provider system, and with the updated route options possibly resulting in a different predicted optimal or top-ranked route option. In step 460, the routine then optionally provides updated route information to the associated clients, such as if the updated route options information would result in different client behavior. For example, the updated route information may be provided to vehicle-based clients that may be traveling on or near the affected routes, or more generally to client devices 382 that had previously been used to obtain information regarding one or more of the affected routes.

After steps 435 or 460, the routine continues to step 490 to determine whether to continue. If so, the routine returns to step 405, and if not continues to step 499 and ends.

Figure 5A:
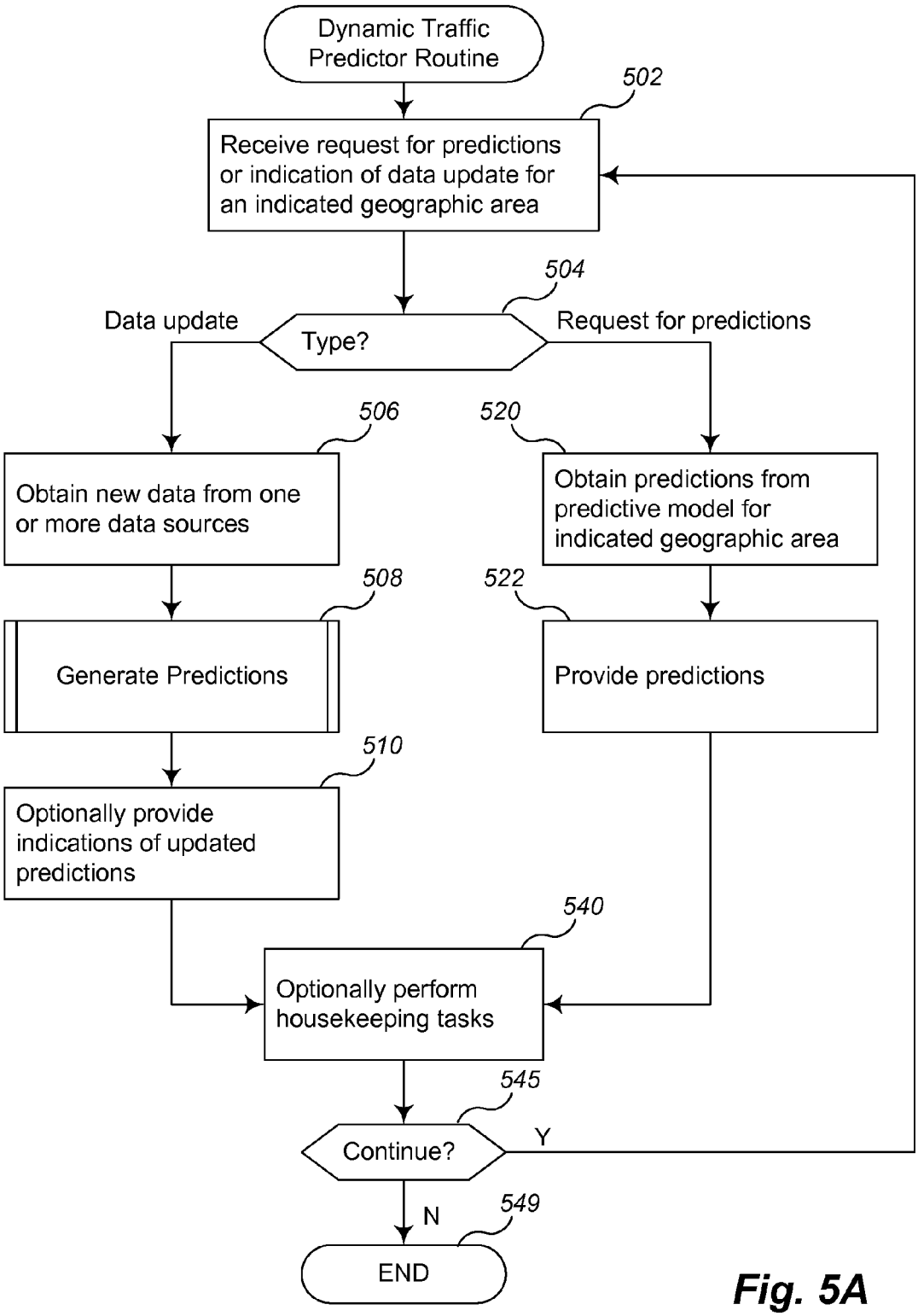
FIGS. 5A-5B are flow diagrams of embodiments of a Dynamic Traffic Predictor routine and an associated Generate Predictions subroutine.
Figure 5B:
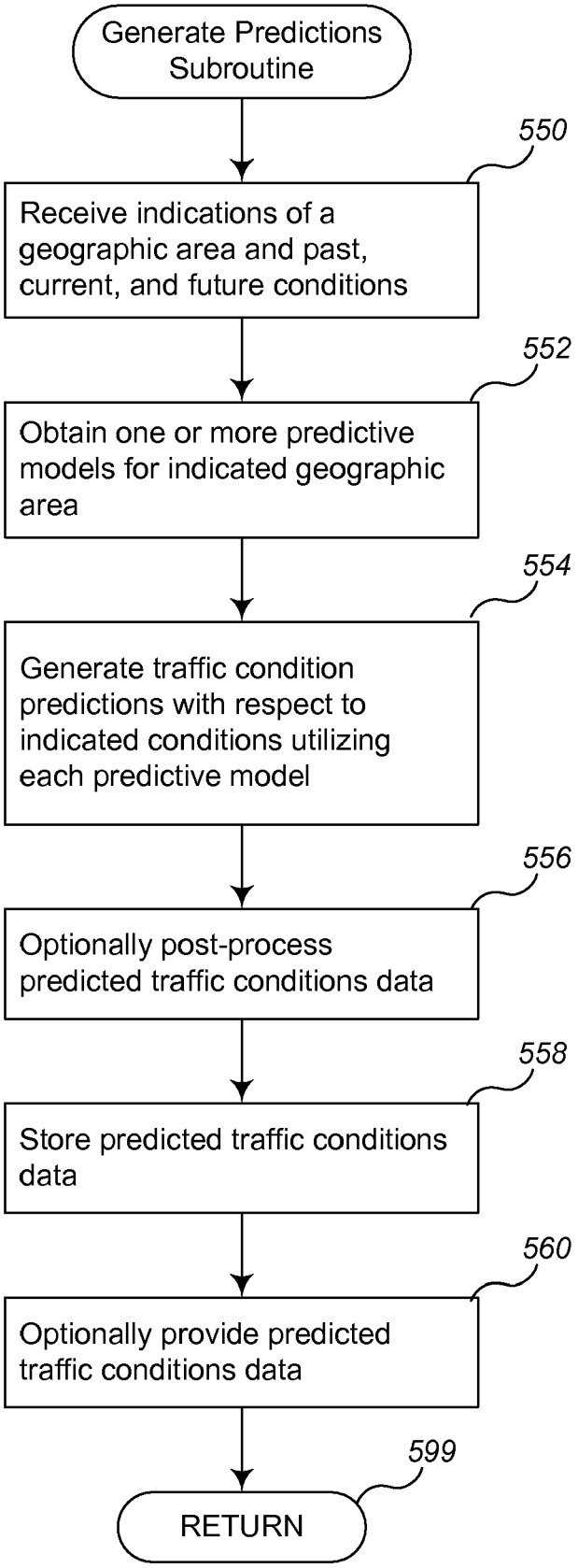

FIGS. 5A-5B are flow diagrams of embodiments of a Dynamic Traffic Predictor routine and an associated Generate Predictions subroutine. The routine of FIG. 5A may be provided, for example, by execution of the Dynamic Traffic Predictor component 356 in FIG. 3, such as to generate predictions of future traffic conditions at multiple future times for each of one or more roads or road segments in one or more geographic areas. In this illustrated embodiment, the routine generates predictions when new current condition input information is received or upon request (e.g., based on periodic requests to generate new predictions, such as every five minutes), but in other embodiments could generate such predictions at other times (e.g., periodically, such as by retrieving any available current condition input information at that time).

The routine begins in step 502 and receives a request for prediction information (e.g., for an indicated road or road segment at an indicated time, or for all roads and road segments in a geographic area based on current conditions) or an indication of a data update for an indicated geographic area. In step 504, the routine determines whether a data update or a predictions request was received, and if it is determined that a data update was received, the routine proceeds to step 506 and obtains new current conditions data from one or more data sources for use as input in the prediction generations (e.g., from the Data Supplier component 352 in FIG. 3, from appropriate stored information, from other sources, etc.). In step 508, the routine executes a Generate Predictions subroutine that generates an updated set of predictions with respect to the newly obtained data, as discussed in greater detail with respect to FIG. 5A, with the generated prediction information stored for later use. In step 510, the routine optionally provides indications of the updated prediction information obtained in step 508 to one or more clients, such as to users who have previously expressed an interest in such information, to third-party entities who may use such prediction information, etc.

If it was instead determined in step 504 that a request for predictions was received, the routine proceeds to step 520 and obtains previously generated predictions from one or more predictive models for the indicated geographic area, such as predictions generated in step 508. In step 522, the routine provides the obtained predictions to the client. After steps 510 and 522, the routine proceeds to step 540 and optionally performs any housekeeping tasks. In step 545, the routine determines whether to continue. If so, the routine returns to step 502, and if not continues to step 549 and ends.

FIG. 5B is a flow diagram of an embodiment of a Generate Predictions subroutine that generates predictions of future traffic conditions at multiple future times for each of one or more roads or road segments in one or more geographic areas, such as for use by the Dynamic Traffic Predictor routine illustrated in FIG. 5A. In this example embodiment, the subroutine generates the future traffic conditions predictions for a geographic area using probabilistic techniques via generated predictive models that include a Bayesian network and multiple corresponding decision trees, such as is previously discussed, but in other embodiments this or a related subroutine could instead generate future traffic conditions predictions in other manners.

The subroutine begins in step 550 and receives indications of a geographic area and of past, current, and future conditions for use as input information. As described in greater detail elsewhere, such conditions may include information about current and past weather conditions, weather forecasts, event schedules, school schedules, current and past traffic conditions, etc. In step 552, the subroutine obtains one or more generated predictive models for the indicated geographic area that include a Bayesian network and one or more decision trees, such as by retrieving previously generated models or by requesting the models from a Traffic Prediction Model Generator component. In step 554, the subroutine generates future traffic condition predictions based on the current conditions input information by using the predictive models, such as to generate predictions at each of multiple future times for each road or road segment in the indicated geographic area. In step 556, the subroutine then optionally performs post-processing of the predicted future traffic conditions information, such as to include merging, averaging, aggregating, selecting, comparing, or otherwise processing one or more sets of output data from the one or more predictive models. In step 558, the subroutine stores the predicted future traffic conditions information, and in step 560 optionally provides the predicted traffic conditions information to one or more clients. In step 599 the subroutine returns.

Figure 6:
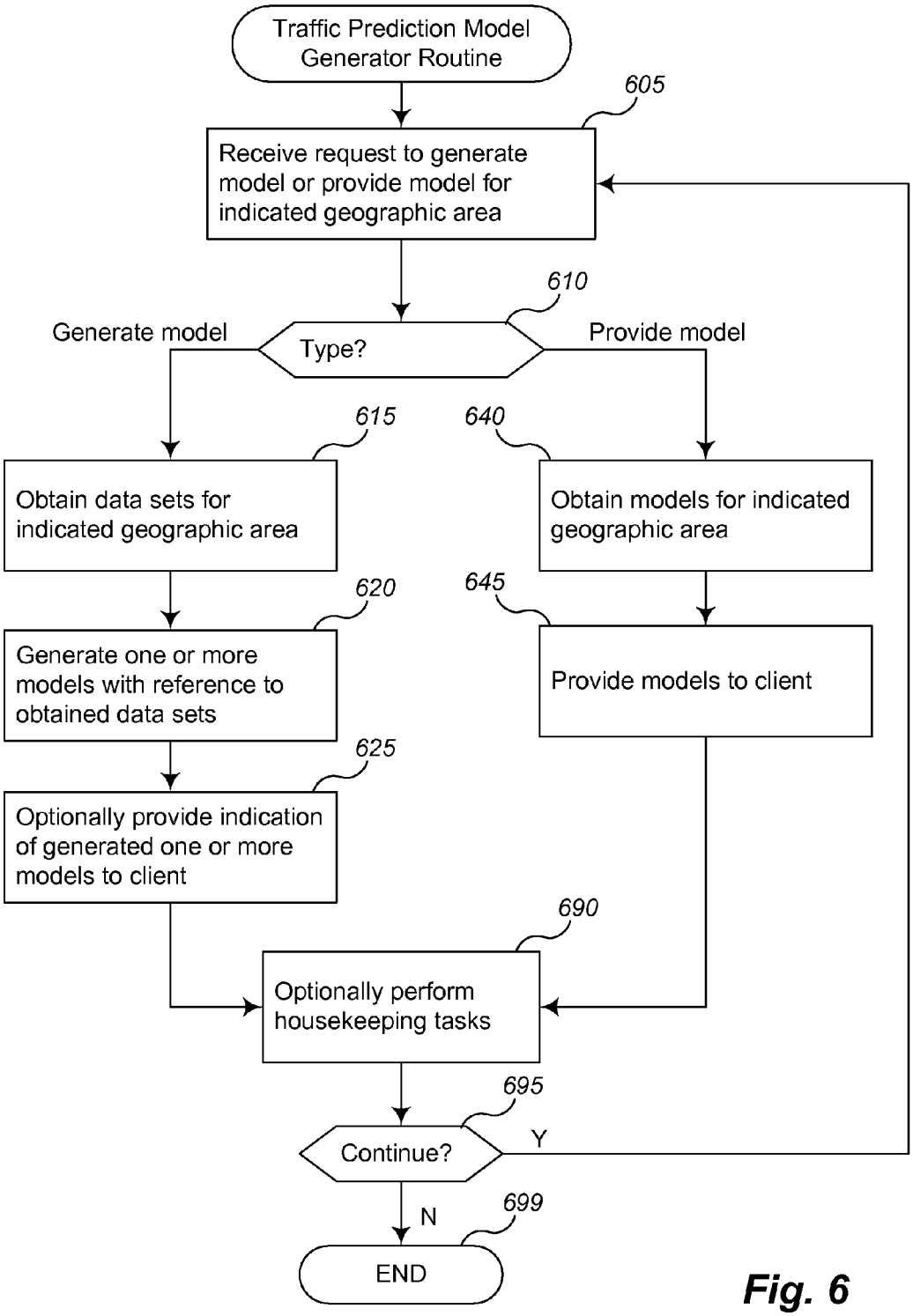
FIG. 6 is a flow diagram of an embodiment of a Traffic Prediction Model Generator routine.

FIG. 6 is a flow diagram of an embodiment of a Traffic Prediction Model Generator routine. The routine may be provided, for example, by execution of the Traffic Prediction Model Generator component 354 of FIG. 3, such as to generate predictive models based on observed case information for later use in generating future traffic conditions predictions.

The routine begins in step 605 and receives a request to generate predictive models for an indicated geographic area or to provide previously generated predictive models for an indicated geographic area. In step 610, the routine determines the type of received request, and if a request to generate a model was received, the routine proceeds to step 615 to obtain observed data for the indicated geographic area, such as from the Data Supplier component 352 or from stored data. In step 620, the routine then generates one or more predictive models with reference to the obtained observed data, as discussed in greater detail elsewhere. In step 625, the routine then optionally provides an indication of the generated one or more models to a client from whom the request was received and/or to others (e.g., the Dynamic Traffic Predictor component 356 of FIG. 3), or otherwise stores the generated models for later use.

If it was instead determined in step 610 that a request to provide a model was received, the routine continues to step 640 where one or more models previously generated predictive models for the indicated geographic area are retrieved. In step 645, the routine then provides those models to the client who requested the models or to another indicated recipient, such as the Dynamic Traffic Predictor component 356 and/or a third-party computing system that utilizes the models to perform its own predictions.

After steps 625 and 645, the routine proceeds to step 690 and optionally performs any housekeeping tasks. In step 695, the routine then determines whether to continue. If so, the routine returns to step 605, and if not continues to step 699 and ends.

In some embodiments, the selection of routes may be based on a variety of types of indicated information, such as when information is requested for fully or partially specified travel routes (with a partially specified route not specifying every road segment between a given starting and ending location), when a starting and ending location are specified (optionally with one or more intermediate locations), when one or more desired times for travel are indicated (e.g., on a particular day; between a first and second time; with an indicated arrival time; etc.); when one or more criteria for assessing route options are specified (e.g., travel time, travel distance, stopping time, speed, etc.), etc. In addition, varying amounts of information related to travel routes may be provided in various embodiments, such as to provide clients with only a predicted optimal selected route or to provide clients with a variety of details about multiple route options analyzed (e.g., in a ranked or otherwise ordered manner, such as by increasing travel time). In addition, some embodiments may represent travel routes in various manners, including human-readable, textual representations using common street and road names and/or machine-readable representations such as series of GPS waypoints.

Various embodiments may also employ various conventions for representing and providing current and predicted traffic condition information. For example, in some embodiments a data feed may be provided for each geographic area of interest to indicate predicted future traffic condition information for each of multiple future times. The data feed format may, for example, be defined by an XML schema that defines an element type with one or more attributes that each contain information related to a predicted traffic congestion level conditions for a single road segment for each of multiple future times, with a fragment of an example such XML stream or file as follows:

```
<Segment id="423" speed="55" abnormality="0"
  color="3"
next3hours="3,3,3,3,2,1,1,0,0,0,1,1"
confidence="2,2,2,1,1,0,0,1,1,1,0,0"/>
```

The above XML fragment represents the current and predicted future traffic conditions for an example road segment 423 (which may represent a single physical sensor, a group of physical sensors that correspond to a logical road segment, one or more data sources other than traffic sensors, etc.). In this example, the current average speed is indicated to be 55 MPH, no abnormalities exist with respect to the current average speed (in this example, abnormalities indicate a difference in the actual current average speed with respect to what would be expected for the current average speed, such as by using a baseline forecast average speed for that time of day, day of week, week of month, and/or month of year); and the current traffic congestion level is indicated to be 3 (in this example, congestion levels are expressed as integers between 0 and 3, with 3 corresponding to the lowest level of traffic congestion and thus being equivalent to a value of green, and with 0 being equivalent to a value of black). As previously discussed, such abnormalities and other anomalies may be detected in various ways, such as by an embodiment of an anomalous traffic condition detector system. In addition, in this example the comma-delimited list labeled "next3hours" indicates predicted future traffic congestion levels for the next twelve future times at 15-minute intervals. In this example, confidence level information is also provided for each of the twelve predicted future traffic congestion levels, with the comma-delimited list labeled "confidence" indicating such confidence levels, although in other embodiments such confidence levels may not be generated and/or provided. In this example, confidence levels are expressed as integers between 0 and 2, with 2 corresponding to the highest level of confidence and 0 being the lowest level of confidence, although other means of representing predicted future traffic congestion levels and associated confidence levels may be used in other embodiments.

In addition, various embodiments provide various means or mechanisms for users and other clients to interact with one or more of the predictive traffic information systems. For example, some embodiments may provide an interactive console (e.g. a client program providing an interactive user interface, a Web browser-based interface, etc.) from which clients can make requests and receive corresponding responses, such as requests for information related to current and/or predicted traffic conditions and/or requests to analyze, select, and/or provide information related to travel routes. In addition, some embodiments provide an API ("Application Programming Interface") that allows client computing systems to programmatically make some or all such requests, such as via network message protocols (e.g., Web services) and/or other communication mechanisms.

FIGS. 7A-7I illustrate example displays of various traffic-related information based on predictions of future traffic conditions. In some embodiments, some or all of such traffic-related information may be provided by an embodiment of a Predictive Traffic Information Provider system and/or an embodiment of a Route Selector system, or may instead by provided by one or more third parties based at least in part on predictive traffic information supplied to those third parties by one or more of the system. In addition, such traffic-related information may be provided to users in various ways in various embodiments, such as by a Web-based client on a desktop computing system that displays the information to one or more users or via cellular telephones or other mobile devices that display or otherwise provide the information to a user.

Figure 7A:
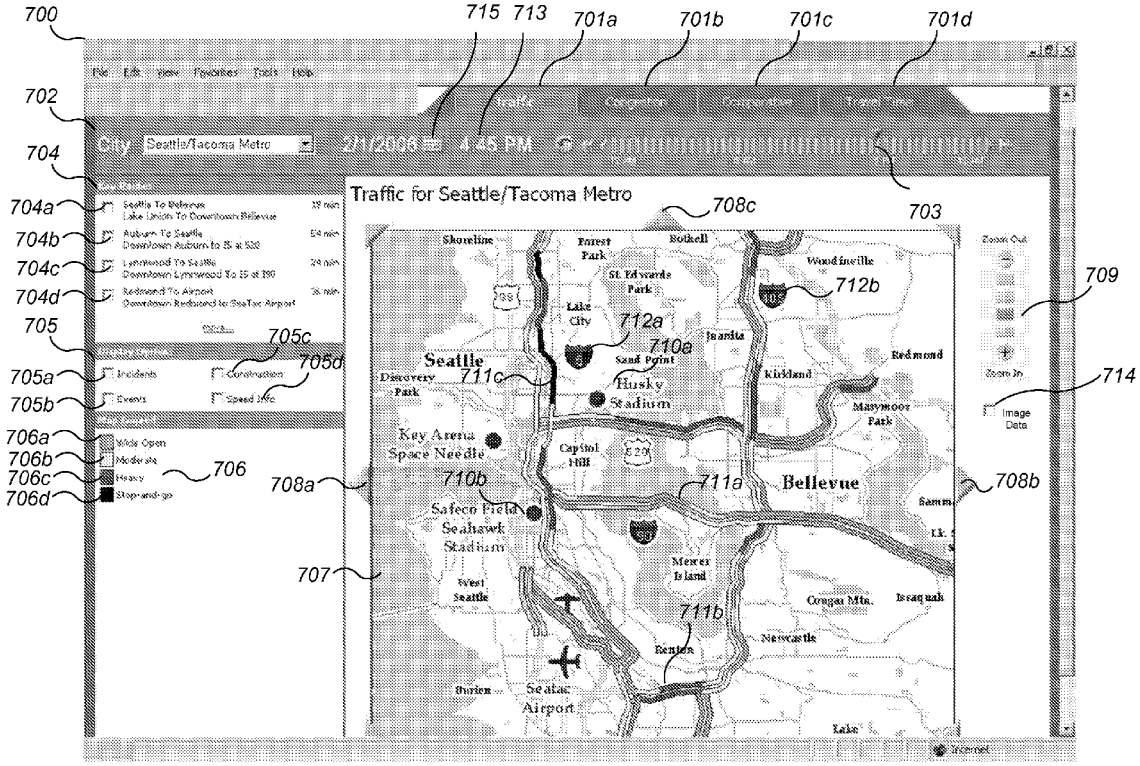
FIGS. 7A-7I illustrate example displays of various traffic-related information using predictions of future traffic conditions.

FIG. 7A illustrates an example display 700 showing current traffic conditions for a network of roads in the Seattle/Tacoma Metro geographic area of the state of Washington. In this example, the display includes user-selectable navigation tab controls 701*a-d*, a user-selectable geographic area selection menu control 702, a user-selectable time slider control 703, a date selector calendar control 715, a key route selection area 704, a display option selection area 705, a map legend area 706, a map display area 707, a user-selectable map data selector control 714, user-selectable pan button controls 708*a-c*, a user-selectable zoom tool control 709, and currently selected time indicator information 713 (to correspond to the user-manipulatable time indicator illustrated on the time slider control as a small triangle pointing downward).

In this example, a view of road traffic information is currently selected (based on selection of the "Traffic" navigation tab 701*a*), the geographic area currently selected is the Seattle/Tacoma Metro area (via control 702), and the time currently selected is 4:45 PM on Feb. 1, 2006 (via slider 703 and/or the calendar date selector control 715), with the various displayed information reflecting those selections. As is shown in the map display area 707 and described in the map legend area 706, traffic road congestion level condition information is currently shown for a selection of major roads in the currently visible portion of the Seattle/Tacoma Metro geographic area. For current or past times for which actual road congestion level condition information is available, the displayed information reflects that actual information, and for future times the displayed information reflects predicted future traffic conditions at those times. In this example, the displayed major roads are divided into logical road segments which are each displayed using a level of grayscale shading to indicate a corresponding level of road congestion of that road segment for the selected time, such as with a road segment 711*c* of the northbound portion of the Interstate 5 road being illustrated with "Stop-and-go" traffic conditions (shown in black in this example), with the adjacent road segment to the south being illustrated with "Moderate" traffic conditions, and with the adjacent road segment to the north also being illustrated with "Stop-and-go" traffic conditions before the next road segment to the north changes to "Heavy" traffic conditions. Road segment 711*a* along the Interstate 90 road is currently shown with "Wide Open" traffic conditions, road segment 711*b* along the Interstate 405 road currently is shown with "Heavy" traffic conditions, and numerous other road segments are similarly shown with corresponding traffic congestion level condition information. While illustrated in grayscale here, in other embodiments the map may be displayed instead in color, such as to show "Stop-and-go" traffic conditions in black, "Heavy" traffic conditions in red, "Moderate" traffic conditions in yellow, and "Wide Open" traffic conditions in green.

The display of traffic-related information may be modified by a user (not shown) in various ways in this example embodiment. For example, the geographic area selection menu control 702 can be used to select from one of a number of different geographic areas for which traffic-related information is available. The time slider control 703 can be used to modify the time that is currently selected for which traffic information is shown, such as to view predicted traffic conditions at future times. The key route selection area 704 includes various user-selectable option controls 704*a-d* that may be selected in order to highlight key routes on the displayed map, such as to highlight a route from Seattle to Bellevue by selecting option 704*a*. User-selectable display option controls 705*a-d* include information about incidents 705*a*, events 705*b*, construction 705*c*, and speed info 705*d*, such as with corresponding information for one or more selected options being overlaid on the displayed map. Pan button controls 708*a-c* can be used to scroll or pan the map frame 707 to obtain a different view of the current geographic area, with an additional southern pan button control 708*d* not currently shown due to the scrolling of the window. The zoom tool control 709 may be used to increase or decrease the display scale of the map. The map data selector control 714 may be used to select an alternate source of map data, such as actual satellite or other imagery of the geographic area (e.g., over which labels or other indications of the roads of interest are displayed). Various other user-selectable controls may be provided in other embodiments, and some or all of the illustrated controls may not be available.

In this example, the map currently displays various information in addition to the traffic conditions for the selected network of roads, such as to indicate venues and other locations that may correspond to events and other areas of traffic concentration (such as Husky Stadium 710*a* in which college football and other events may occur, Safeco Field 710*b* in which professional baseball and other events may occur, Seahawk Stadium in which professional football and soccer and other events may occur, the Space Needle tourist attraction, the SeaTac Airport, popular parks such as Marymoor Park and Discovery Park, etc.), cities and neighborhoods, and highway labels such as 712*a-b*. Various other types of information may similarly be shown, such as at all times or instead in a user-selectable manner.

Figure 7B:
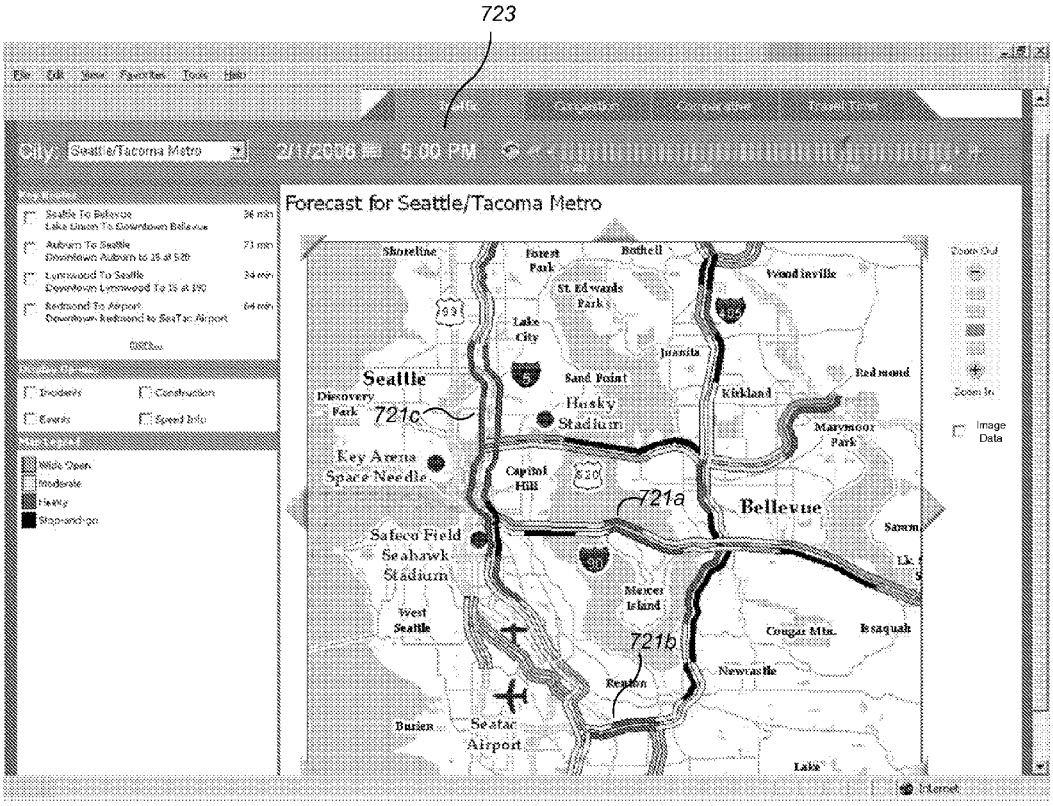

FIG. 7B illustrates an example display showing predicted traffic conditions at a currently selected future time 723 of 5:00 PM, such as based on user modification at 4:45 PM of the slider control 703 of FIG. 7A. Overall, the illustrated predicted traffic congestion level conditions in FIG. 7B for the road network appear to be more congested than the traffic congestion level conditions for 4:45 PM in FIG. 7A. As one example, road segment 721*a* has a different predicted level of road traffic congestion condition than the respective corresponding road segment 711*a* of FIG. 7A, with heavy traffic congestion conditions now being illustrated.

Figure 7C:
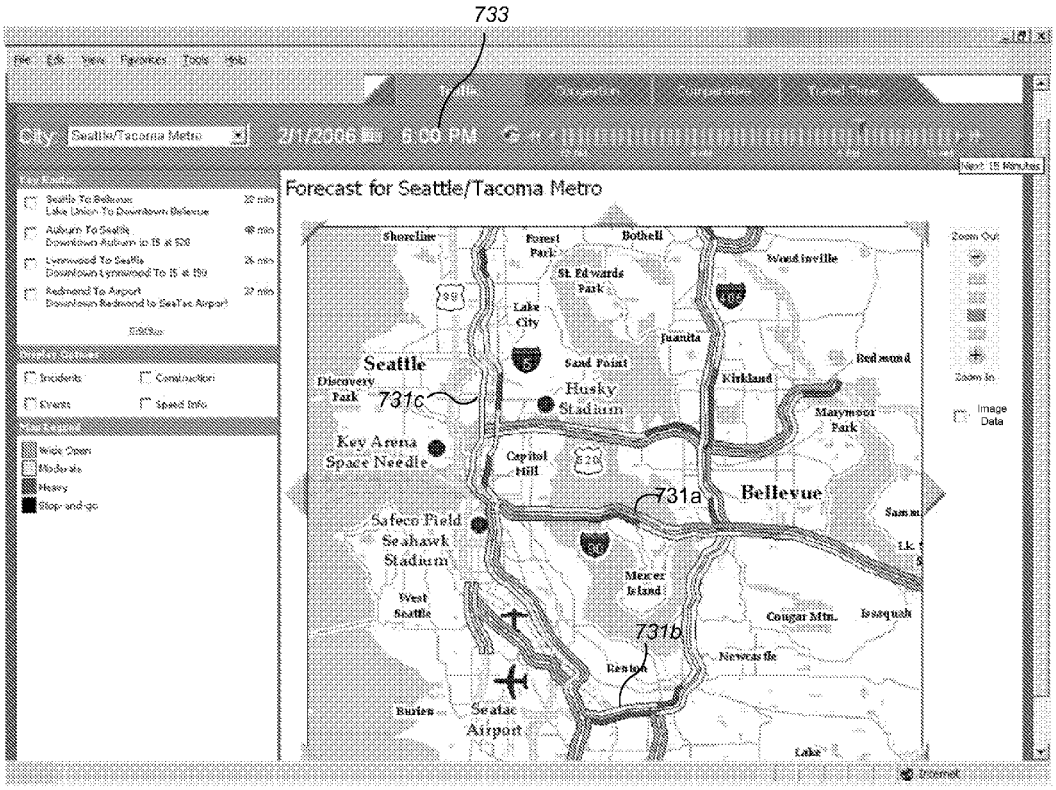

FIG. 7C illustrates an example display showing predicted traffic conditions at a currently selected future time 733 of 6:00 PM, such as based on user modification at 4:45 PM of the slider control 703 of FIG. 7A. Overall, the illustrated predicted traffic congestion level conditions in FIG. 7C for the road network appear to be less congested than the predicted traffic congestion level conditions for 5:00 PM in FIG. 7B. For example, road segment 731*a* is shown as being wide open at 6 PM, while traffic for the same segment 721*a* in FIG. 7B was predicted to be heavy at 5:00 PM. In addition, road segment 731*b* has changed from heavy to moderate levels of traffic congestion between 5:00 and 6:00 PM, as shown by the corresponding segment 721*b* in FIG. 7B.

Figure 7D:
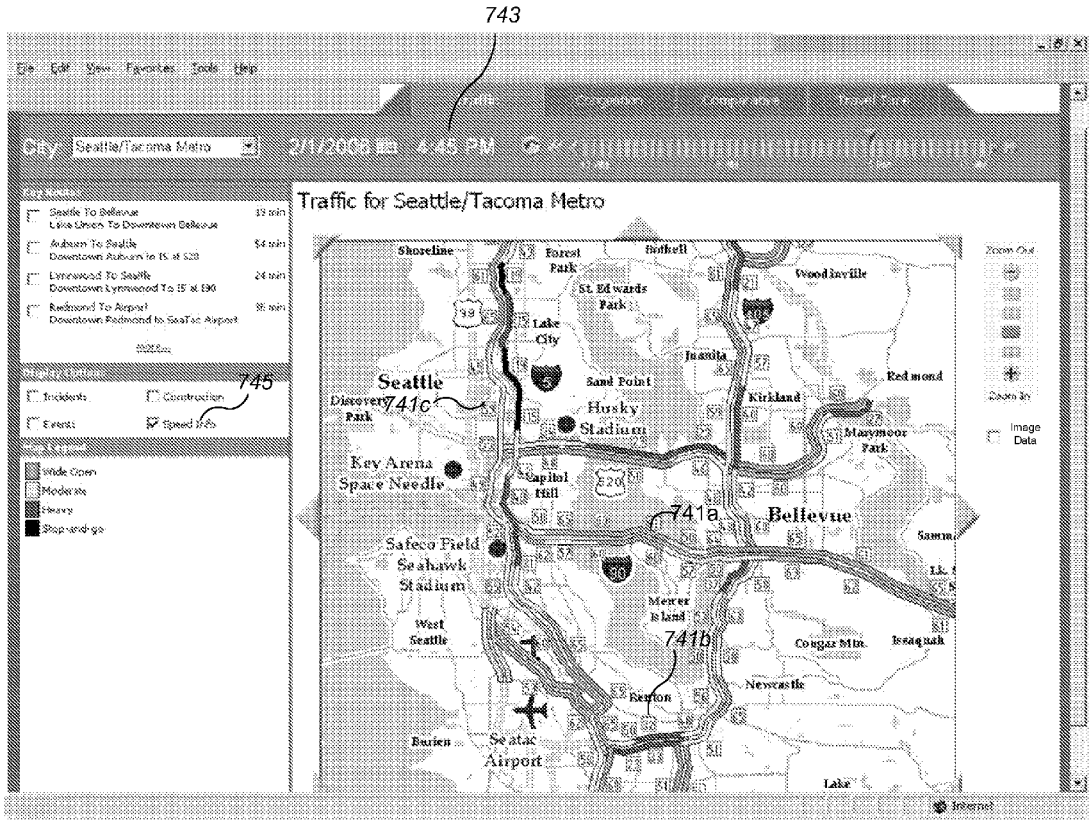

FIG. 7D illustrates an example display similar to that shown in FIG. 7A, but with the map being augmented with roadway speed information. In particular, in this view the user has selected the display option 745 (labeled "Speed Info") in order to cause current average traffic speeds to be illustrated. For example, road segment 741*a* (with wide open traffic congestion) is labeled with a numeric 61 indicator that reflects an average speed of 61 miles per hour for traffic on that segment at the currently selected time 743 of 4:45 PM. In contrast, road segment 741*b* (with heavy traffic congestion) is labeled with a numeric 32 indicator that reflects an average speed of only 32 miles per hour for vehicles on that road segment. In some embodiments such speed information indicators may be displayed for only current and/or past times, while in other embodiments predicted future traffic condition speed information may similarly be displayed for future times.

Figure 7E:
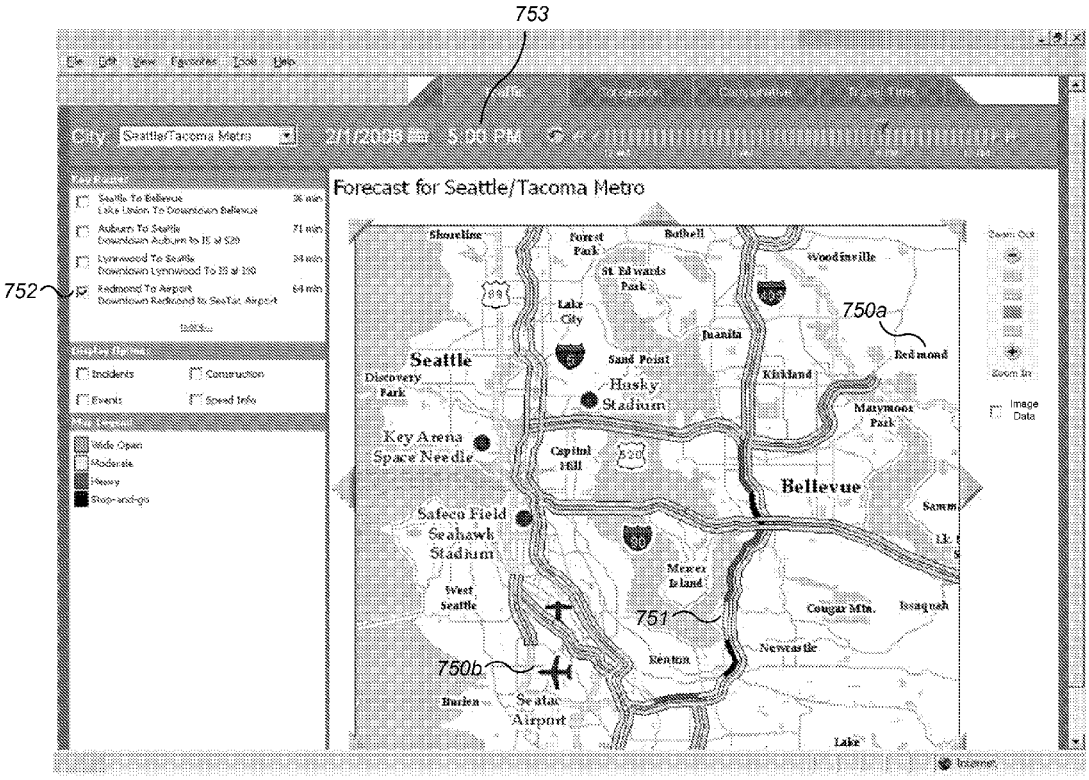

FIG. 7E illustrates an example display similar to that shown in FIG. 7B, but with the map showing predicted travel conditions on a particular travel route at the currently selected future time 753 of 5:00 PM. In this example, the user has selected key route option control 752 labeled "Redmond to Airport," and in response information about predicted traffic conditions relevant to the route between Redmond 750*a* and SeaTac Airport 750*b* are shown for the currently selected future time. In particular, in this example traffic condition information is shown only for the route 751 through the road network corresponding to the selected route option 752, such as by displaying other roads in a de-emphasized fashion (e.g., in embodiments in which road congestion levels are shown in color, by showing the other roads in gray).

Figure 7F:
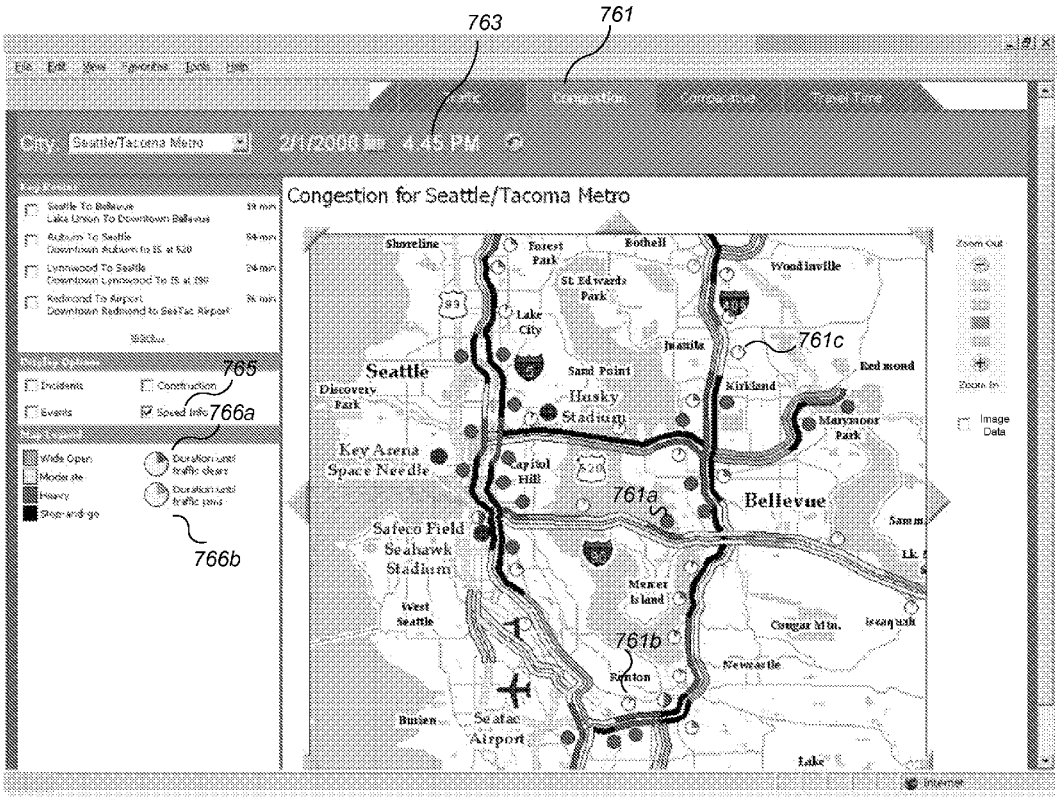

FIG. 7F illustrates an example display similar to that shown in FIG. 7A, but with the map showing a congestion-oriented view of current traffic conditions at the currently selected time 763 of 4:45 PM. In this view, the user has selected the "Congestion" navigation tab control 761 and the speed information display option 765 in order to obtain information about predicted times until current traffic conditions are expected to change from their current state. In this example, a time slider is not shown because the predicted information provided is relative to a current time of 4:45 PM, although in other embodiments similar predicted change information may additionally be available for user-selected future times. In this view, road segments are annotated with circular clock icons, such as icons 766*a* and 766*b*. The clock icon 766*a* with darker shading in this example indicates an amount of time until traffic on a given road segment clears or otherwise improves by a designated amount (e.g., changes from "Stop-and-go" or "Heavy" to "Moderate" or "Wide Open"), while the clock icon 766*b* with lighter shading in this example indicates an amount of time until traffic on a given road segment becomes congested or otherwise worsens by a designated amount (e.g., changes from "Wide Open" or "Moderate" to "Heavy" or "Stop-and-go"). For example, clock icon 761*a* is all dark, indicating that the corresponding adjoining road segment is expected to remain in a congested state for at least the next hour. In contrast, clock icon 761*b* is only approximately one-eighth dark, indicating that the adjoining road segment is expected to clear in approximately one-eighth of an hour, and clock icon 761*c* is approximately one-eighth light, indicating that traffic on the adjoining road segment is expected to become congested soon.

Figure 7G:
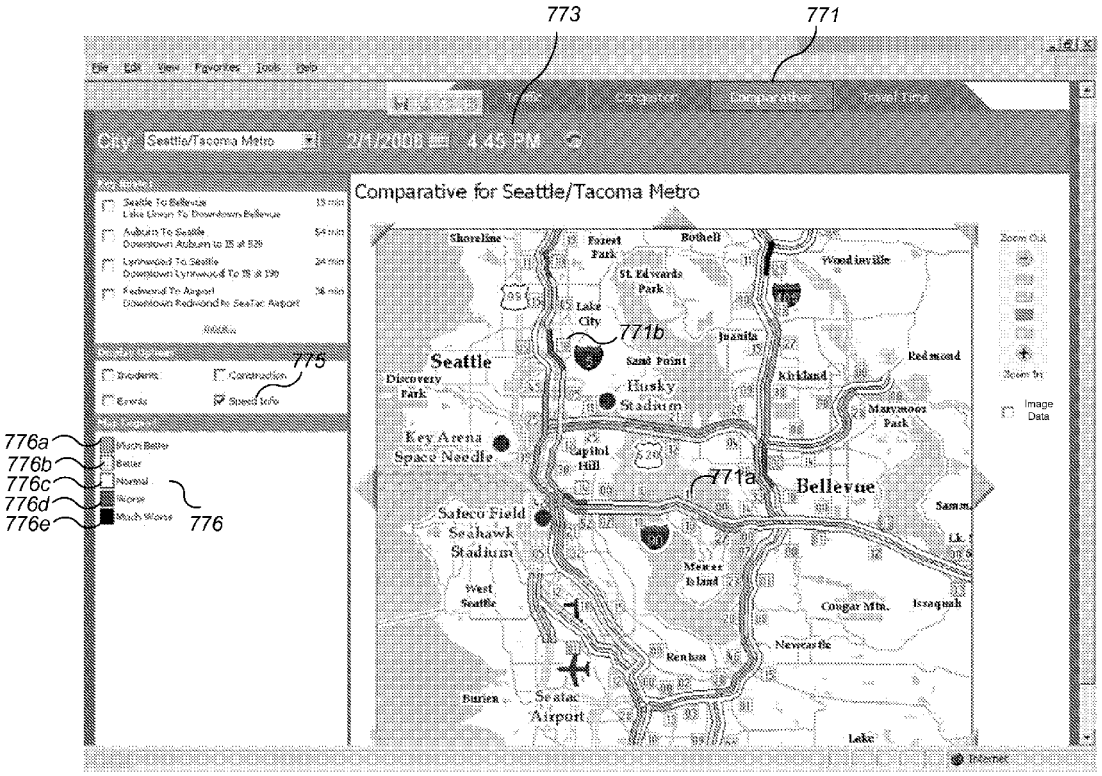
Figure 7H:
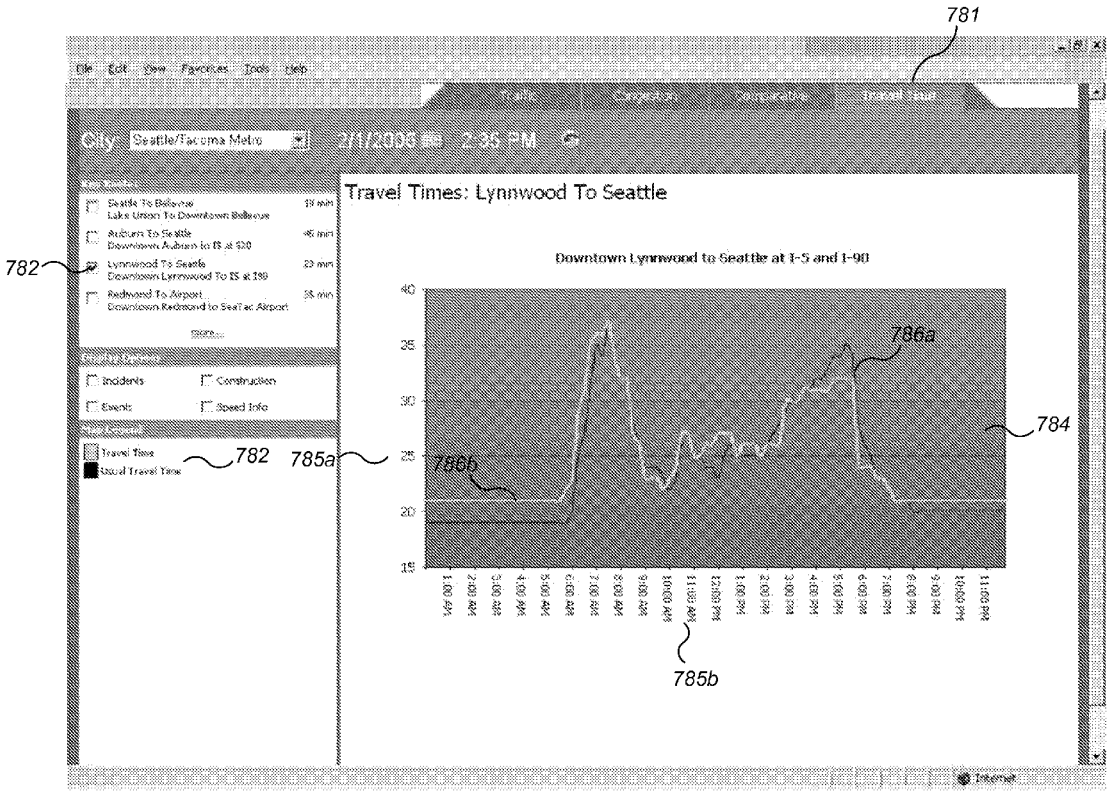
Figure 7I:
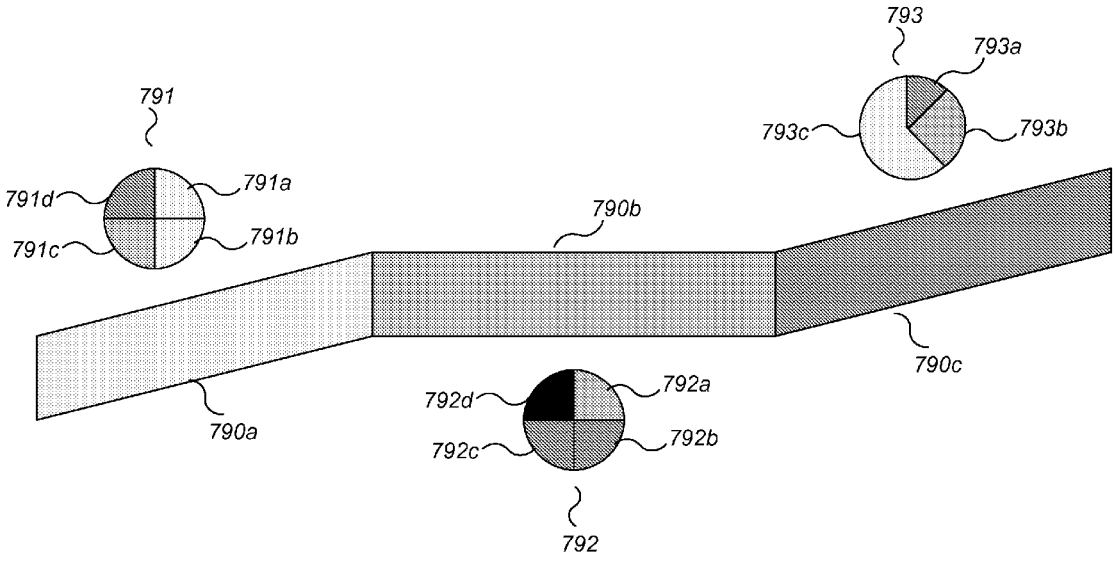

FIG. 7I illustrates an example display similar to that shown in FIG. 7F, but with only a portion of one road illustrated and with icons that each visual present information about predicted traffic conditions for multiple future times. In this example, three road segments 790*a-c* are shown and each displayed with a degree of predicted traffic congestion level at a particular currently selected time, not shown (although in embodiments in which the currently selected time is a past time, at least some of the information displayed may reflect actual traffic congestion levels corresponding to the past time rather than predicted information). In this example, road segment 790*a* has wide-open traffic conditions at the currently selected time, road segment 790*b* has moderate traffic conditions at the currently selected time, and road segment 790*c* has heavy traffic conditions at the currently selected time.

In addition, each road segment has an adjoining clock icon that can display multiple areas each corresponding to a portion of the hour following the currently selected time, although in other embodiments the clock may represent a period of time other than an hour, or such information may alternatively be displayed in manners other than a clock or a circle. For example, clock 791 adjoins road segment 790*a* and has four portions 791*a-d*, with each portion for this clock being a 15-minute quadrant, and with each clock portion being filled with the level of grayscale for the traffic congestion level represented by that portion. Thus, portion 791*a* represents the 15 minutes following the currently selected time and is shaded to indicate that wide-open traffic conditions are predicted for road segment 790*a* during those 15 minutes, and portion 791*b* represents the period of time from 15 to 30 minutes after the currently selected time and also indicates predicted wide-open traffic congestion level conditions. While the portions of example clock 791 are evenly spaced in 15-minute segments (e.g., to reflect predictions made at each of 15-minute time intervals), in other embodiments each distinct portion of time within a clock may instead correspond to a different predicted or actual traffic congestion level—if so, the two portions 791*a* and 791*b* that both represent the same level of traffic congestion would instead by combined into a single portion, which in this example would be a portion that fills the first half of the clock. In this example, portion 791*c* indicates predicted moderate traffic conditions for the road segment during the next period of time (which in this example is 30 to 45 minutes after the currently selected time), and portion 791*d* indicates predicted heavy traffic conditions for the road segment during the last 15 minutes of the hour. Thus, in contrast to the clock icons illustrated in FIG. 7F that each represent a single predicted future traffic condition (the future point in time when the level of traffic congestion will change), the clock icon 791 illustrates predicted future traffic conditions for each of multiple future times, and provides significantly more information to the user regarding predicted future conditions in a compact and easy-to-understand manner.

In a similar manner to clock icon 791, clock icon 792 adjoins road segment 790*b* and has four portions 792*a-d* that in this example are each 15-minute quadrants. Quadrants 792*a-d* represent, respectively, moderate, heavy, heavy, and stop-and-go predicted traffic congestion level conditions for road segment 790*b* at the periods of time corresponding to the portions. Conversely, clock icon 793 has only three portions that each represents a traffic congestion level distinct from any other portions adjacent in time. Thus, with respect to adjoining road segment 790*c*, portion 793*a* of clock 793 indicates predicted heavy traffic congestion level conditions for the road segment during a first approximately 7 minutes following the currently selected time, portion 793*b* indicates predicted moderate traffic congestion level conditions for the road segment during the following approximately 15 minutes, and portion 793*c* indicates predicted wide open traffic congestion level conditions for the road segment during the remainder of the hour. While three portions of time are illustrated here, in will be appreciated that more or less portions could be displayed, that each portion can represent any amount of time down to the difference in times between distinct future time predictions, and that different portions of such a clock may represent the same predicted level of traffic congestion (e.g., if one or more intervening portions have one or more different predicted traffic congestion levels).

FIG. 7G illustrates an example display similar to that shown in FIG. 7A, but with the map showing a comparative view of current traffic conditions at the currently selected time 773 of 4:45 PM so as to indicate differences from normal conditions. In this view, the user has selected the "Comparative" navigation tab control 771 and the speed information display option control 775 in order to obtain information describing a degree of difference (e.g., a numeric amount of difference and/or one of multiple predefined enumerated levels of difference) between current traffic conditions as compared to normal expected conditions for the currently selected time, with normal traffic conditions being determined in this example by reference to a predictive model that can be used to determine expected default long-term traffic condition forecasts based on historical observations and some current conditions such as scheduled events but not on transient or temporary situations such as accidents and other road incidents, short-term road construction, current weather conditions, etc. More generally, in other embodiments the "normal" or other expected data against which the comparison is made may be determined or selected in other manners, such as the following: by purely using historical averages; by allowing a user to designate the types of information to be considered for the "normal" data (e.g., to use school calendar information but not events), such as is described in more detail with respect to FIG. 7K; by allowing a user or other operator to designate a particular set of data to be used for the comparison (e.g., by supplying a particular set of data, by indicating a particular past date to use, such as last Wednesday at 5 PM, etc.), such as is described in more detail with respect to FIG. 7K; etc. In this example, a time slider is not shown because the predicted information provided is relative to a current time of 4:45 PM, although in other embodiments similar predicted difference information may additionally be available for user-selected future times, such as is described in more detail with respect to FIG. 7J. In this view, the road segments are again marked to reflect information of interest, but the map legend 776 indicates different meanings for the markings, such as to indicate varying degrees or levels of difference from normal in various shades of gray (or in other embodiments to instead using various colors, such as green to indicate that current or predicted traffic conditions are much better than normal 776*a*, yellow to indicate that the traffic conditions are better than normal 776*b*, white to indicate that the traffic conditions are substantially normal 776*c*, red to indicate that the traffic conditions are worse than normal 776*d*, and black to indicate that the traffic conditions are much worse than normal 776*e*). In addition, in this example the selection of the speed information control 775 prompts road segments to be annotated with numbers in boxes to indicate a numeric difference of the number of miles per hour faster or slower than normal that traffic is flowing on a given road segment (e.g., for embodiments in which colors are used, boxes displayed in one of two colors to indicate better than normal speeds and worse than normal speeds, such as green for better and red for worse). For example, road segment 771*a* is displayed with a level of grayscale indicating better-than-normal traffic and is annotated with the number "11" in a box (e.g., a green box) to indicate that traffic is flowing 11 miles per hour faster than normal on that road segment. In contrast, road segment 771*b* is displayed with a level of grayscale indicating worse-than-normal traffic and is annotated with the number "10" in a box (e.g., a red box) to indicate that traffic is flowing 10 miles per hour slower than normal on that road segment.

Other types of comparative traffic conditions information may be displayed in other manners in other embodiments. For example, in some embodiments, comparative traffic conditions information may be determined and displayed in a manner other than on a per-road segment basis, such as to determine and display aggregate comparative traffic conditions information for multiple road segments (e.g., multiple road segments along a particular route, or in a particular geographic area), whether in addition to or instead of displayed comparative traffic information on a per-road segment basis. In addition, other types of comparative information may be determined and displayed in other embodiments, such as differences in an average amount of time to travel from one end of a road segment to another, differences in average traffic volume or occupancy, etc. Furthermore, in addition to the various comparative traffic condition information that is displayed on the map for the various road segments to indicate the differences from expected conditions, in other embodiments additional alerts or notifications may be provided with respect to particular circumstances of interest. For example, a user may be allowed to request a notification when a road segment of interest (e.g., a particular selected road segment, any road segment along a particular selected route, etc.) has traffic conditions that are much better than expected and/or that are much worse than expected, such as during a particular period of time of interest. If so, corresponding notifications or alerts may be provided to the user in various ways, including as part of the user interface that displays the map to the user (e.g., in a separate pane or other window portion for textual notifications, not shown; by further highlighting or emphasizing particular road segments on the map to which the notifications correspond, such as via distinct colors or other visual indicator; etc.) and/or by sending one or more types of electronic messages to the user (e.g., an email, instant message, text message, SMS message, automated phone call, RSS feed communication, etc.).

Figure 7J:
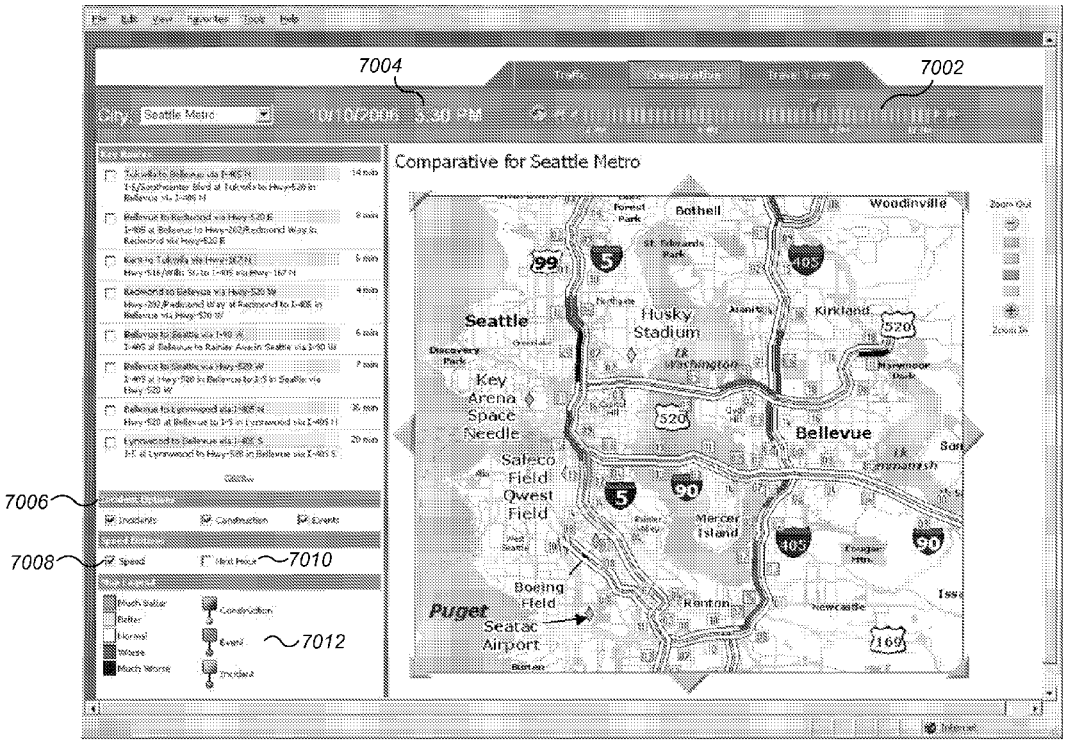
FIGS. 7J-7K illustrate example displays related to anomalous traffic conditions.

FIG. 7J illustrates an example user interface display with comparative traffic condition information similar to that shown in FIG. 7G, but with the display further including a user-manipulatable time slider control 7002 similar to control 703 of FIG. 7A. In this example, the current time is 1:00 PM, but a user has manipulated the time slider 7002 such that the position of the triangle-shaped time indicator on the slider control reflects a selected time 7004 of 3:30 PM. In response, the displayed map is updated so that the displayed traffic conditions information correspond to a comparative view of traffic conditions at the selected time, such as to indicate differences between target traffic conditions for 3:30 PM and expected traffic conditions for 3:30 PM. By using the example user interface display of FIG. 7J, the user can obtain information related to anomalous traffic conditions at selected times of interest. The target and expected traffic conditions data that is used as a basis for comparison for a particular selected time may be selected in various ways, such as based on the difference between the current time and the selected time. In this example, the user is requesting comparative information for a time two and one-half hours in the future, which may be within the time interval for which short-term predicted information is available. As such, target traffic conditions may be obtained from a predictive model that provides short-term predictive information based on current conditions (e.g., current traffic conditions, current weather, traffic incidents, etc.) as well as future conditions corresponding to the selected time (e.g., event schedules, school schedules, forecast weather, scheduled traffic construction or other work, etc.). The expected traffic conditions may be obtained from a predictive model that provides longer-term default forecast information based primarily on conditions and other inputs that may be considered by the user as part of their subjective understanding of "normal" traffic conditions (e.g., not based on current conditions, such as current weather and traffic incidents). In other embodiments and situations, target and expected traffic conditions may be determined in various other ways, as described in more detail elsewhere.

The illustrated user interface display of FIG. 7J also includes an incident display options control area 7006 that includes various user-selectable controls which a user may modify in order to display or not display indications of various types of information affecting traffic conditions via one or more corresponding markers 7012. In this example, the user-selectable controls allow control over display of information about traffic incidents, locations of road construction or other road work, and scheduled events. In addition, the user interface display of FIG. 7J also includes a speed options control area that includes user-selectable controls 7008 and 7010 to modify how speed-related information is displayed on the map. In the illustrated example, in response to the user's selection of the Speed control 7008, the map has been annotated with a number in a box for each road segment to numerically indicate information about average speed for the associated road segment, and in particular in this example to display a comparative number of how many miles per hour faster or slower that the target traffic conditions speed for the selected time is relative to the expected traffic conditions speed for the selected time. By selecting the Next Hour control 7010, the map would instead or in addition be annotated with clock icons similar to those described with reference to FIG. 7I, so as to provide the user with an indication of predicted traffic information for each road segment during a future time period beyond the selected time, such as the next hour. The predicted future information may be displayed as comparative predicted future traffic conditions information and/or as non-comparative absolute predicted future traffic conditions information. Thus, for example, if comparative predicted future traffic conditions information is displayed, a particular clock icon for a particular road segment may indicate distinct predicted traffic information for each of multiple distinct future times during the future time period, such as that traffic conditions will be much better than normal in 15 minutes from the selected time, will be somewhat better than normal in 30 minutes, will be normal in 35 minutes, etc.).

Figure 7K:
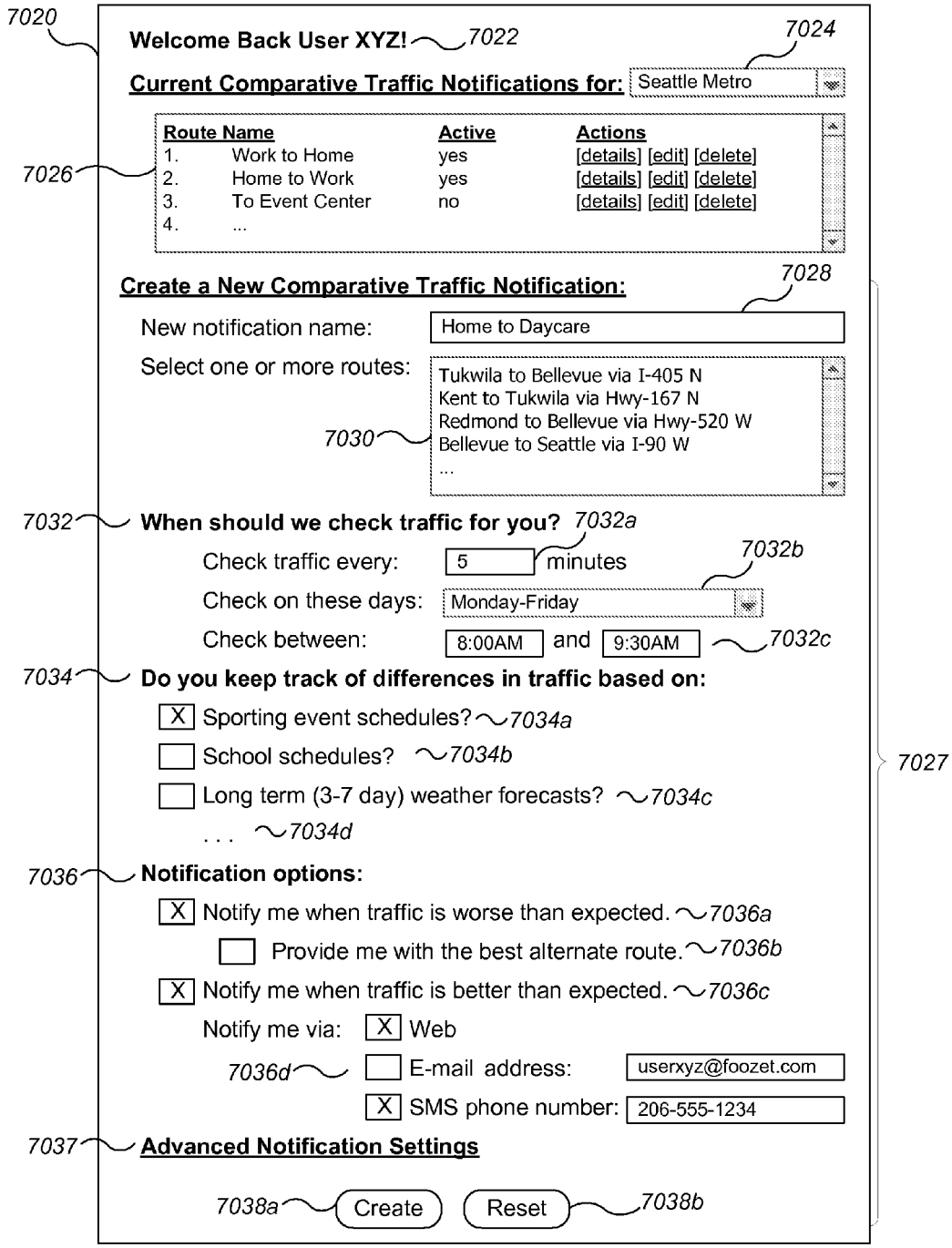

FIG. 7K illustrates an example user interface display 7020 that is provided to a particular example user to allow the user to specify and manage his/her requested types of comparative traffic notifications. The illustrated user interface 7020 may be displayed on, for example, one of the client devices 382 described with reference to FIG. 3. In particular, in at least some embodiments, a user may be able to create one or more particular comparative traffic notification definitions that are used to determine when and how to provide notifications to the user. For example, a particular comparative traffic notification definition may specify various attributes, criteria, and/or conditions that may be used to identify anomalous traffic conditions that are of interest to the user, as well as mechanisms by which the user is to be notified of corresponding traffic condition anomalies. As one particular example, a comparative traffic notification definition may include indications of one or more road segments that are of interest to a user (e.g., road segments that are part of a selected route), timing criteria that specify days and/or times during which the user is interested in receiving notifications of anomalous traffic conditions, indications of the types of information on which "normal" traffic conditions should be based (e.g., that the user ordinarily tracks school schedules but not sporting event schedules), and indications of one or more notification mechanisms by which the user prefers to be notified of any detected anomalous traffic conditions (e.g., by email to a specified email address).

The illustrated user interface 7020 provides various user-selectable controls with which a user may manage (e.g., create, delete, edit, configure, etc.) one or more comparative traffic notification definitions. In particular, the illustrated user interface 7020 includes a welcome message 7022 customized to the user, identified as "User XYZ" in this example. The user interface 7020 also includes a comparative traffic notification definition management control area 7026 that provides summary information and controls for commonly performed actions for comparative traffic notification definitions previously created by the user. In this example, notification definitions are each associated with a particular geographic area, such that the user may manage groups of comparative traffic notification definitions for each of multiple geographic areas, with a user-selectable geographic area control 7024 indicating the current geographic area. In addition, in this example, each of the illustrated comparative traffic notification definitions is associated with a particular route within the current geographic area, so as to select the road segments along that route, although in other embodiments one or more road segments of interest may be specified in other manners. Alternatively, in other embodiments an anomaly may be determined in a manner that is not specific to a particular road segment, but instead reflects an aggregate amount of deviation between target and expected traffic conditions for multiple road segments (e.g., all road segments along a particular route, all road segments within a defined geographic area, etc.), such as by averaging or otherwise combining individual deviations for each road segment in the group, or by initially assessing the deviation in an aggregate manner. In the illustrated example, the comparative traffic notification management control area 7026 displays three comparative traffic notification definitions, named "Work to Home", "Home to Work", and "To Event Center", respectively. In the illustrated embodiment, a comparative traffic notification definition may be in an active or inactive state, as specified by the user, so as to control whether or not notifications should actually be sent when anomalies are detected that match or otherwise conform to the settings, criteria, and/or conditions specified by the notification definition. In this manner, users may temporarily disable the sending of notifications, such as when their travel patterns temporarily change (e.g., when they leave a given geographic area on a business trip or holiday). In addition, in other embodiments, more or less information may be displayed in area 7026, and the displayed information may be displayed in different ways (e.g., organized by creation date, name, etc.).

User interface 7020 also includes a section 7027 with various controls to enable creation of comparative traffic notification definitions. In particular, section 7027 includes a control 7028 that may be utilized to specify a name for a new notification definition (e.g., "Home to Daycare") and a route selection control 7030 that may be utilized to specify one or more travel routes for use in identifying relevant road segments. Section 7027 also includes a timing section 7032 that includes multiple controls 7032*a*-7032*c* via which the user may specify when anomalous traffic conditions should cause notifications to occur. In this example, controls 7032*a*-7032*c* may be utilized to specify frequency, days of week, and a time period, respectively.

In addition, section 7027 includes a designation section 7034 that includes multiple controls 7034*a*-7034*d* via which a user may specify one or more types of information to be considered (or not considered) when selecting normal or expected traffic conditions data to use when identifying anomalies for the user for the comparative traffic notification definition being created. In particular, controls 7034*a*-7034*c* may be utilized to specify that sporting event schedules, school schedules, and long-term weather forecasts, respectively, should be included or excluded when determining normal traffic conditions. In some embodiments, additional types of information may be specified, as illustrated 7034*d*, while in other embodiments users may not be allowed to customize their expected traffic conditions data (e.g., if a single type of expected conditions data is used for all users in the same types of situations, such as default forecast information or historical average speed information). In this example, by selecting one or more of the controls 7034*a*-7034*c*, the user is indicating the types of information that reflect the user's subjective understanding of normal traffic conditions, so that anomalies may be detected in a manner specific to a particular user's representation of normal or expected traffic conditions. For example, User XYZ may be a baseball fan that regularly attends professional baseball games at a stadium local to his geographic area and is aware of the home game schedule, so that User XYZ is interested in receiving notifications on game days that reflect differences from typical game day traffic conditions. Conversely, if User XYZ does not keep track of the baseball game schedule, User XYZ may prefer to receive notifications that reflect when game day traffic causes traffic conditions that vary from the typical non-game day traffic (e.g., so as to reflect heavy traffic near the stadium or surrounding roads before and after the games). Thus, by selecting (or not selecting) the sporting event schedules control 7034*a*, User XYZ indicates whether sporting event schedules should be used to determine expected traffic conditions data. In other embodiments, different techniques may be used to obtain information about a given user's expectations and/or mental model with respect to normal traffic conditions. For example, in some cases, such information may be inferred based on demographic information that is associated with the user (e.g., that the user has school-aged children and therefore likely tracks school schedules) and/or may be obtained in other contexts (e.g., during an initial sign-up process), whether with or without the knowledge of the user.

Section 7027 further includes a notification designation section 7036 that includes multiple controls 7036*a*-7036*d* via which the user may specify conditions and mechanisms for notifying the user of anomalous traffic conditions and/or related information. In particular, control 7036*a* may be utilized to specify that the user desires to be notified when traffic is worse than expected, and one or more other controls (not shown) may optionally allow the user to specify a degree or level of difference that is a threshold for the notification (e.g., a minimum number of miles-per-hour speed deviation, a particular one of multiple enumerated levels of difference, etc.). If control 7036*a* is selected, control 7036*b* may be utilized in this example to specify that the user desires to be provided with information about one or more alternative routes, such as may be provided by the Route Selector system 360 described with reference to FIG. 3. Control 7036*c* may be utilized to specify that the user desires to be notified when traffic is better than expected, and similarly may in some embodiments allow the user to specify a degree or level of difference that is a threshold for the notification. Control 7036*d* may be utilized to specify one or more preferred notification mechanisms, such as via the Web (e.g., the next time that this user receives a map or other related information for the geographic area or route to which the current comparative traffic notification definition corresponds), one or more email messages sent to a specified email address, and/or one or more SMS ("Short Message Service") messages. Various other types of notification mechanisms may be used in other embodiments.

In this example, section 7027 also includes an advanced notification settings control 7037 that may be utilized by the user to access additional user interface controls for further specifying attributes and/or criteria associated with a comparative traffic notification. For example, a user may be provided with various mechanisms to specify different and/or additional timing triggers, notification conditions and/or mechanisms, default forecast traffic information input types, etc. In addition, a user may be provided with alternative mechanisms for specifying routes of interest, such as a direct manipulation route-mapping tool that may be used to create custom travel routes. Section 7027 further includes controls 7038*a*-7038*b* via which the user may create a new comparative traffic notification definition after the various configurations have been completed or to instead reset values in the various presented user input areas to initial and/or default values, respectively. It will be appreciated that other related types of functionality to create and manage comparative traffic notification definitions may be provided in a variety of other ways in other embodiments. In addition, additional details related to displaying and otherwise providing information about anomalous and other traffic conditions are included in U.S. patent application Ser. No. 11/556,670, filed concurrently and entitled "Displaying Road Traffic Condition Information And User Controls," which is hereby incorporated by reference in its entirety.

Figure 8:
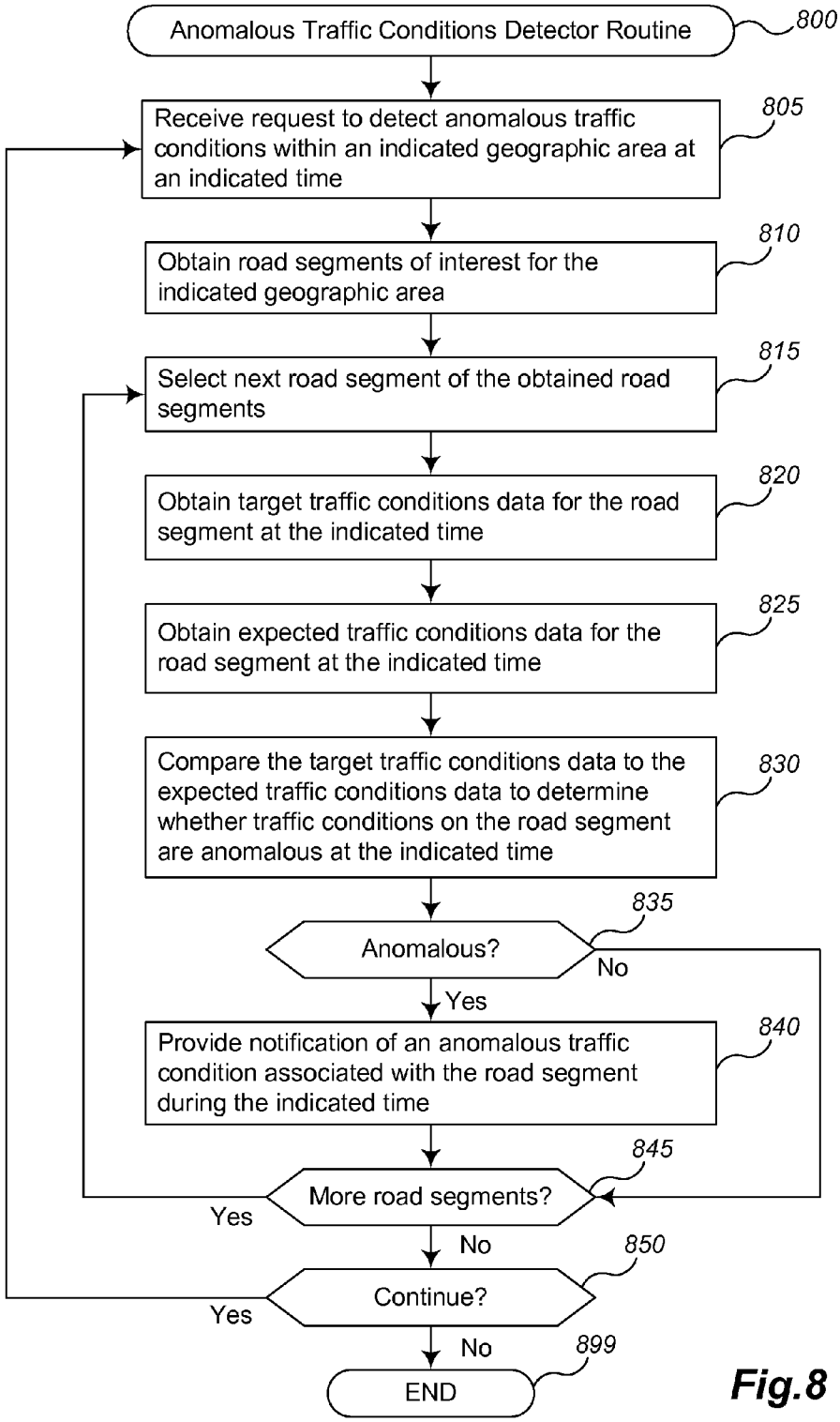
FIG. 8 is a flow diagram of an embodiment of an Anomalous Traffic Conditions Detector routine.

FIG. 8 is a flow diagram of an embodiment of an Anomalous Traffic Conditions Detector routine 800. This routine may be provided by, for example, execution of the Anomalous Traffic Conditions Detector system 365 described with reference to FIG. 3, or instead via a component (not shown) of the Predictive Traffic Information Provider system 350 described with reference to FIG. 3. The routine detects anomalous traffic conditions on the roads of an indicated geographic area, based on comparisons of target traffic conditions data (e.g., current traffic conditions data reflecting actual traffic conditions on one or more road segments) and expected traffic conditions data (e.g., forecasted traffic conditions data reflecting normal traffic conditions on one or more roads). In this example, the routine determines anomalies with respect to particular road segments and then provides indications of those anomalies, such that the indicated anomalies may be used as part of a comparative map display and/or to provide notifications or other alerts to particular users (e.g., as requested by the users), but in other embodiments the routine may perform in other manners, such as to retrieve individual user-defined comparative traffic notification definitions and analyze road traffic conditions according to those definitions.

In this example, the routine begins in step 805 and receives a request to detect anomalous traffic conditions within an indicated geographic area at an indicated selected time. The indicated time may be any time (e.g., past, current, future) for which traffic conditions data is available for use in detecting anomalies. In step 810, the routine obtains information about road segments of interest for the indicated geographic area. In some cases, this may be all road segments within the geographic area, whereas in other cases, the road segments of interest may be based on preferences expressed by one or more users, such as road segments that are parts of travel routes specified by the users via a user interface such as the one described with reference to FIG. 7K.

In steps 815-845, the routine performs a loop in which it determines whether traffic conditions associated with each of the road segments are anomalous at the indicated time. In step 815, the routine selects the next road segment of the road segments, beginning with the first. In step 820, the routine obtains target traffic conditions data for the selected road segment at the indicated time. The obtained target traffic conditions data may be based at least in part on the indicated time, as previously discussed, such as to use traffic conditions data that most accurately reflects actual or predicted traffic conditions for the indicated time. For example, if the indicated time is the current time, the routine may obtain current traffic conditions data that reflect actual traffic conditions on the road segment. On the other hand, if the indicated time is a future time that is within a predetermined time interval (e.g., three hours) of the current time, the routine may obtain predicted future traffic conditions data. Furthermore, if the indicated time is a future time that is beyond the predetermined time interval, the routine may obtain long-term forecast traffic conditions data.

In step 825, the routine obtains expected traffic conditions data for the selected road segment at the indicated time. The obtained expected traffic conditions data may also be based at least in part on the indicated time, as previously discussed, such as to use traffic conditions data that most accurately reflects traffic conditions that would be expected and/or considered normal for the indicated time. As such, the obtained expected traffic conditions data may be based on predictions that do not consider the impact of transient, temporary, or otherwise unexpected current conditions, such as accidents, current weather conditions, current traffic conditions, and/or short term construction projects. For example, if the indicated time is the current time or a future time within a predetermined time interval of the current time for which long-term forecast traffic conditions data is available, the routine may obtain default long-term forecast traffic conditions data. On the other hand, if the indicated time is a future time beyond the predetermined time interval for which long-term forecasts are available, the routine may obtain historical average conditions for the indicated time (e.g., average conditions for the indicated time of day, day of week, and/or month of year).

In step 830, the routine compares the target traffic conditions data to the expected traffic conditions data to determine whether traffic conditions on the road segment are or are not likely to be anomalous at the indicated time. For example, if the target traffic conditions data includes current actual traffic conditions data and the expected traffic conditions data includes default forecasted traffic conditions data that each include average speeds data for the road segment, the routine may compare the corresponding average speeds and determine that an anomaly exists when the actual average speed is greater or less than the expected average speed by a predetermined amount (e.g., differing by more than 15 miles per hour, differing by more than 20%, etc.). In other embodiments, other or additional measures of traffic conditions (e.g., traffic volume) may be utilized. For example, when traffic conditions information is represented as a distribution (e.g., a distribution of average traffic speeds for a road segment at a particular time or over a period of time), one or more of various statistical measures may be used to compare two such distributions (e.g., a first distribution to represent actual and/or predicted traffic conditions, and a second distribution to represent expected traffic conditions). The extent to which the two distributions differ may be calculated by statistical measures, such as the Kullback-Leibler divergence, which provides a convex measure of the similarity between two probability distributions, and a similarity difference above a predetermined or dynamically specified threshold may reflect anomalous traffic conditions. In addition, some embodiments may use other statistical measures such as statistical information entropy, whether instead of or in addition to a similarity measure such as the Kullback-Leibler divergence. The statistical entropy of a probability distribution is a measure of the diversity of the probability distribution. Statistical entropy of a probability distribution P may be expressed as follows, $$H(P) = -\sum_i P_i \log P_i$$

where $P_i$ is a value of the discretized probability distributions P (e.g., each $P_i$ is the probability that speeds within the i-th bucket of the histogram for P occurred). In addition, the difference between two statistical entropy measures may be measured by calculating the entropy difference measure. The entropy difference measure between two probability distributions P and Q may be expressed as $$EM = \|H(P) - H(Q)\|^2$$

where H(P) and H(Q) are the entropies of the probability distributions P and Q, respectively, as described above. A statistical entropy value and/or a statistical entropy difference value above a predetermined or dynamically specified threshold may reflect anomalous traffic conditions.

The statistical measures described above may be utilized in various ways in order to detect anomalous traffic conditions. In some embodiments, various information about a target traffic conditions distribution is provided as input to one or more automated classifiers, such as based on a neural network, probabilistic Bayesian network classifier, decision tree, support vector machine, etc. For example, the classifier input information may include, for example, the Kullback-Leibler divergence between an expected traffic conditions distribution for a road segment and a target traffic conditions distribution (e.g., actual and/or predicted traffic conditions distribution) for the road segment, and the statistical entropy of the target traffic conditions distribution. The classifier then assesses whether the target traffic conditions are anomalous based on the provided inputs, and provides a corresponding output. In some cases, additional information may also be provided as input to the classifier, such as information about a current or other selected time (e.g., an indication of the time-of-day, such as a time period from 5:00 AM to 9:00 AM; day or days of week, such as Monday through Thursday, Friday, Saturday or Sunday; size of mph buckets for average speed traffic conditions information; etc.).

In other embodiments, anomalous target traffic conditions may be identified without the use of an automated classifier. For example, target traffic conditions may be determined to be anomalous if one or more statistical measures are above a predetermined threshold value. For instance, target traffic conditions may be determined to be anomalous if the Kullback-Leibler divergence between target and expected traffic conditions distribution is above a first threshold value, if the statistical entropy of the target traffic conditions distribution is above a second threshold value, and/or if the entropy difference measure between the target and expected traffic conditions distribution is above a third threshold.

In addition, other non-statistical information may be utilized to determine whether target traffic conditions for a road segment are anomalous, whether in addition to or instead of statistical measures, including based on information about traffic conditions of nearby road segments (e.g., one or more adjoining road segments). For example, if a neighboring next road segment (the next road segment to which traffic on a current target road segment will travel) indicates new anomalous road traffic conditions that are significantly worse than normal, such as may be indicated by a new traffic accident that has recently occurred on the next road segment or on one or more following road segments after the next road segment, the chances may be significantly increased that traffic conditions on the target road segment will also worsen at the current time or shortly afterwards. Conversely, significantly improving traffic conditions on such next road segments may indicate that effects of one or more prior traffic accidents are dissipating, such that target traffic conditions for the target road segment will return to expected traffic conditions at the current time or shortly afterwards. Information about one or more prior road segments (the prior road segment from which traffic on a current target road segment arrives) and/or other nearby road segments (e.g., an adjoining road segment representing travel in an opposite direction on the same road at approximately the same geographic location) may similarly be used to anticipate current and/or near-term changes in actual and/or predicted road traffic conditions information for a target road segment. Furthermore, in some embodiments such information about recent and/or current traffic conditions on nearby road segments may be automatically used to update predicted road traffic conditions information for a target road segment for a current time and/or times in the near future, such as to better identify anomalous road traffic conditions for the target road segment with respect to the updated predicted road traffic conditions information that reflects current conditions on the nearby road segments.

As previously noted, the above techniques may be utilized with respect to a variety of types of traffic conditions flow information, including traffic speed, traffic volume, density, and occupancy. Additional details related to use of statistical measures and classifiers are included in U.S. patent application Ser. No. 11/540,342, filed Sep. 28, 2006 and entitled "Rectifying Erroneous Traffic Sensor Data," which is hereby incorporated by reference in its entirety.

In step 835, the routine determines whether traffic conditions were determined to be anomalous in step 830. If so, the routine continues to step 840 and provides one or more notifications of an anomalous traffic condition associated with the road segment during the indicated time. The notification may be provided in various ways, such as by formatting and transmitting a machine-readable (e.g., XML) message or other transmission that may be processed by another computing system, such as one of the third-party computing systems 390 described with reference to FIG. 3. In other embodiments, the notification may be provided to a human user and may depend on a particular notification mechanism (e.g., electronic mail, SMS, etc.) selected or otherwise specified by that user, as described in more detail with reference to FIG. 7K. Each notification may include varying amounts and types of information, such as indications of the road segment, the time for which the anomaly has been detected, a measure of the severity and/or directionality of the anomaly (e.g., an integer in the range 3 to −3 with more positive values indicating increasingly better than expected traffic conditions and more negative values indicating increasingly worse than expected traffic conditions), etc.

If it is instead determined in step 835 that an anomaly was not detected in step 830, or after step 840, the routine continues to step 845 to determine whether there are more road segments to process. If so, the routine returns to step 815. Otherwise, the routine continues to step 850 to determine whether to continue. The routine may continue, for example, if it has received other requests to detect anomalous traffic conditions, or if it was invoked to process each of one or more geographic areas for each of one or more indicated times. If it is determined in step 850 to continue, the routine returns to step 805, and otherwise ends at step 899.

While the illustrated routine 800 detects anomalies in response to a received request or indication, other embodiments may detect anomalies in other ways and/or at other times. For example, another embodiment may run continuously (e.g., as a daemon process) or periodically (e.g., every 5 minutes), such as to process some or all road segments in some or all geographic areas. Furthermore, another embodiment of the routine may record detected anomalies and/or the comparative information used to detect anomalies, such that clients (e.g., users and/or other computing systems) may be later notified by the same or some other routine. In addition, other embodiments may cache or otherwise store the results of traffic conditions data comparisons, so as to avoid performing duplicative comparisons for particular times, road segments, etc.

The following table illustrates one example of various combinations of target traffic conditions data and expected traffic conditions data that may be compared in order to detect anomalous traffic conditions. In particular, each row of the table describes the types of target and expected traffic conditions data that may be used when detecting anomalies for a given time, t, using P to represent a time horizon for which predicted traffic conditions are available.

| Time (t) | Target Data | Expected Data |
|---|---|---|
| t < current time (meaning that the selected time t is earlier than the current time, and thus has already occurred) | Prior actual traffic conditions for t | Default forecast traffic conditions for t<br>or<br>Predicted traffic conditions for t<br>or<br>Full forecast traffic conditions for t<br>or<br>Historical average traffic conditions for t |
| t = current time | Current actual traffic conditions | Default forecast traffic conditions for t<br>or<br>Predicted traffic conditions for t<br>or<br>Full forecast traffic conditions for t<br>or<br>Historical average traffic conditions for t |
| current time < t <= P | Predicted traffic conditions for t | Default forecast traffic conditions for t<br>or<br>Full forecast traffic conditions for t<br>or<br>Historical average traffic conditions for t |
| P < t | Full forecast traffic conditions for t | Default forecast traffic conditions for t<br>or<br>Historical average traffic conditions for t |

Additional details related to differences between predicted, full forecast, default forecast and historical average traffic conditions are included elsewhere. In addition, in other embodiments target and expected traffic conditions data may be selected in different ways. For example, as noted elsewhere, in some embodiments users or other systems may be able to configure the inputs upon which various types of expected traffic conditions are to be based (e.g., to base forecast traffic conditions on school schedules but not event schedules), such that expected traffic conditions may better reflect a given user's mental traffic model.

In some embodiments, the described techniques for detecting anomalous traffic conditions may be used in other ways. For example, a newly detected anomaly may indicate the existence of a traffic incident (e.g., an accident) that has recently occurred. As such, some embodiments may utilize detected anomalies to infer the likely existence of traffic incidents or other factors that may affect traffic conditions, and report the likely existence of such incidents to others (e.g., users and/or other client systems, governmental authorities and/or response teams, etc.). Such techniques may be advantageous in geographic areas for which data feeds that include reported traffic incidents are unavailable, slow (e.g., having a substantial time lag between the occurrence of an incident and its report), or otherwise unreliable. The automatic inference of the existence of traffic incidents may be based on various probabilistic models (e.g., neural networks, Bayesian networks, decision trees, etc.) that are capable of classifying the temporal (e.g., how fast one or more anomalies occur) and/or spatial (e.g., anomalies on adjacent road segments possibly indicating a spreading traffic backup due to an accident) characteristics of detected anomalies.

FIG. 7H illustrates an example display similar to that shown in FIG. 7A, but with the map showing a graphical view of total travel time for a particular travel route over the course of a day based on the currently selected day of Feb. 1, 2006. In this view, the user has selected the "Travel Time" navigation tab 781 in order to obtain the usual and actual/expected total travel times for a selected route, such as a route between Lynnwood and Seattle based on selection of the Lynnwood to Seattle route option control 782. In particular, a graph 784 is displayed that plots time of day on the x-axis 785*b* and total travel time in minutes on the y-axis 785*a*. The dark line 786*a* graphs the usual total travel time for the given travel route at the various times during the day, and the light line 786*b* graphs the current and/or predicted travel times (based on whether the currently selected day is in the past, is today, or is in the future), thus enabling easy comparison of the differences in the total travel time lines. As with respect to FIG. 7G, the usual total travel times for a route in FIG. 7H may be determined in various ways in various embodiments, including based on historical averages, by reference to a predictive model that can be used to determine expected long-term traffic condition forecasts based on historical observations and some current conditions (such as scheduled events) but not on transient or temporary situations (such as accidents and other road incidents, short-term road construction, etc.), by allowing a user to designate the types of information to be considered for the "usual" data (e.g., to use school calendar information but not events), by allowing a user or other operator to designate a particular set of data to be used for the comparison (e.g., by supplying a particular set of data, by indicating a particular past date to use, such as last Wednesday at 5 PM, etc.), etc. In addition, a time slider is not shown in this example because the predicted information provided is relative to the day of a currently selected time, although in other embodiments similar predicted difference information may be available for user-selected future times via a slider or other mechanism to select a date.

Various embodiments may further utilize various input information and provide various output information for the predictive models used to make future traffic conditions predictions. In some embodiments, inputs to the predictive models related to date and time information include the following variables: MarketId (an identifier for a geographic region); DateTimeUtc (the time of day in Universal Time); DateTimeLocal (the time of day in local time); DateTimeKey, DateDayOfWeekLocal (the day of the week); DateMonthLocal (the month of the year); DateDayLocal; DateHourLocal (the hour of the day); DatePeriod15MinutesLocal (the 15 minute interval of the day); and HolidayLocal (whether the day is a holiday). In some embodiments, inputs to the predictive models related to current and past traffic conditions information include the following variables: RoadSegmentId (an identifier for a particular road segment); SpeedX (the current reported speed of traffic on road segment X); BlackStartLocalX (the length of time that black traffic congestion level conditions have been reported for road segment X); PercentBlackX (the percentage of sensors or other data sources associated with road segment X that are reporting black traffic congestion level conditions); PercentBlackX-N, where X is a particular road segment and N is a member of {15, 30, 45, 60} and where the value corresponds to the percentage of a road segment X (e.g., percent of sensors associated with the road segment) for which black traffic conditions were reported N minutes ago; RawColor X (the current color corresponding to a level of traffic congestion on road segment X); RawColor X-N, where X is a particular road segment and N is a member of {15, 30, 45, 60}, and where the value is a color corresponding to a level of traffic congestion on road segment X N minutes ago; SinceBlackX (the length of time since black traffic congestion levels have been reported for road segment X); HealthX; and AbnormalityX. In some embodiments, inputs to the predictive models related to weather conditions information include the following variables: Temperature (current temperature); WindDirection (current wind direction); WindSpeed (current wind speed); SkyCover (current level of cloud or haze); PresentWeather (current weather state); and RainNHour, where N is a member of {1, 3, 6, 24} and represents precipitation accumulation in the previous N hour(s); and MetarId. In some embodiments, inputs to the predictive models related to event and school schedules information include the following variables: EventVenueId (a venue identifier); EventScheduleId (a schedule identifier); DateDayLocal (the day of a given event); StartHourLocal (the start hour of a given event); EventTypeId (an event type identifier); EventVenueId (a venue identifier); SchoolLocationId (a school location identifier); and IsSchoolDay (whether or not the current day is a school day).

In some embodiments, outputs to the predictive models related to traffic conditions include the following variables: RawColorXN, where X is a particular road segment and N is a member of {15, 30, 45, 60, 75, 90, 105, 120, 135, 150, 165, 180}, and where the value is a color corresponding to an expected level of traffic congestion on road segment X in N minutes time; and PredRawColorXNProb to indicate confidence in given predictions, where X and N are defined as above with reference to the RawColorXN variables and the value is the confidence level in prediction for road segment X in N minutes time (e.g., based on the level of historical support from observed data for the decision tree path taken to make the prediction).

The following illustrates one example of possible values or ranges of values that may be taken by various of the variables described above, with the indicator " . . . " between two numbers indicating that any integer between and including those two numbers are possible values (e.g., "1 . . . 4" represents {1, 2, 3, 4}), and with possible values of 0 and 1 indicating true and false for appropriate variables (e.g., casedata.HolidayLocal). In other embodiments, other input and/or output variables may be used, and their values may be represented in other manners.

| Variable Name | Example Possible Values |
|---|---|
| eventschedule.EventScheduleId | Integer |
| eventschedule.EventVenueId | Integer |
| eventschedule.Name | "Seattle Mariners Game" |
| eventschedule.DateDayLocal | 1 . . . 31 |
| eventschedule.StartHourLocal | 0 . . . 23 |
| eventschedule.EventTypeId | Integer |
| eventvenue.EventVenueId | Integer |
| eventvenue.Name | "Safeco Field" |
| eventvenue.MarketId | Integer |
| casedata.DateTimeUtc | 02/13/2006 12:15:00 |
| casedata.DateTimeLocal | 02/13/2006 04:15:00 |
| casedata.DateDayOfWeekLocal | 1 . . . 7 |
| casedata.DateMonthLocal | 1 . . . 12 |
| casedata.DateHourLocal | 0 . . . 23 |
| casedata.HolidayLocal | 0, 1 |
| roadsegmentdata.RoadSegmentId | Integer |
| roadsegmentdata.SpeedX | 0 . . . 100 (mph) |
| roadsegmentdata.BlackStartLocalX | Before 0745, 0745-0759, 0800-0814, 0815-0829, 0830-0844, 0845-0859, . . . , 1915-1929, After 1930 |
| roadsegmentdata.SinceBlackX | Integer (minutes) |
| roadsegmentdata.PercentBlackX | none, 0-15, 15-30, 30-50, 50-75, 75-100 |
| roadsegmentdata.PercentBlackX-N | none, 0-15, 15-30, 30-50, 50-75, 75-100 |
| roadsegmentdata.RawColorX | 0, 1, 2, 3 |
| roadsegmentdata.RawColorXN | 0, 1, 2, 3 |
| roadsegmentdata.RawColorX-N | 0, 1, 2, 3 |
| roadsegmentdata.ColorX | 0, 1, 2, 3 |
| roadsegmentdata.HealthX | 0, 1 |
| roadsegmentdata.AbnormalityX | 0, 1 |
| roadsegmentdata.PredRawColorXN | 0, 1, 2, 3 |
| roadsegmentdata.PredRawColorXNProb | Real [0, 1] |
| weather.MetarId | Integer |
| weather.MarketId | Integer |
| weather.Temperature | 32-40 F., 40-80 F., Extreme Heat, Freezing, Hot, Unknown |
| weather.WindDirection | N, NE, E, SE, S, SW, W, NW |
| weather.WindSpeed | Breezy, Calm, Windy, Heavy, Unknown |
| weather.SkyCover | Broken Clouds, Clear Skies, Few Clouds, Obscured Cover, Overcast, Scattered Clouds, Unknown |
| weather.PresentWeather | Blowing Snow, Clear or Fair, Cloudy, Fog, Haze, Mist, Rain, Snow, Thunderstorms, Unknown, Windy |
| weather.RainNHour | Extreme Rain, Hard Rain, No Rain, Soft Rain, Trace Rain, Unknown |
| schoollocation.SchoolLocationId | Integer |
| schoollocation.Name | "Lake Washington" |
| schoollocation.MarketId | Integer |
| schoolschedule.IsSchoolDay | 0, 1 |

Those skilled in the art will also appreciate that in some embodiments the functionality provided by the routines discussed above may be provided in alternative ways, such as being split among more routines or consolidated into fewer routines. Similarly, in some embodiments illustrated routines may provide more or less functionality than is described, such as when other illustrated routines instead lack or include such functionality respectively, or when the amount of functionality that is provided is altered. In addition, while various operations may be illustrated as being performed in a particular manner (e.g., in serial or in parallel) and/or in a particular order, those skilled in the art will appreciate that in other embodiments the operations may be performed in other orders and in other manners. Those skilled in the art will also appreciate that the data structures discussed above may be structured in different manners, such as by having a single data structure split into multiple data structures or by having multiple data structures consolidated into a single data structure. Similarly, in some embodiments illustrated data structures may store more or less information than is described, such as when other illustrated data structures instead lack or include such information respectively, or when the amount or types of information that is stored is altered.

From the foregoing it will be appreciated that, although specific embodiments have been described herein for purposes of illustration, various modifications may be made without deviating from the spirit and scope of the invention. Accordingly, the invention is not limited except as by the appended claims and the elements recited therein. In addition, while certain aspects of the invention are presented below in certain claim forms, the inventors contemplate the various aspects of the invention in any available claim form. For example, while only some aspects of the invention may currently be recited as being embodied in a computer-readable medium, other aspects may likewise be so embodied.

What is claimed is:

1. A computer-implemented method for automatically identifying abnormal traffic conditions on roads, the method comprising:

receiving information describing a network of roads in a geographic area;

for each of the roads in the network, identifying multiple segments of the road for which traffic conditions are distinctly tracked;

for each of multiple users, receiving a request from the user to be notified of abnormal traffic conditions that occur on one or more indicated road segments, wherein the received request from a first user of the multiple users includes an indication from the first user of a first specified amount of difference between actual and expected average traffic speeds for the first user; and facilitating navigation of vehicles over the network of roads using information about automatically identified abnormal traffic conditions on the roads, the facilitating of the navigation of the vehicles being performed automatically by one or more programmed computing systems and including, for each of at least some of the road segments, obtaining information indicating current actual traffic conditions for the road segment, the current actual traffic conditions including an actual average traffic speed of vehicles traveling on the road segment at a current time;

obtaining information indicating expected traffic conditions for the current time for the road segment, the expected traffic conditions reflecting a generated forecast of traffic conditions that includes an expected average traffic speed of vehicles traveling on the road segment at the current time;

automatically identifying whether the current actual traffic conditions for the road segment at the current time are abnormal with respect to the expected traffic conditions for the road segment for the current time, the identifying being based at least in part on generated comparative information for the road segment that indicates a difference between the actual and expected average traffic speeds of vehicles traveling on the road segment, wherein the identifying of whether current actual traffic conditions for a road segment are abnormal based at least in part on generated comparative information for the road segment that indicates a difference between the actual and expected average traffic speeds of vehicles traveling on the road segment includes, for the multiple users other than the first user, determining whether the difference exceeds a predetermined amount and includes, for the first user, determining whether the difference exceeds the first specified amount; and if the current actual traffic conditions for the road segment are identified as abnormal, and if one or more users has requested to be notified of abnormal traffic conditions on the road segment, providing information about the abnormal current actual traffic conditions to each of the one or more users, wherein the providing of the information about the abnormal current actual traffic conditions to each of the one or more users includes providing a notification to the first user if the difference between the actual and expected average traffic speeds of vehicles traveling on one or more of the at least some road segments exceeds the first specified amount.

2. The method of claim 1 wherein at least some of the received requests from the users each indicate road segments of interest by indicating one or more routes on the network of roads, and wherein the at least some road segments include the indicated road segments of interest.

3. The method of claim 2 wherein the at least some received requests each indicate a notification mechanism to use for notifying of abnormal traffic conditions, and wherein the providing of information about abnormal current actual traffic conditions to a user whose request indicates a notification mechanism is performed in a manner so as to use the indicated notification mechanism.

4. The method of claim 3 wherein the at least some received requests each indicate one or more times of interest, and wherein the providing of information about abnormal current actual traffic conditions to a user whose request indicates one or more times of interest is performed only if the current time is one of the indicated times of interest.

5. The method of claim 4 wherein the facilitating of the navigation of vehicles over the network of roads using information about automatically identified abnormal traffic conditions on the roads is performed repeatedly at each of multiple distinct times such that the current time changes for each performance.

6. The method of claim 1 wherein the generated forecast traffic conditions for the at least some road segments are default forecast traffic conditions generated by one or more predictive models using input information related to traffic conditions at the current time, wherein the input information includes information about time-of-day of the current time, about day-of-week of the current time, about school schedules in the geographic area at the current time, and about holiday schedules in the geographic area at the current time, and wherein the input information does not include information about current conditions at a time of generating the forecast traffic conditions, the current conditions including current traffic conditions, current traffic incidents, and current weather conditions.

7. The method of claim 6 wherein at least one of the one or more predictive models uses a Bayesian network to probabilistically generate the forecast traffic conditions.

8. The method of claim 1 wherein the providing of information about abnormal traffic conditions to each of one or more users includes at least one of sending an electronic message to the user with the information about the abnormal traffic conditions and initiating a display to the user of the information about the abnormal traffic conditions.

9. A computer-implemented method for automatically identifying abnormal traffic conditions on roads so as to facilitate travel, the method comprising:

receiving indications of multiple road segments of multiple related roads;

receiving information from a user that identifies traffic conditions that are considered to be normal by the user for one of the multiple road segments;

obtaining information about expected traffic conditions for each of the road segments for a current time, the expected traffic conditions reflecting traffic conditions that are normal for the road segments at the current time, wherein the obtained expected traffic conditions for the one road segment for the current time are based at least in part on the received information from the user;

obtaining information about target traffic conditions for each of the road segments for the current time for comparison to the expected traffic conditions for the road segments, the target traffic conditions reflecting actual traffic conditions on the road segments;

for each of the multiple road segments, comparing the target traffic conditions for the road segment for the current time to the expected traffic conditions for the road segment for the current time to automatically determine whether the target traffic conditions are abnormal with respect to normal traffic conditions for the current time, the automatic determining of whether the target traffic conditions are abnormal with respect to normal traffic conditions for the current time being performed by one or more computing systems, wherein the automatic determining that target traffic conditions for the one road segment are abnormal with respect to normal traffic conditions for the one road segment is performed on behalf of the user; and providing indications of the road segments whose target traffic conditions are determined to be abnormal for the current time to facilitate travel on the roads, wherein the providing of the indications of the road segments whose target traffic conditions are determined to be abnormal for the current time includes providing notification to the user if the target traffic conditions for the one road segment that reflect the actual traffic conditions on the one road segment differ from the identified traffic conditions that are considered to be normal by the user for the one road segment by more than a determined amount.

10. The method of claim 9 wherein the automatic determining that target traffic conditions for a road segment are abnormal with respect to normal traffic conditions for the road segment includes determining that the target traffic conditions are better than the normal traffic conditions by at least a minimum amount.

11. The method of claim 9 wherein the automatic determining that target traffic conditions for a road segment are abnormal with respect to normal traffic conditions for the road segment includes determining that the target traffic conditions are worse than the normal traffic conditions by at least a minimum amount.

12. The method of claim 9 wherein, for each of the multiple road segments, the comparing of the target traffic conditions for the road segment for the current time to the expected traffic conditions for the road segment for the current time includes generating comparative information that includes a numerical difference between the target and expected traffic conditions for the road segment.

13. The method of claim 12 wherein, for each of one or more of the multiple road segments, the target traffic conditions are determined to be abnormal with respect to normal traffic conditions if the numerical difference between the target and expected traffic conditions for the road segment exceeds a predetermined quantity.

14. The method of claim 12 wherein the providing of the indications of the road segments whose target traffic conditions are determined to be abnormal includes providing indications of the generated comparative information for at least some of the multiple road segments.

15. The method of claim 9 wherein, for each of the multiple road segments, the comparing of the target traffic conditions for the road segment for the current time to the expected traffic conditions for the road segment for the current time includes using one or more statistical measures to determine whether the target traffic conditions for the road segment are abnormal.

16. The method of claim 15 wherein the target and expected traffic conditions for the current time for the multiple road segments are each represented as a distribution of traffic speeds of vehicles traveling on the road segment at the current time, and wherein the one or more statistical measures include at least one statistical difference measure to determine an amount of difference between the target and expected traffic speed distributions for a road segment.

17. The method of claim 15 wherein the target and expected traffic conditions for the current time for the multiple road segments each have an associated probability distribution, and wherein the one or more statistical measures used to determine whether the target traffic conditions for a road segment are abnormal are applied at least in part to the associated probability distributions for the target and expected traffic conditions for the road segment.

18. The method of claim 9 wherein, for each of the multiple road segments, the automatic determining of whether the target traffic conditions for the current time for the road segment are abnormal is further based at least in part on information about traffic conditions for one or more other road segments adjoining the road segment.

19. The method of claim 18 wherein the information about traffic conditions for one or more other road segments adjoining a road segment includes information about abnormal traffic conditions for the current time for the one or more other road segments.

20. The method of claim 9 wherein, for each of the multiple road segments, the automatic determining of whether the target traffic conditions for the current time for the road segment are abnormal is further based at least in part on use of an automated classifier, the classifier using at least one of a probabilistic Bayesian network, a decision tree, a neural network, and a support vector machine.

21. The method of claim 9 wherein the obtained information about the target traffic conditions for at least some of the road segments that reflect actual traffic conditions for the at least some road segments includes measurements of actual traffic conditions on the at least some road segments that are taken within a predetermined amount of time from the current time.

22. The method of claim 9 wherein the obtained information about expected traffic conditions for at least some of the road segments includes forecasted traffic conditions information based on use of at least one predictive model whose input information includes information about conditions affecting traffic on the roads.

23. The method of claim 22 wherein the obtaining of the information about the expected traffic conditions for the road segments includes generating the information about the expected traffic conditions based at least in part on use of the at least one predictive models.

24. The method of claim 22 wherein the input information to the at least one predictive model does not include multiple of current traffic conditions, current weather conditions, current traffic incidents, future expected weather conditions, and future events that are scheduled to occur.

25. The method of claim 22 wherein the input information to the at least one predictive model includes multiple of a time-of-day for the current time, a day-of-week for the current time, a month-of-year for the current time, a holiday schedule, and a school schedule.

26. The method of claim 22 wherein the at least one predictive model includes a probabilistic Bayesian network.

27. The method of claim 9 wherein the obtained information about expected traffic conditions for each of at least some of the road segments includes information about historical average traffic conditions based on an aggregation of actual traffic conditions that have been previously observed on the road segment.

28. The method of claim 9 further comprising receiving an indication of a selected future time, comparing predicted traffic conditions on each of one or more road segments at the selected future time to normal traffic conditions on that road segment at that future time so as to automatically determine whether the predicted traffic conditions at that future time on that road segment are abnormal with respect to the normal traffic conditions at that future time on that road segment, and providing indications of the road segments whose predicted traffic conditions at the selected future time are determined to be abnormal.

29. The method of claim 28 wherein the predicted traffic conditions on each of the one or more road segments at the selected future time are predictions that are generated for the road segment for the future time based in part on current conditions at a time of the generating.

30. The method of claim 28 wherein the normal traffic conditions on each of the one or more road segments at the selected future time are forecasts that are generated for the road segment for the future time without using current traffic conditions at a time of the generating.

31. The method of claim 9 wherein the expected traffic conditions for each of the road segments include expected average traffic speed for the road segment, and wherein the target traffic conditions for each of the road segments include actual average traffic speed for the road segment.

32. The method of claim 9 wherein the expected traffic conditions for each of the road segments include expected traffic volume for the road segment during a period of time, and wherein the target traffic conditions for each of the road segments include actual traffic volume for the road segment during the period of time.

33. The method of claim 9 wherein the expected traffic conditions for each of the road segments include expected traffic occupancy percentage for at least one location of the road segment during a period of time, and wherein the target traffic conditions for each of the road segments include actual traffic occupancy percentage for at least one location of the road segment during the period of time.

34. The method of claim 9 wherein one or more users have each requested notification of abnormal traffic conditions for at least one selected road segment, and wherein the providing of the indications of the road segments whose target traffic conditions are determined to be abnormal includes sending one or more electronic messages to each of the one or more users who have selected at least one of the road segments whose target traffic conditions are determined to be abnormal.

35. The method of claim 9 wherein the providing of the indications of one or more of the road segments whose target traffic conditions are determined to be abnormal includes initiating display to each of one or more users of a map that includes representations of the one or more road segments, the map indicating for each of the one or more road segments a numerical difference between the target traffic conditions for the road segment and the expected traffic conditions for the road segment.

36. The method of claim 9 further comprising, after automatically determining that the target traffic conditions for one or more of the road segments are abnormal, automatically inferring an occurrence of a traffic incident based at least in part on the determination of the abnormality of the target traffic conditions for the one or more road segments.

37. A computer-implemented method for automatically identifying abnormal traffic conditions on roads so as to facilitate travel, the method comprising:

receiving indications of multiple road segments of multiple related roads;

obtaining information about expected traffic conditions for each of the road segments for a current time, the expected traffic conditions reflecting traffic conditions that are normal for the road segments at the current time;

obtaining information about target traffic conditions for each of the road segments for the current time for comparison to the expected traffic conditions for the road segments, the target traffic conditions reflecting actual traffic conditions on the road segments;

for each of the multiple road segments, comparing the target traffic conditions for the road segment for the current time to the expected traffic conditions for the road segment for the current time to automatically determine whether the target traffic conditions are abnormal with respect to normal traffic conditions for the current time, the automatic determining of whether the target traffic conditions are abnormal with respect to normal traffic conditions for the current time being performed by one or more computing systems;

providing indications of the road segments whose target traffic conditions are determined to be abnormal for the current time to facilitate travel on the roads; and receiving an indication of a selected past time, comparing actual traffic conditions on each of one or more road segments at the selected past time to normal traffic conditions on that road segment at that past time so as to automatically determine whether the actual traffic conditions at that past time on that road segment are abnormal with respect to the normal traffic conditions at that past time on that road segment, and providing indications of the road segments whose actual traffic conditions at the selected past time are determined to be abnormal.

38. A non-transitory computer-readable storage medium whose stored contents configure a computing device to automatically identify abnormal traffic conditions on roads so as to facilitate travel, by performing a method comprising:

receiving indications of multiple road segments;

obtaining information about expected traffic conditions for each of the road segments for a current time, the expected traffic conditions reflecting traffic conditions that are normal for the road segments at the current time, the traffic conditions that are normal for the road segments at the current time including information specific to a first user that indicates traffic conditions for at least one of the road segments that are normal for the first user for the at least one road segments at the current time;

obtaining information about target traffic conditions for each of the road segments for the current time for comparison to the expected traffic conditions for the road segments, the target traffic conditions reflecting actual traffic conditions on the road segments;

for each of the multiple road segments, comparing the target traffic conditions for the road segment for the current time to the expected traffic conditions for the road segment for the current time to automatically determine whether the target traffic conditions are abnormal with respect to normal traffic conditions for the current time, the automatic determining of whether the target traffic conditions are abnormal with respect to normal traffic conditions for the current time including determining whether the indicated traffic conditions for the at least one road segments that are normal for the first user differ by at least a determined amount from the target traffic conditions for the at least one road segments for the current time; and providing indications of the road segments whose target traffic conditions are determined to be abnormal, the providing of the indications including notifying the first user if the target traffic conditions for one or more of the at least one road segments for the current time are determined to differ by at least the determined amount from the indicated traffic conditions for the at least one road segments that are normal for the first user.

39. The non-transitory computer-readable storage medium of claim 38 wherein, for each of at least one of the multiple road segments, the comparing of the target traffic conditions for the road segment for the current time to the expected traffic conditions for the road segment for the current time includes generating comparative information that includes a numerical difference between the target and expected traffic conditions for the road segment, and wherein the providing of the indications of the road segments whose target traffic conditions are determined to be abnormal includes providing indications of the generated comparative information for one or more of the at least one road segments.

40. The non-transitory computer-readable storage medium of claim 38 wherein the obtained information about the target traffic conditions for at least some of the road segments includes measurements of actual traffic conditions on the at least some road segments that are taken within a predetermined amount of time from the current time, and wherein the obtained information about expected traffic conditions for the at least some road segments includes forecasted traffic conditions information based on use of at least one predictive model whose input information includes information about conditions affecting traffic on the roads.

41. The non-transitory computer-readable storage medium of claim 38 wherein the method further comprises receiving an indication of a selected past time, comparing actual traffic conditions on each of one or more road segments at the selected past time to normal traffic conditions on that road segment at that past time so as to automatically determine whether the actual traffic conditions at that past time on that road segment are abnormal with respect to the normal traffic conditions at that past time on that road segment, and providing indications of the road segments whose actual traffic conditions at the selected past time are determined to be abnormal.

42. The non-transitory computer-readable storage medium of claim 38 wherein the method further comprises receiving an indication of a selected future time, comparing predicted traffic conditions on each of one or more road segments at the selected future time to normal traffic conditions on that road segment at that future time so as to automatically determine whether the predicted traffic conditions at that future time on that road segment are abnormal with respect to the normal traffic conditions at that future time on that road segment, and providing indications of the road segments whose predicted traffic conditions at the selected future time are determined to be abnormal.

43. The non-transitory computer-readable storage medium of claim 38 wherein the providing of the indications of one or more of the road segments whose target traffic conditions are determined to be abnormal includes initiating display to each of one or more users that include the first user of a map that includes representations of the one or more road segments, the map indicating for each of the one or more road segments a numerical difference between the target traffic conditions for the road segment and the expected traffic conditions for the road segment.

44. The non-transitory computer-readable storage medium of claim 38 wherein the computer-readable medium is a memory of the computing device, and wherein the contents are instructions that when executed cause the computing device to perform the method.

45. A computing device configured to automatically identify abnormal traffic conditions on roads so as to facilitate travel, comprising:

one or more processors; and a first component configured to, when executed by at least one of the one or more processors, and for each of multiple indicated road segments:

receive information from a user that identifies traffic conditions that are considered to be normal by the user for the road segment;

obtain information about expected traffic conditions for the road segment for a current time, the expected traffic conditions reflecting traffic conditions that are normal for the road segment at the current time and being based at least in part on the received information from the user;

obtain information about target traffic conditions for the road segment for the current time for comparison to the expected traffic conditions for the road segment, the target traffic conditions reflecting actual traffic conditions on the road segment;

compare the target traffic conditions for the road segment for the current time to the expected traffic conditions for the road segment for the current time to automatically determine that the target traffic conditions are abnormal with respect to normal traffic conditions for the current time, the automatic determining that the target traffic conditions are abnormal being performed on behalf of the user; and provide an indication of the road segment having target traffic conditions that are determined to be abnormal, wherein the providing of the indication includes providing notification to the user if the target traffic conditions differ from the expected traffic conditions by more than a determined amount.

46. The computing device of claim 45 wherein the first component includes software instructions for execution by the at least one processors of the computing device.

* * * * *